US010926142B2

(12) United States Patent
Parsons et al.

(10) Patent No.: US 10,926,142 B2
(45) **Date of Patent: *Feb. 23, 2021**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/774,449

(22) Filed: Jan. 28, 2020

(65) Prior Publication Data

US 2020/0179771 A1 Jun. 11, 2020

Related U.S. Application Data

(63) Continuation-in-part of application No. 16/372,009, filed on Apr. 1, 2019, now Pat. No. 10,821,334, (Continued)

(51) Int. Cl.

| | |
|---|---|
| ***A63B 53/04*** | (2015.01) |
| ***A63B 60/02*** | (2015.01) |
| *A63B 60/54* | (2015.01) |

(52) U.S. Cl.
CPC ..... *A63B 53/0466* (2013.01); *A63B 53/04* (2013.01); *A63B 60/02* (2015.10); (Continued)

(58) Field of Classification Search
CPC .... A63B 2053/0454; A63B 2053/0491; A63B 60/54; A63B 53/0466; A63B 2053/0433; (Continued)

(56) References Cited

U.S. PATENT DOCUMENTS

| | | | |
|---|---|---|---|
| 1,133,129 | A | 3/1915 | James |
| 1,269,745 | A | 6/1918 | William |

(Continued)

OTHER PUBLICATIONS

International Search Report and Written Opinion Issued in Connection With Corresponding Application No. PCT/US2015/042282 dated Oct. 13, 2015 (12 Pages).

(Continued)

*Primary Examiner* — Benjamin Layno

(57) ABSTRACT

Embodiments of golf club heads and methods to manufacture golf club heads are generally described herein. In one example, a golf club head may include a body portion having a toe portion, a heel portion, a top portion, a bottom portion, a rear portion, and a front portion having a face portion. The body portion may include a cavity wall portion extending from the top portion to the bottom portion. The body portion may include a first interior cavity portion and a second interior cavity portion. Other examples and embodiments may be described and claimed.

20 Claims, 33 Drawing Sheets

Related U.S. Application Data which is a continuation of application No. 15/875,416, filed on Jan. 19, 2018, now Pat. No. 10,293,220, which is a continuation of application No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, application No. 16/774,449, which is a continuation-in-part of application No. 16/290,610, filed on Mar. 1, 2019, now Pat. No. 10,617,918, which is a continuation of application No. 15/875,496, filed on Jan. 19, 2018, now Pat. No. 10,252,123, which is a continuation of application No. 15/457,627, filed on Mar. 13, 2017, now Pat. No. 9,895,583, which is a continuation of application No. 15/189,806, filed on Jun. 22, 2016, now Pat. No. 9,636,554, which is a continuation of application No. 14/667,546, filed on Mar. 24, 2015, now Pat. No. 9,399,158, which is a continuation of application No. 14/615,606, filed on Feb. 6, 2015, now Pat. No. 9,199,140, application No. 16/774,449, which is a continuation-in-part of application No. 16/375,553, filed on Apr. 4, 2019, now Pat. No. 10,695,623, which is a continuation of application No. 15/967,117, filed on Apr. 30, 2018, now Pat. No. 10,293,221, said application No. 15/875,416 is a continuation of application No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, said application No. 15/967,117 is a continuation-in-part of application No. 15/875,496, filed on Jan. 19, 2018, now Pat. No. 10,252,123, said application No. 15/457,627 is a continuation of application No. 15/189,806, filed on Jun. 22, 2016, now Pat. No. 9,636,554, said application No. 14/667,546 is a continuation-in-part of application No. 14/615,606, filed on Feb. 6, 2015, now Pat. No. 9,199,140, application No. 16/774,449, which is a continuation-in-part of application No. 16/375,553, filed on Apr. 4, 2019, now Pat. No. 10,695,623, which is a continuation of application No. 15/967,117, filed on Apr. 30, 2018, now Pat. No. 10,293,221, which is a continuation of application No. 15/457,618, filed on Mar. 13, 2017, now Pat. No. 9,987,526, which is a continuation of application No. 15/163,393, filed on May 24, 2016, now Pat. No. 9,662,547, which is a continuation of application No. 14/667,541, filed on Mar. 24, 2015, now Pat. No. 9,352,197, application No. 16/774,449, which is a continuation-in-part of application No. 16/418,691, filed on May 21, 2019, now Pat. No. 10,653,928, which is a continuation of application No. 15/803,157, filed on Nov. 3, 2017, now Pat. No. 10,335,645, which is a continuation of application No. 15/290,859, filed on Oct. 11, 2016, now Pat. No. 9,814,945, which is a continuation of application No. 15/040,892, filed on Feb. 10, 2016, now Pat. No. 9,550,096, application No. 16/774,449, which is a continuation-in-part of application No. 16/539,397, filed on Aug. 13, 2019, now Pat. No. 10,786,712, which is a continuation of application No. 16/035,268, filed on Jul. 13, 2018, now Pat. No. 10,420,990, which is a continuation of application No. 15/725,900, filed on Oct. 5, 2017, now Pat. No. 10,052,532, which is a continuation of application No. 15/445,253, filed on Feb. 28, 2017, now Pat. No. 9,795,843, which is a continuation of application No. 15/227,281, filed on Aug. 3, 2016, now Pat. No. 9,782,643, application No. 16/774,449, which is a continuation-in-part of application No. 16/713,942, filed on Dec. 13, 2019, which is a continuation of application No. 16/198,128, filed on Nov. 21, 2018, now Pat. No. 10,532,257, which is a continuation of application No. 15/583,756, filed on May 1, 2017, now Pat. No. 10,143,899, which is a continuation of application No. 15/271,574, filed on Sep. 21, 2016, now Pat. No. 9,669,270, application No. 16/774,449, which is a continuation-in-part of application No. 16/710,903, filed on Dec. 11, 2019, which is a continuation of application No. 15/994,860, filed on May 31, 2018, now Pat. No. 10,543,407, which is a continuation of application No. 15/807,201, filed on Nov. 8, 2017, now Pat. No. 10,010,770, which is a continuation of application No. 15/463,306, filed on Mar. 20, 2017, now Pat. No. 9,821,200, which is a continuation of application No. 15/249,857, filed on Aug. 29, 2016, now Pat. No. 9,630,070, application No. 16/774,449, which is a continuation-in-part of application No. 16/222,580, filed on Dec. 17, 2018, now Pat. No. 10,722,764, which is a continuation of application No. 15/831,148, filed on Dec. 4, 2017, now Pat. No. 10,195,501, which is a continuation of application No. 15/453,701, filed on Mar. 8, 2017, now Pat. No. 9,833,667, application No. 16/774,449, which is a continuation-in-part of application No. 16/542,548, filed on Aug. 16, 2019, which is a continuation of application No. 15/967,098, filed on Apr. 30, 2018, now Pat. No. 10,420,989, which is a continuation of application No. 15/687,273, filed on Aug. 25, 2017, now Pat. No. 9,981,160, application No. 16/774,449, which is a continuation-in-part of application No. 16/265,686, filed on Feb. 1, 2019, now Pat. No. 10,617,917, which is a continuation-in-part of application No. 15/910,747, filed on Mar. 2, 2018, now Pat. No. 10,232,234, which is a continuation of application No. 15/477,972, filed on Apr. 3, 2017, now Pat. No. 9,914,029, which is a continuation of application No. 15/406,408, filed on Jan. 13, 2017, now Pat. No. 9,861,867, application No. 16/774,449, which is a continuation-in-part of application No. 16/502,987, filed on Jul. 3, 2019, now Pat. No. 10,709,942, which is a continuation of application No. 15/981,094, filed on May 16, 2018, now Pat. No. 10,384,102, which is a continuation of application No. 15/724,035, filed on Oct. 3, 2017, now Pat. No. 9,999,814, which is a continuation of application No. 15/440,968, filed on Feb. 23, 2017, now Pat. No. 9,795,842, application No. 16/774,449, which is a continuation-in-part of application No. 15/970,665, filed on May 3, 2018, which is a continuation of application No. 15/667,343, filed on Aug. 2, 2017, now Pat. No. 10,213,659, application No. 16/774,449, which is a continuation-in-part of application No. 16/533,352, filed on Aug. 6, 2019, now Pat. No.

10,843,051, which is a continuation of application No. 16/030,403, filed on Jul. 9, 2018, now Pat. No. 10,413,787, application No. 16/774,449, which is a continuation of application No. 16/179,406, filed on Nov. 2, 2018, now Pat. No. 10,583,336.

(60) Provisional application No. 62/042,155, filed on Aug. 26, 2014, provisional application No. 62/048,693, filed on Sep. 10, 2014, provisional application No. 62/101,543, filed on Jan. 9, 2015, provisional application No. 62/105,123, filed on Jan. 19, 2015, provisional application No. 62/109,510, filed on Jan. 29, 2015, provisional application No. 62/115,024, filed on Feb. 11, 2015, provisional application No. 62/120,760, filed on Feb. 25, 2015, provisional application No. 62/138,918, filed on Mar. 26, 2015, provisional application No. 62/184,757, filed on Jun. 25, 2015, provisional application No. 62/194,135, filed on Jul. 17, 2015, provisional application No. 62/195,211, filed on Jul. 21, 2015, provisional application No. 62/281,639, filed on Jan. 21, 2016, provisional application No. 62/296,506, filed on Feb. 17, 2016, provisional application No. 62/301,756, filed on Mar. 1, 2016, provisional application No. 62/362,491, filed on Jul. 14, 2016, provisional application No. 62/291,793, filed on Feb. 5, 2016, provisional application No. 62/337,184, filed on May 16, 2016, provisional application No. 62/361,988, filed on Jul. 13, 2016, provisional application No. 62/356,539, filed on Jun. 30, 2016, provisional application No. 62/360,802, filed on Jul. 11, 2016, provisional application No. 62/380,727, filed on Aug. 29, 2016, provisional application No. 62/406,856, filed on Oct. 11, 2016, provisional application No. 62/412,389, filed on Oct. 25, 2016, provisional application No. 62/419,242, filed on Nov. 8, 2016, provisional application No. 62/444,671, filed on Jan. 10, 2017, provisional application No. 62/445,878, filed on Jan. 13, 2017, provisional application No. 62/512,275, filed on May 30, 2017, provisional application No. 62/530,734, filed on Jul. 10, 2017, provisional application No. 62/624,294, filed on Jan. 31, 2018, provisional application No. 62/581,456, filed on Nov. 3, 2017.

(52) U.S. Cl.
CPC ..... *A63B 53/0408* (2020.08); *A63B 53/0412* (2020.08); *A63B 53/0433* (2020.08); *A63B 53/0475* (2013.01); *A63B 60/54* (2015.10); *A63B 2053/0491* (2013.01)

(58) Field of Classification Search
CPC ..... A63B 53/04; A63B 53/0475; A63B 2053/0408
USPC ..... 473/334–339, 332, 346, 350, 333
See application file for complete search history.

(56) References Cited

U.S. PATENT DOCUMENTS

| | | | | |
|---|---|---|---|---|
| 1,306,029 | A | 6/1919 | Robertson | |
| D55,864 | S | 7/1920 | Mattern | |
| 1,534,600 | A | 4/1925 | Mattern | |
| 1,538,312 | A | 5/1925 | Beat | |
| D138,437 | S | 8/1944 | Link | |
| D138,438 | S | 8/1944 | Link | |
| D138,442 | S | 8/1944 | Link | |
| 3,556,533 | A | 1/1971 | Hollis | |
| 3,652,094 | A | 3/1972 | Glover | |
| D240,748 | S | 7/1976 | Bock et al. | |
| 4,085,934 | A | 4/1978 | Churchward | |
| D253,778 | S | 12/1979 | Madison | |
| 4,754,977 | A | 7/1988 | Sahm | |
| D307,783 | S | 5/1990 | Iinuma | |
| 5,106,094 | A * | 4/1992 | Desbiolles | A63B 53/04 473/342 |
| D326,885 | S | 6/1992 | Paul | |
| 5,219,408 | A | 6/1993 | Sun | |
| D351,883 | S | 10/1994 | Solheim et al. | |
| 5,447,311 | A | 9/1995 | Viollaz et al. | |
| 5,467,983 | A * | 11/1995 | Chen | A63B 53/04 473/342 |
| 5,518,243 | A | 5/1996 | Redman | |
| D378,111 | S | 2/1997 | Parente et al. | |
| D384,120 | S | 9/1997 | Cruz et al. | |
| 5,788,584 | A | 8/1998 | Parente et al. | |
| D400,625 | S | 11/1998 | Kubica et al. | |
| D400,627 | S | 11/1998 | Kubica et al. | |
| D405,489 | S | 2/1999 | Kubica et al. | |
| D405,492 | S | 2/1999 | Kubica et al. | |
| 5,997,415 | A | 12/1999 | Wood | |
| D444,830 | S | 7/2001 | Kubica et al. | |
| 6,290,609 | B1 | 9/2001 | Takeda | |
| 6,306,048 | B1 | 10/2001 | Mccabe et al. | |
| 6,409,612 | B1 | 6/2002 | Clayton et al. | |
| D478,140 | S | 8/2003 | Burrows | |
| 6,607,451 | B2 * | 8/2003 | Kosmatka | A63B 53/04 473/329 |
| 6,638,182 | B2 | 10/2003 | Kosmatka | |
| 6,773,360 | B2 | 8/2004 | Willett et al. | |
| 6,811,496 | B2 | 11/2004 | Wahl et al. | |
| D508,969 | S | 8/2005 | Hasebe | |
| D513,051 | S | 12/2005 | Barez et al. | |
| 6,979,270 | B1 * | 12/2005 | Allen | A63B 53/04 473/290 |
| D514,179 | S | 1/2006 | Chen et al. | |
| D514,185 | S | 1/2006 | Barez et al. | |
| D520,586 | S | 5/2006 | Bingman | |
| D522,077 | S | 5/2006 | Schweigert et al. | |
| D522,601 | S | 6/2006 | Schweigert et al. | |
| D523,498 | S | 6/2006 | Chen et al. | |
| D526,694 | S | 8/2006 | Schweigert et al. | |
| 7,083,530 | B2 | 8/2006 | Wahl et al. | |
| 7,121,956 | B2 | 10/2006 | Lo | |
| D534,599 | S | 1/2007 | Barez et al. | |
| 7,166,040 | B2 | 1/2007 | Hoffman et al. | |
| D536,401 | S | 2/2007 | Kawami | |
| D536,403 | S | 2/2007 | Kawami | |
| 7,186,190 | B1 | 3/2007 | Beach et al. | |
| 7,223,180 | B2 | 5/2007 | Willett et al. | |
| 7,261,646 | B2 | 8/2007 | De Shiell et al. | |
| 7,303,486 | B2 | 12/2007 | Imamoto | |
| D563,498 | S | 3/2008 | Jertson et al. | |
| D564,054 | S | 3/2008 | Jertson et al. | |
| D564,055 | S | 3/2008 | Jertson et al. | |
| 7,338,388 | B2 | 3/2008 | Schweigert et al. | |
| 7,347,794 | B2 | 3/2008 | Schweigert | |
| D567,317 | S | 4/2008 | Jertson et al. | |
| D569,933 | S | 5/2008 | Jertson et al. | |
| D569,934 | S | 5/2008 | Jertson et al. | |
| D569,935 | S | 5/2008 | Schweigert et al. | |
| D569,936 | S | 5/2008 | Schweigert et al. | |
| D569,942 | S | 5/2008 | Jertson et al. | |
| D570,937 | S | 6/2008 | Schweigert et al. | |
| D570,938 | S | 6/2008 | Jertson et al. | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,448,964 | B2 | 11/2008 | Schweigert et al. | |
| 7,494,425 | B2 | 2/2009 | De Shiell et al. | |
| 7,530,904 | B2 | 5/2009 | Beach et al. | |
| D594,520 | S | 6/2009 | Schweigert et al. | |
| D594,521 | S | 6/2009 | Jertson et al. | |
| D594,919 | S | 6/2009 | Schweigert et al. | |

(56) References Cited

U.S. PATENT DOCUMENTS

| | | | |
|---|---|---|---|
| 7,540,811 | B2 | 6/2009 | Beach et al. |
| D597,620 | S | 8/2009 | Taylor et al. |
| 7,568,985 | B2 | 8/2009 | Beach et al. |
| 7,578,753 | B2 | 8/2009 | Beach et al. |
| D600,297 | S | 9/2009 | Jertson et al. |
| 7,584,531 | B2 | 9/2009 | Schweigert et al. |
| 7,588,502 | B2 | 9/2009 | Nishino |
| 7,591,738 | B2 | 9/2009 | Beach et al. |
| D603,472 | S | 11/2009 | Schweigert et al. |
| 7,611,424 | B2 | 11/2009 | Nagai et al. |
| 7,621,823 | B2 | 11/2009 | Beach et al. |
| D605,715 | S | 12/2009 | Barez et al. |
| 7,632,194 | B2 | 12/2009 | Hoffman et al. |
| 7,658,686 | B2 | 2/2010 | Soracco |
| 7,713,142 | B2 | 5/2010 | Hoffman et al. |
| 7,717,804 | B2 | 5/2010 | Beach et al. |
| 7,717,805 | B2 | 5/2010 | Beach et al. |
| D618,746 | S | 6/2010 | Jertson et al. |
| D618,747 | S | 6/2010 | Schweigert et al. |
| D618,753 | S | 6/2010 | Jertson et al. |
| D618,754 | S | 6/2010 | Schweigert et al. |
| 7,744,484 | B1 | 6/2010 | Chao |
| 7,798,203 | B2 | 9/2010 | Schweigert et al. |
| 7,846,041 | B2 | 12/2010 | Beach et al. |
| D635,626 | S | 4/2011 | Nicolette |
| 7,927,229 | B2 | 4/2011 | Jertson et al. |
| D638,893 | S | 5/2011 | Schweigert et al. |
| D638,896 | S | 5/2011 | Schweigert et al. |
| 7,963,861 | B2 | 6/2011 | Beach et al. |
| 8,012,038 | B1 | 9/2011 | Beach et al. |
| D647,585 | S | 10/2011 | Jertson et al. |
| 8,088,025 | B2 | 1/2012 | Wahl et al. |
| 8,096,896 | B2 | 1/2012 | Deshiell et al. |
| D661,751 | S | 6/2012 | Nicolette et al. |
| D661,756 | S | 6/2012 | Nicolette et al. |
| 8,257,196 | B1 | 9/2012 | Abbott et al. |
| 8,257,197 | B2 | 9/2012 | Schweigert |
| 8,262,506 | B2 | 9/2012 | Watson et al. |
| 8,287,402 | B2 | 10/2012 | De Shiell et al. |
| D673,630 | S | 1/2013 | Schweigert |
| D673,632 | S | 1/2013 | Schweigert et al. |
| 8,371,957 | B2 | 2/2013 | Schweigert et al. |
| D680,179 | S | 4/2013 | Solheim et al. |
| 8,414,422 | B2 | 4/2013 | Peralta et al. |
| 8,485,919 | B2 | 7/2013 | Rice et al. |
| D691,230 | S | 10/2013 | Chen et al. |
| 8,562,457 | B2 | 10/2013 | Beach et al. |
| 8,608,587 | B2 | 12/2013 | Henrikson et al. |
| 8,628,431 | B2 | 1/2014 | Schweigert et al. |
| 8,651,975 | B2 | 2/2014 | Soracco |
| 8,663,026 | B2 | 3/2014 | Anderson et al. |
| 8,777,778 | B2 | 7/2014 | Solheim et al. |
| 8,784,232 | B2 | 7/2014 | Jertson et al. |
| 8,790,196 | B2 | 7/2014 | Solheim et al. |
| 8,808,108 | B2 | 8/2014 | Schweigert |
| D712,989 | S | 9/2014 | Gillig |
| 8,826,512 | B2 | 9/2014 | Schweigert |
| 8,858,362 | B1 | 10/2014 | Leposky et al. |
| 8,961,336 | B1 | 2/2015 | Parsons et al. |
| D724,164 | S | 3/2015 | Schweigert et al. |
| 8,979,671 | B1 | 3/2015 | Demille et al. |
| D729,892 | S | 5/2015 | Nicolette et al. |
| D733,234 | S | 6/2015 | Nicolette |
| 9,199,140 | B1 | 12/2015 | Schweigert et al. |
| 9,199,143 | B1 | 12/2015 | Parsons et al. |
| D753,251 | S | 4/2016 | Schweigert et al. |
| D756,471 | S | 5/2016 | Nicolette et al. |
| 9,352,197 | B2 | 5/2016 | Parsons et al. |
| D760,334 | S | 6/2016 | Schweigert et al. |
| 9,399,352 | B2 | 7/2016 | Mizutani et al. |
| 9,427,634 | B2 | 8/2016 | Parsons et al. |
| 9,452,325 | B2 | 9/2016 | Deshiell et al. |
| 9,550,096 | B2 | 1/2017 | Parsons et al. |
| 9,630,070 | B2 | 4/2017 | Parsons et al. |
| 9,795,842 | B1 | 10/2017 | Parsons et al. |
| 9,839,821 | B2 | 12/2017 | Deshiell et al. |
| 10,583,336 | B2 * | 3/2020 | Parsons ..... A63B 60/02 |
| 2002/0019265 | A1 * | 2/2002 | Allen ..... A63B 60/00 473/329 |
| 2003/0104878 | A1 | 6/2003 | Yabu |
| 2003/0148818 | A1 | 8/2003 | Myrhum et al. |
| 2004/0033846 | A1 | 2/2004 | Caldwell |
| 2004/0043833 | A1 | 3/2004 | Andrew et al. |
| 2004/0087388 | A1 * | 5/2004 | Beach ..... A63B 53/0466 473/334 |
| 2006/0015049 | A1 | 1/2006 | Suarez et al. |
| 2006/0105856 | A1 | 5/2006 | Lo |
| 2006/0111200 | A1 | 5/2006 | Poynor |
| 2007/0004527 | A1 | 1/2007 | Helmstetter |
| 2007/0129161 | A1 | 6/2007 | Matsunaga et al. |
| 2007/0238551 | A1 | 10/2007 | Yokota |
| 2007/0293344 | A1 | 12/2007 | Davis |
| 2008/0004133 | A1 | 1/2008 | Schweigert |
| 2008/0015049 | A1 | 1/2008 | Imamoto |
| 2008/0188322 | A1 | 8/2008 | Anderson et al. |
| 2009/0029795 | A1 | 1/2009 | Schweigert et al. |
| 2010/0144461 | A1 | 6/2010 | Ban |
| 2010/0167837 | A1 | 7/2010 | Ban |
| 2010/0323812 | A1 * | 12/2010 | Boyd ..... A63B 53/0466 473/329 |
| 2010/0331102 | A1 | 12/2010 | Golden et al. |
| 2011/0143858 | A1 | 6/2011 | Peralta et al. |
| 2012/0142445 | A1 | 6/2012 | Burnett et al. |
| 2012/0190479 | A1 | 7/2012 | Rice et al. |
| 2012/0202615 | A1 | 8/2012 | Beach et al. |
| 2012/0220387 | A1 | 8/2012 | Beach et al. |
| 2013/0210542 | A1 | 8/2013 | Harbert et al. |
| 2013/0303304 | A1 | 11/2013 | Sato |
| 2013/0318772 | A1 | 12/2013 | Wahl et al. |
| 2014/0187346 | A1 | 7/2014 | Beno et al. |
| 2014/0235369 | A1 | 8/2014 | Willett et al. |
| 2014/0349779 | A1 | 11/2014 | Mizutani |
| 2015/0231454 | A1 | 8/2015 | Parsons et al. |
| 2015/0231458 | A1 | 8/2015 | Petersen et al. |
| 2015/0231806 | A1 | 8/2015 | Parsons et al. |
| 2015/0360098 | A1 | 12/2015 | Parsons et al. |
| 2016/0059090 | A1 | 3/2016 | Parsons et al. |
| 2016/0339308 | A1 | 11/2016 | Parsons et al. |
| 2018/0056144 | A1 | 3/2018 | Parsons et al. |

OTHER PUBLICATIONS

International Search Report and Written Opinion Issued in Connection With Corresponding Application No. PCT/US2015/42484 dated Oct. 19, 2015 (12 Pages).

International Search Report and Written Opinion Received in Connection With the Corresponding Application No. PCT/US2015/016666, dated May 14, 2015 (10 Pages).

International Search Report and Written Opinion Received in Connection With the Corresponding Application No. PCT/US2016/17474, dated May 12, 2016 (13 Pages).

International Search Report and Written Opinion Received in Connection With the Corresponding Application No. PCT/US2017/013513, dated Mar. 17, 2017 (10 Pages).

International Search Report and Written Opinion Received in Connection With the Corresponding Application No. PCT/US2017/28402, dated Jul. 18, 2017 (9 Pages).

Spotted: Three New PXG Drivers Appear on the USGA Conforming List (GOLFWRX). Dec. 18, 2017. Retrieved From the Internet on Jan. 16, 2019. URL: .

Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation-in-part of application Ser. No. 16/372,009, filed Apr. 1, 2019, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

This application is a continuation-in-part of application Ser. No. 16/290,610, filed Mar. 1, 2019, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part of application Ser. No. 16/375,553, filed Apr. 4, 2019, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197.

This application is a continuation-in-part of application Ser. No. 16/418,691, filed May 21, 2019, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

This application is a continuation-in-part of application Ser. No. 16/539,397, filed Aug. 13, 2019, which is a continuation of application Ser. No. 16/035,268, filed Jul. 13, 2018, now U.S. Pat. No. 10,420,990, which is a continuation of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

This application is a continuation-in-part application Ser. No. 16/713,942, filed Dec. 13, 2019, which is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

This application is a continuation-in-part of application Ser. No. 16/710,903, filed Dec. 11, 2019, which is a continuation of application Ser. No. 15/994,860, filed May 31, 2018, which is a continuation of application Ser. No. 15/807,201, filed Nov. 8, 2017, now U.S. Pat. No. 10,010,770, which is a continuation of application Ser. No. 15/463,306, filed Mar. 20, 2017, now U.S. Pat. No. 9,821,200, which is a continuation of application Ser. No. 15/249,857, filed Aug. 29, 2016, now U.S. Pat. No. 9,630,070, which claims the benefit of U.S. Provisional Application No. 62/337,184, filed May 16, 2016, and U.S. Provisional Application No. 62/361,988, filed Jul. 13, 2016.

This application is a continuation-in-part of application Ser. No. 16/222,580, filed Dec. 17, 2018, which is a continuation of application Ser. No. 15/831,148, filed Dec. 4, 2017, now U.S. Pat. No. 10,195,101, which is a continuation of application Ser. No. 15/453,701, filed Mar. 8, 2017, now U.S. Pat. No. 9,833,667, which claims the benefit of U.S. Provisional Application No. 62/356,539, filed Jun. 30, 2016, and U.S. Provisional Application No. 62/360,802, filed Jul. 11, 2016.

This application is a continuation-in-part of application Ser. No. 16/542,548, filed Aug. 16, 2019, which is a continuation of application Ser. No. 15/967,098, filed Apr. 30, 2018, now U.S. Pat. No. 10,420,989, which is a continuation of application Ser. No. 15/687,273, filed Aug. 25, 2017, now U.S. Pat. No. 9,981,160, which claims the benefit of U.S. Provisional Application No. 62/380,727, filed Aug. 29, 2016.

This application is a continuation-in-part of application Ser. No. 16/265,686, Feb. 1, 2019, which is a continuation-in-part of application Ser. No. 15/910,747, filed Mar. 2, 2018, now U.S. Pat. No. 10,232,234, which is a continuation of application Ser. No. 15/477,972, filed Apr. 3, 2017, now U.S. Pat. No. 9,914,029, which is a continuation of application Ser. No. 15/406,408, filed Jan. 13, 2017, now U.S. Pat. No. 9,861,867, which claims the benefit of U.S. Provisional Application No. 62/406,856, filed Oct. 11, 2016, U.S. Provisional Application No. 62/412,389, filed Oct. 25, 2016, and U.S. Provisional Application No. 62/419,242, filed Nov. 8, 2016.

This application is a continuation-in-part of application Ser. No. 16/502,987, filed Jul. 3, 2019, which is a continuation of application Ser. No. 15/981,094, filed May 16, 2018, which is a continuation of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

This application is a continuation-in-part of application Ser. No. 15/970,665, filed May 3, 2018, which is a continuation of application Ser. No. 15/667,343, filed Aug. 2, 2017, now U.S. Pat. No. 10,213,659, which claims the benefit of U.S. Provisional Application No. 62/512,275, filed May 30, 2017.

This application is a continuation-in-part of application Ser. No. 16/533,352, filed Aug. 6, 2019, which is a continuation of application Ser. No. 16/030,403, filed Jul. 9, 2018, now U.S. Pat. No. 10,413,787, which claims the benefit of U.S. Provisional Application No. 62/530,734, filed Jul. 10, 2017, and U.S. Provisional Application No. 62/624,294, filed Jan. 31, 2018.

This application is a continuation of application Ser. No. 16/179,406, filed Nov. 2, 2018, which claims the benefit of U.S. Provisional Application No. 62/581,456, filed Nov. 3, 2018.

The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
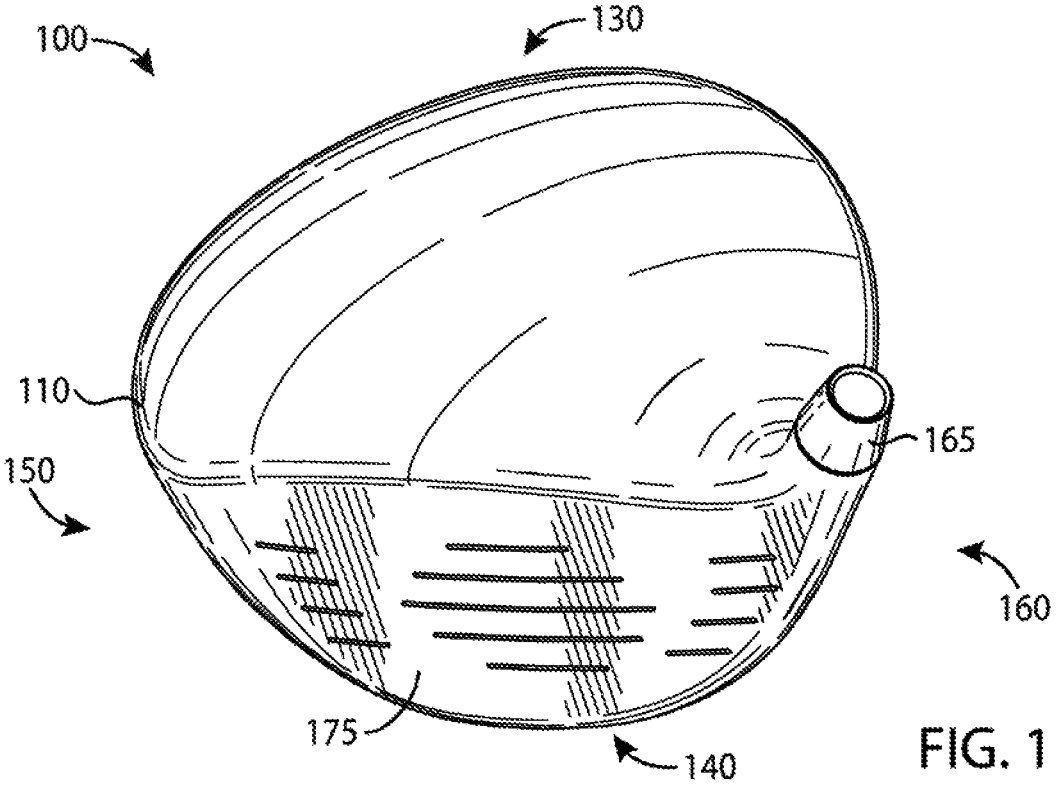
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

Figure 2:
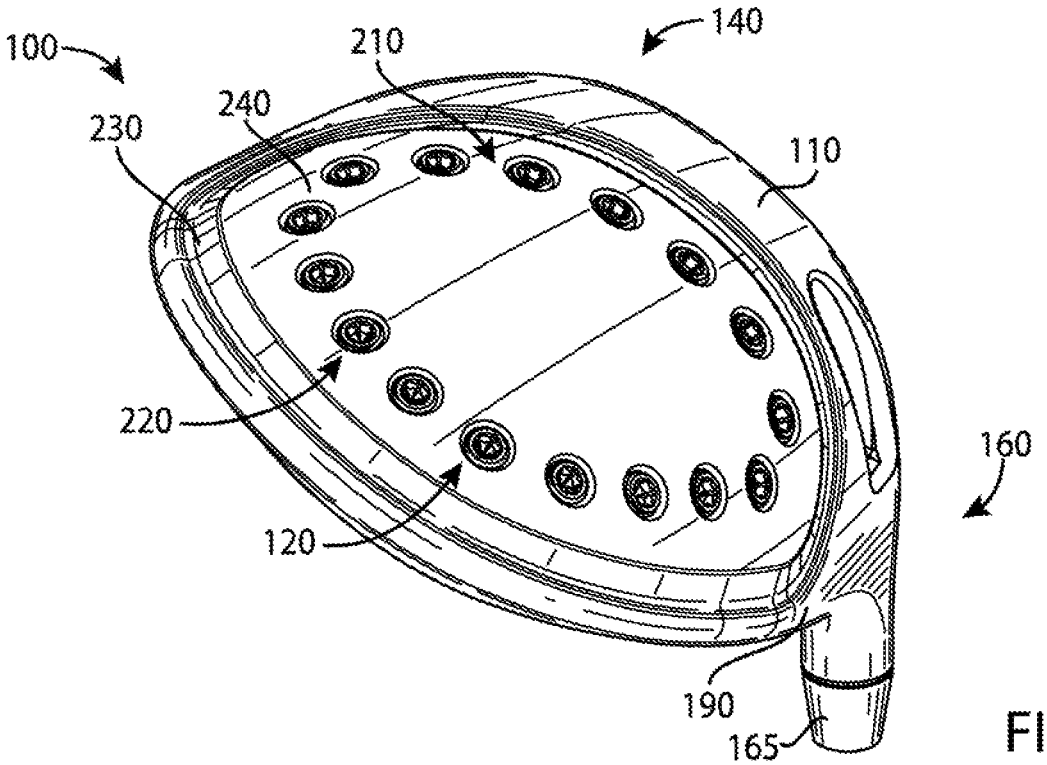
FIG. 2 depicts a bottom perspective view of the example golf club head of FIG. 1.
Figure 3:
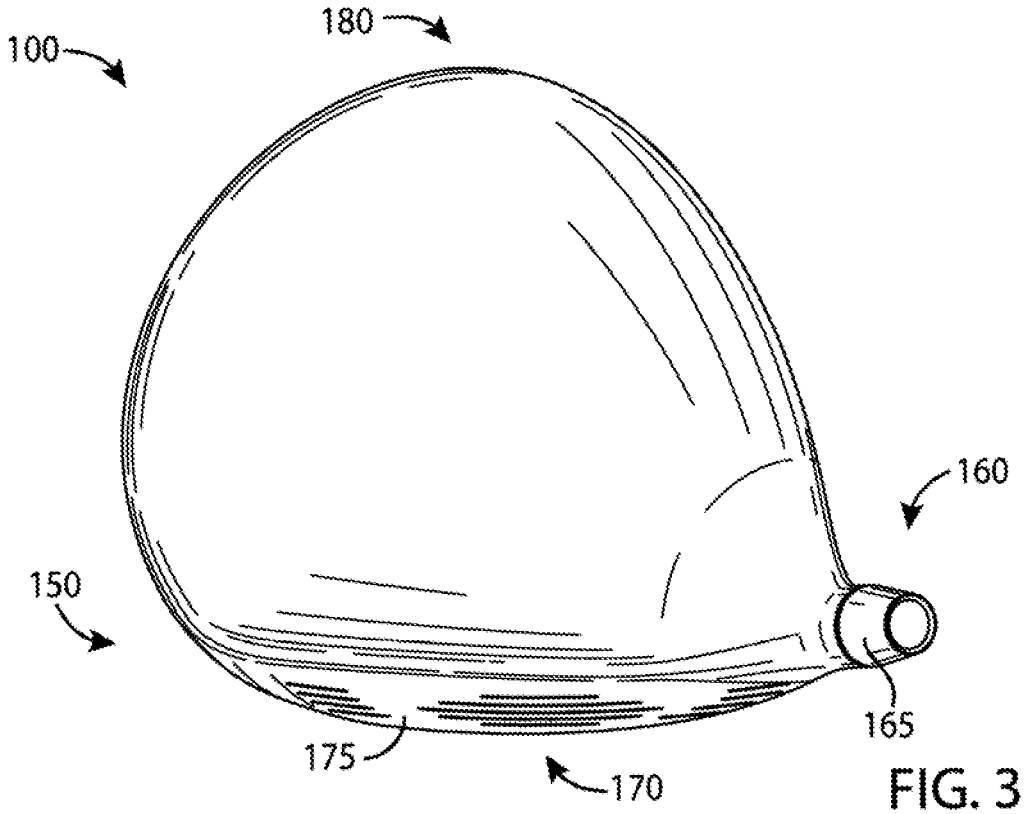
FIG. 3 depicts a top view of the example golf club head of FIG. 1.

In general, golf club heads and methods to manufacture golf club heads are described herein. The apparatus, methods, and articles of manufacture described herein are not limited in this regard. In the example of FIGS. 1-13, a golf club head 100 may include a body portion 110, and a plurality of mass portions 120, generally, shown as a first set of mass portions 210 (FIG. 2) and a second set of mass portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a port region 240. For example, the port region 240 may be a D-shape region. The port region 240 may include a plurality of ports 900 (FIG. 9) to receive the plurality of mass portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of mass portions 210, generally shown as 405, 410, 415, 420, 425, 430, and 435 (FIG. 4), may be associated with a first mass. Each of the second set of mass portions 220, generally shown as 440, 445, 450, 455, 460, 465, 470, 475, and 480 (FIG. 4), may be associated with a second mass. The first mass may be greater than the second mass or vice versa. In one example, the first set of mass portions 210 may be made of a tungsten-based material whereas the second set of mass portions 220 may be made of an aluminum-based material. As described in detail below, the first and second set of mass portions 210 and 220, respectively, may provide various weight configurations (e.g., FIGS. 15-18).

Figure 9:
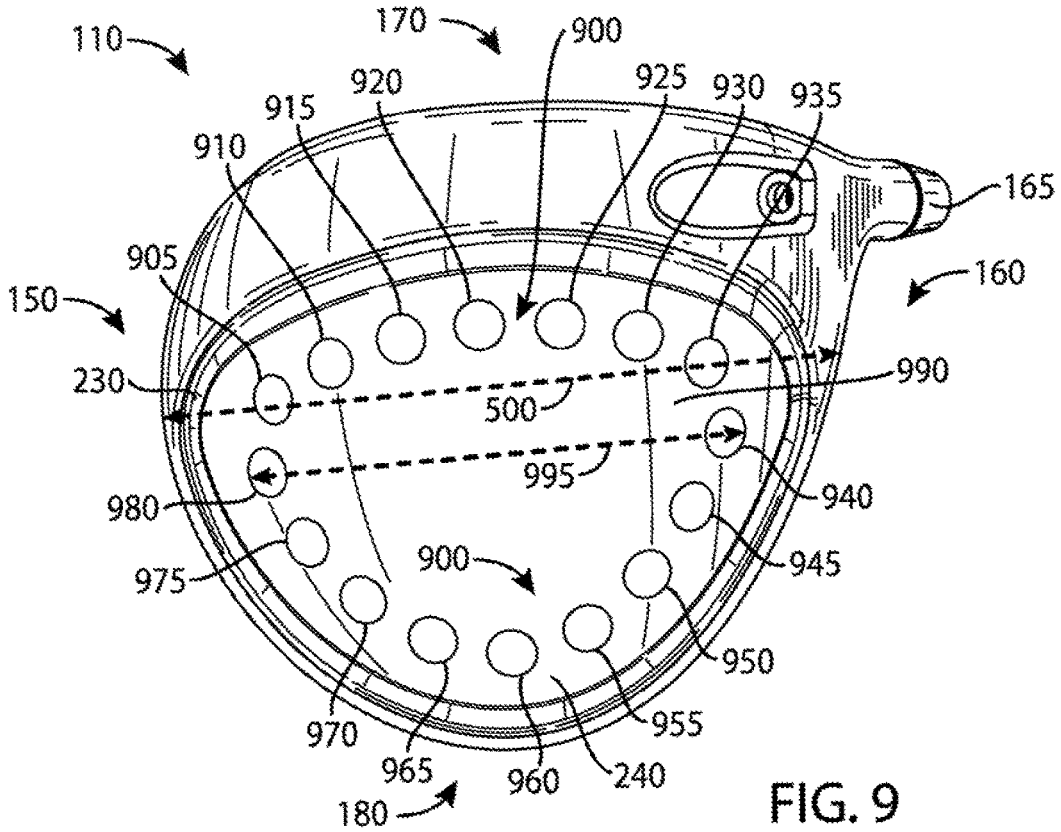
FIG. 9 depicts a bottom view of an example body portion of the example golf club head of FIG. 1.
Figure 10:
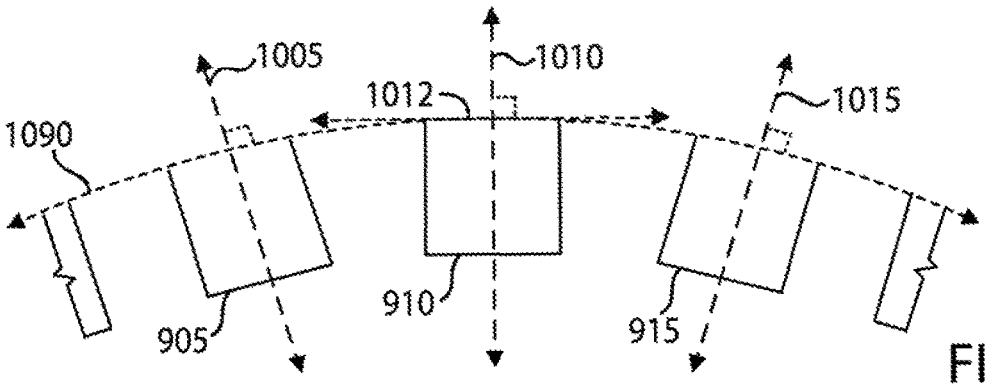
FIG. 10 depicts a cross-sectional view of the example body portion of the example golf club head of FIG. 1.
Figure 11:
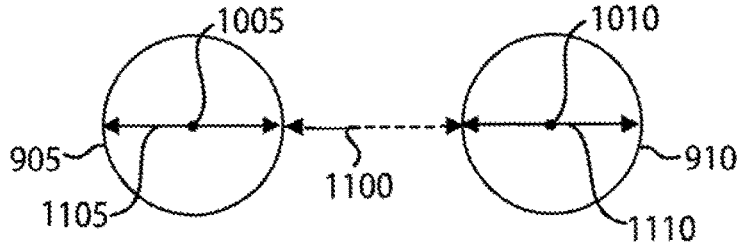
FIG. 11 depicts two ports of the example golf club head of FIG. 1.

Referring to FIGS. 9-11, for example, the bottom portion 140 of the body portion 110 may include a plurality of ports 900. The plurality of ports 900, generally shown as 905, 910, 915, 920, 925, 930, 935, 940, 945, 950, 955, 960, 965, 970, 975, and 980, may be located along a periphery of the port region 240 of the bottom portion 140. The plurality of ports 900 may extend across the bottom portion 140. In particular, the plurality of ports 900 may extend between the toe and heel portions 150 and 160, respectively, across the bottom portion 140. The plurality of ports 900 may also extend between the front and rear portions 170 and 180, respectively, across the bottom portion 140. The plurality of ports 900 may be arranged across the bottom portion 140 along a path that defines a generally D-shaped loop. In one example, the plurality of ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of ports 900 may extend more than 50% of a maximum toe-to-heel club head distance 500 of the golf club head 100. In particular, the plurality of ports 900 may extend between the toe portion 150 and the heel portion 160 at a maximum toe-to-heel port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of ports 900 may extend a port maximum toe-to-heel port distance of at least 2.5 inches between the toe and heel portions 150 and 160, respectively. A maximum toe-to-heel port distance 995 may be the maximum distance between the heel-side boundary of the port farthest from the toe portion 150 and the toe-side boundary of the port farthest from the heel portion 160. In the example of FIG. 9, the port maximum toe-to-heel port distance 995 may be the maximum distance between the heel-side boundary of the port 940 and toe-side boundary of the port 980. For example, the maximum toe-to-heel port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of ports 900 may be associated with a port diameter ($D_{port}$) (e.g., two shown as 1105 and 1110 in FIG. 11). For example, the port diameter of each port of the plurality of ports 900 may be about 0.3 inch (7.65 millimeters). Alternatively, the port diameters of adjacent ports may be different. In one example, the port 905 may be associated with a port diameter 1105, and the port 910 may be associated with a port diameter 1110. In particular, the port diameter 1105 of the port 905 may be larger than the port diameter 1110 of the port 910 or vice versa. The apparatus, methods, and articles of manufacture described herein are not limited in this regard.

The bottom portion 140 may also include an outer surface 990. As illustrated in FIG. 10, for example, the plurality of ports 900 may be formed on the bottom portion 140 relative to an outer surface curve 1090 formed by the outer surface 990. In particular, each of the plurality of ports 900 may be associated with a port axis generally shown as 1005, 1010, and 1015. A center of a port may define the port axis of the port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of ports 900 by positioning the golf club head 100 in various positions. Alternatively, the ports may be manufactured by multiple-axis machining processes, which may be able to rotate the golf club head around multiple axes to mill away excess material (e.g., by water jet cutting and/or laser cutting) to form the plurality of ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of ports 900 on the bottom portion 140. For example, a five-axis milling machine may form the plurality of ports 900 so that the port axis 1000 of each of the plurality ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent ports may be separated by a port distance 1100, which may be the shortest distance between two adjacent ports on the outer surface 990. In particular, the port distance 1100 may be less than or equal to the port diameter of any of the two adjacent ports. In one example, the port distance 1100 between the ports 905 and 910 may be less than or equal to either the port diameter 1105 or the port diameter 1110. The apparatus, methods, and articles of manufacture described herein are not limited in this regard.

The plurality of mass portions 120 may have similar or different physical properties (e.g., density, shape, mass, volume, size, color, etc.). In one example, the first set of mass portions 210 may be a black color whereas the second set of mass portions 220 may be a gray color or a steel color. Some or all of the plurality of mass portions 120 may be partially or entirely made of a metal material such as a steel-based material, a tungsten-based material, an aluminum-based material, any combination thereof or suitable types of materials. Alternatively, some or all of the plurality of mass portions 120 may be partially or entirely made of a non-metal material (e.g., composite, plastic, etc.).

Figure 12:
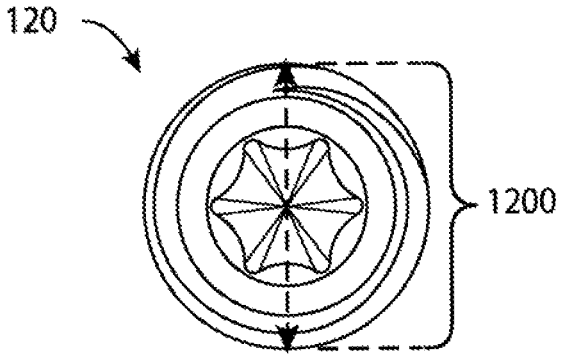
FIG. 12 depicts a top view of an example mass portion of the example golf club head of FIG. 1.
Figure 13:
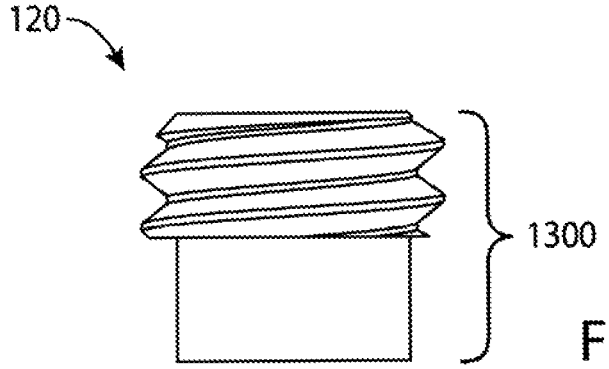
FIG. 13 depicts a side view of the example mass portion of FIG. 10.

In the illustrated example as shown in FIGS. 12 and 13, each mass portion of the plurality of mass portions 120 may have a cylindrical shape (e.g., a circular cross section). Although the above examples may describe mass portions having a particular shape, the apparatus, methods, and articles of manufacture described herein may include mass portions of other suitable shapes (e.g., a portion of or a whole sphere, cube, cone, cylinder, pyramid, cuboidal, prism, frustum, or other suitable geometric shape). Each mass portion of the plurality of mass portions 120 may be associated with a diameter 1200 and a height 1300. In one example, each mass portion of the plurality of mass portions 120 may have a diameter of about 0.3 inch (7.62 millimeters) and a height of about 0.2 inch (5.08 millimeters). Alternatively, the first and second sets of mass portions 210 and 220, respectively, may be different in width and/or height.

Instead of a rear-to-front direction as in other golf club heads, each mass portion of the plurality of mass portions 120 may engage one of the plurality of ports 400 in a bottom-to-top direction. The plurality of mass portions 120 may include threads to secure in the ports. For example, each mass portion of the plurality of mass portions 120 may be a screw. The plurality of mass portions 120 may not be readily removable from the body portion 110 with or without a tool. Alternatively, the plurality of mass portions 120 may be readily removable (e.g., with a tool) so that a relatively heavier or lighter mass portion may replace one or more of the plurality of mass portions 120. In another example, the plurality of mass portions 120 may be secured in the ports of the body portion 110 with epoxy or adhesive so that the plurality of mass portions 120 may not be readily removable. In yet another example, the plurality of mass portions 120 may be secured in the ports of the body portion 110 with both epoxy and threads so that the plurality of mass portions 120 may not be readily removable. The apparatus, methods, and articles of manufacture described herein are not limited in this regard.

Figure 14:
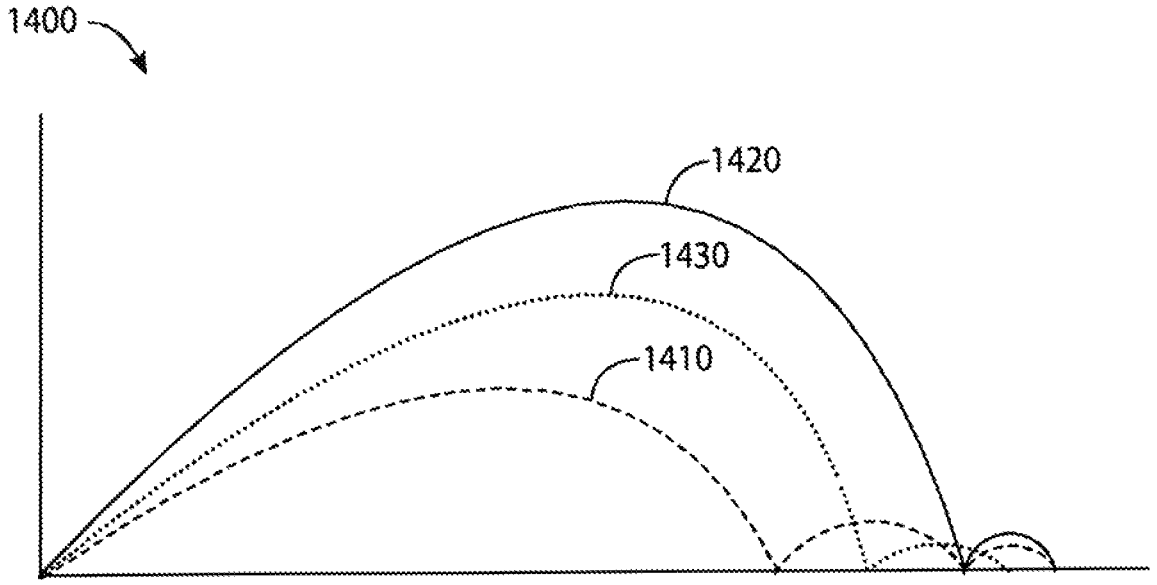
FIG. 14 depicts example launch trajectory profiles of the example golf club head of FIG. 1.
Figure 15:
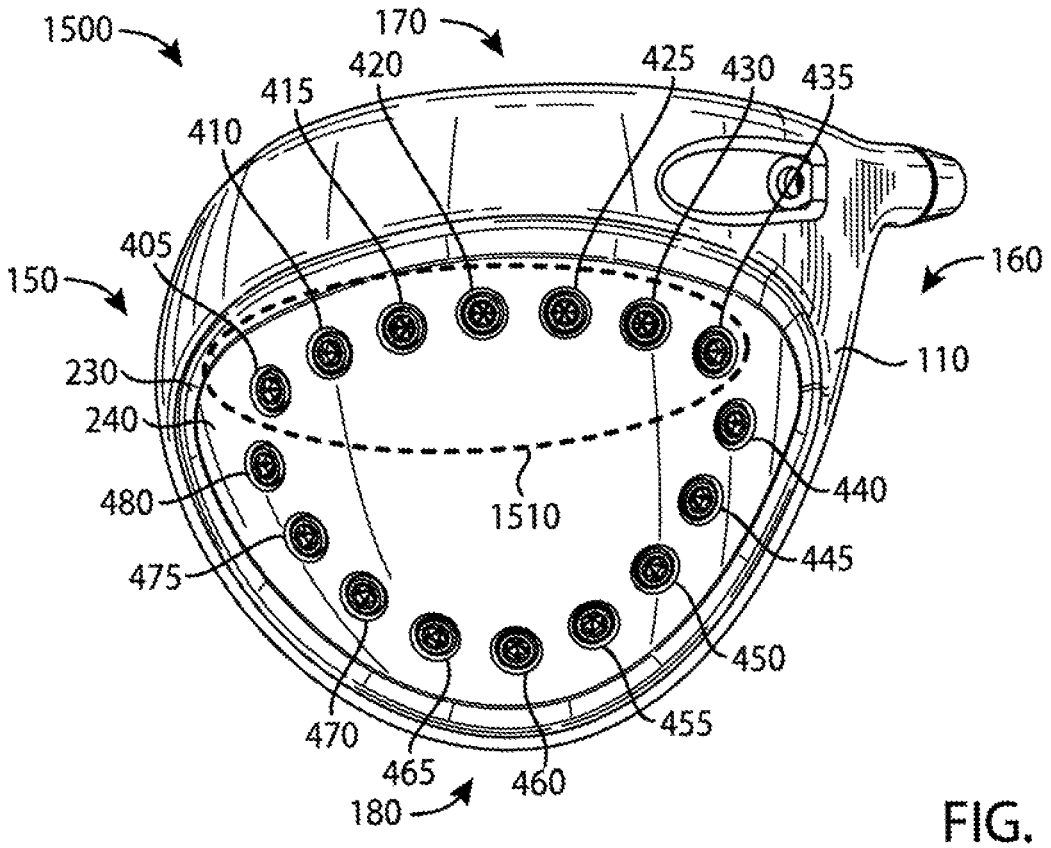
FIG. 15 depicts a first weight configuration of the example mass portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of ports 1510. The first set of ports 1510 may be located at or proximate to the front portion 170 (e.g., ports 905, 910, 915, 920, 925, 930, and 935 shown in FIG. 9). In the first weight configuration 1500, a first set of mass portions may be disposed toward the front portion 170 according to the configuration of the first set of ports 1510, whereas a second set of mass portions may be disposed toward the rear portion 180. In particular, the first set of mass portions may form a cluster according to the configuration of the first set of ports 1510 at or proximate to the front portion 170. The mass portions 405, 410, 415, 420, 425, 430, and 435 may define the first set of mass portions and may be disposed in ports 905, 910, 915, 920, 925, 930, and 935, respectively. The mass portions 440, 445, 450, 455, 460, 465, 470, 475, and 480 may define the second set of mass portions and may be disposed in ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier mass portions (i.e., the first set of mass portions) towards the front portion 170 of the golf club head 100 according to the configuration of the first set of ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the mass portions being disposed in certain ports, any mass portion of the first set of mass portions 210 may be disposed in any port of the first set of ports 1510.

Figure 16:
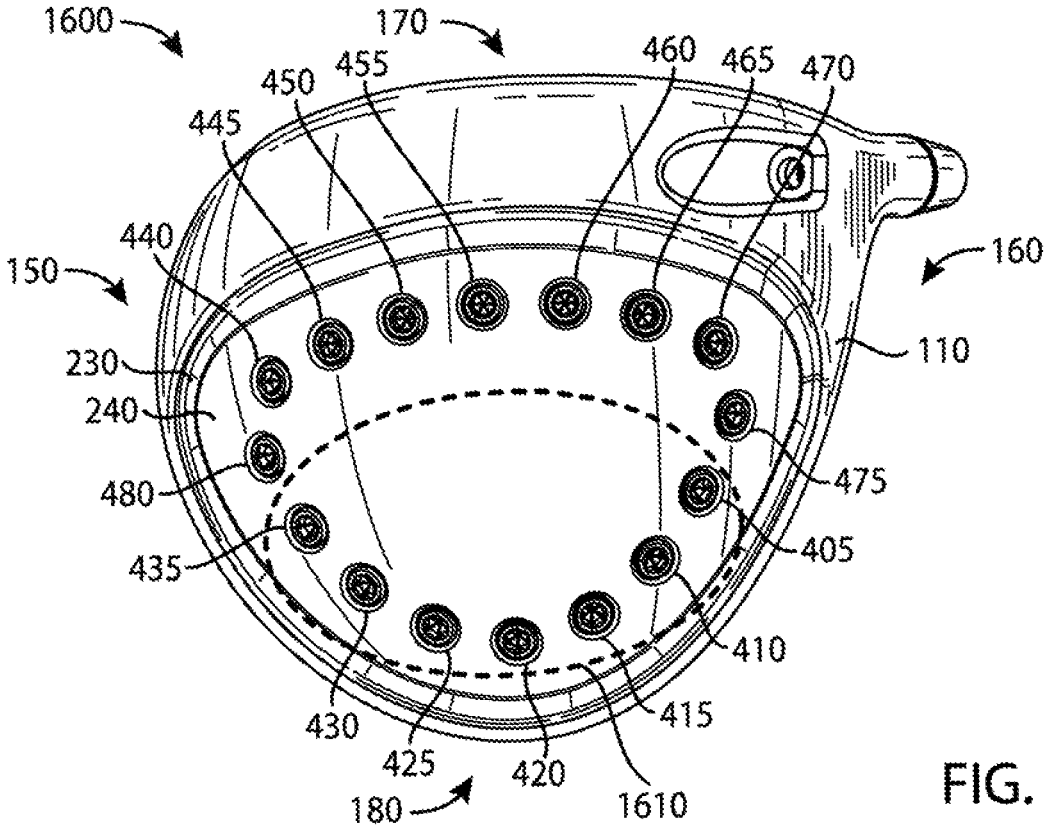
FIG. 16 depicts a second weight configuration of the example mass portions.

Turning to FIG. 16, for example, a second weight configuration 1600 may be associated with a configuration of a second set of ports 1610. The second set of ports 1610 may be located at or proximate to the rear portion 180 (e.g., ports, 945, 950, 955, 960, 965, 970, and 975 shown in FIG. 9). In a second weight configuration 1600 as illustrated in FIG. 16, for example, a first set of mass portions may be disposed toward the rear portion 180 whereas a second set of mass portions may be disposed toward the front portion 170. In particular, the first set of mass portions may form a cluster 1610 at or proximate to the rear portion 180 according to the configuration of the second set of ports 1610. The mass portions 405, 410, 415, 420, 425, 430, and 435 may define the first set of mass portions and may be disposed in ports 945, 950, 955, 960, 965, 970, and 975, respectively. The mass portions 440, 445, 450, 455, 460, 465, 470, 475, and 480 may define the second set of mass portions and may be disposed in ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier mass portion (i.e., the first set of mass portions) towards the rear portion 180 of the golf club head 100 according to the configuration of the second set of ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
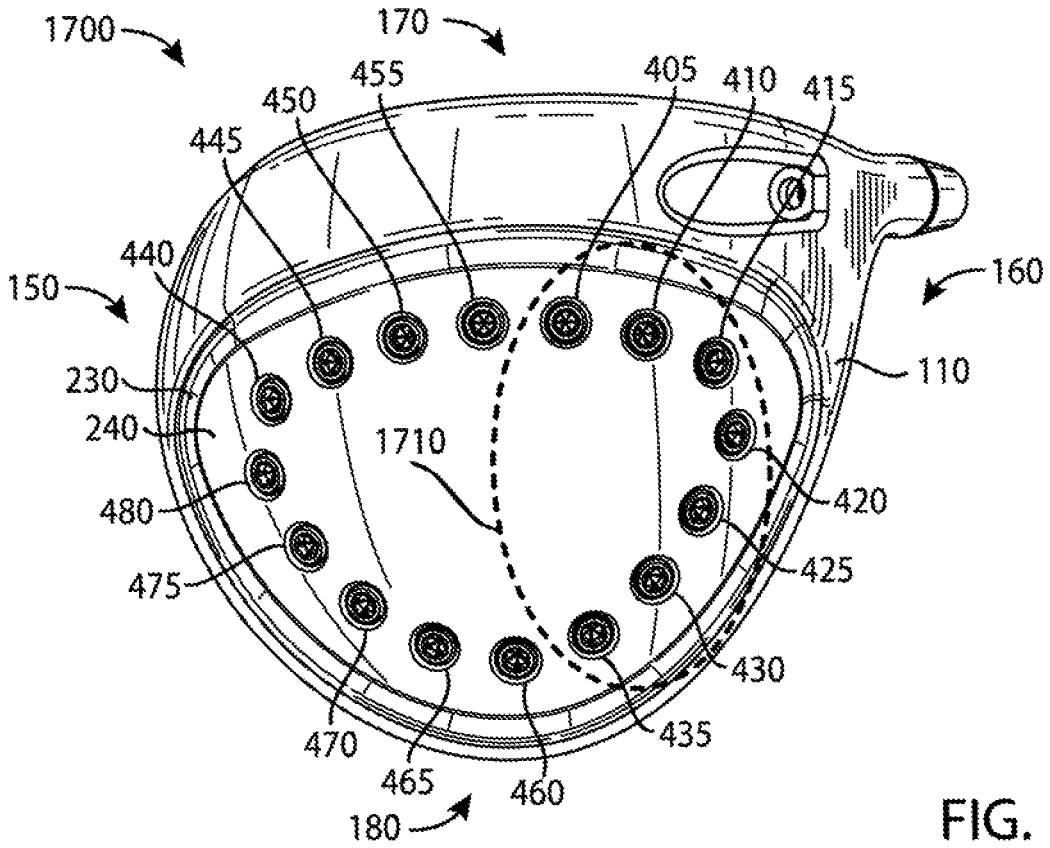
FIG. 17 depicts a third weight configuration of the example mass portions.

Turning to FIG. 17, for example, a third weight configuration 1700 may be associated with a configuration of a third set of ports 1710. In the third weight configuration 1700, for example, a first set of mass portions may be disposed toward the heel portion 160 whereas a second set of mass portions may be disposed toward the toe portion 150. In particular, the first set of mass portions may form a cluster of mass portions at or proximate to the heel portion 160 according to the configuration of the third set of ports 1710. The mass portions 405, 410, 415, 420, 425, 430, and 435 may define the first set of mass portions and may be disposed in ports 925, 930, 935, 940, 945, 950, and 955, respectively. The mass portions 440, 445, 450, 455, 460, 465, 470, 475, and 480 may define the second set of mass portions and may be disposed in ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier mass portions (i.e., the first set of mass portions) towards the heel portion 160 of the golf club head 100, the center of gravity (GC) of the golf club head 100 may move relatively closer to the axis of the shaft.

Figure 18:
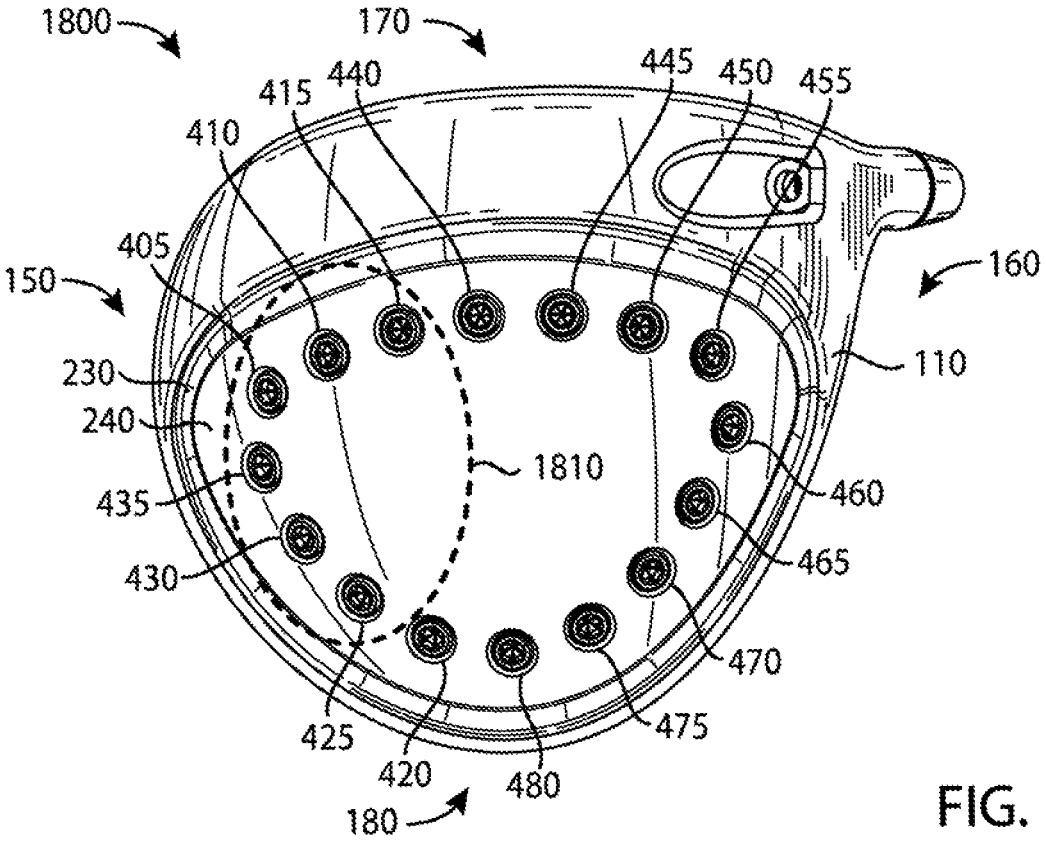
FIG. 18 depicts a fourth weight configuration of the example mass portions.
Figure 19:
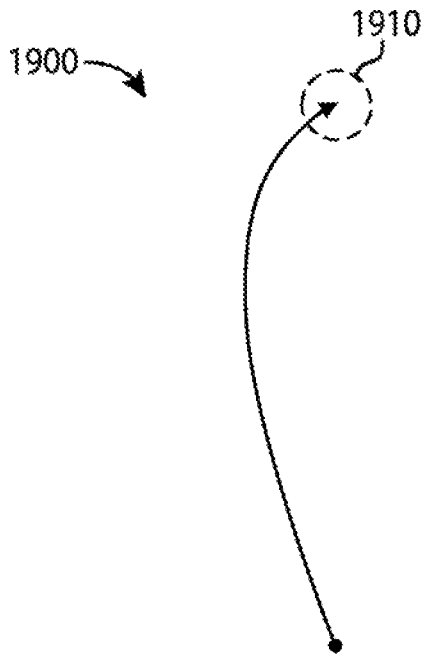
FIG. 19 depicts an example launch trajectory profile of the example golf club head of FIG. 18.

Turning to FIG. 18, for example, a fourth weight configuration 1800 may be associated with a configuration of a fourth set of ports 1810. In a fourth weight configuration 1800, for example, a first set of mass portions may be disposed toward the toe portion 150 whereas a second set of mass portions may be disposed toward the heel portion 160. In particular, the first set of mass portions may form a cluster of mass portions at or proximate to the toe portion 150 according to the configuration of the fourth set of ports 1810. The mass portions 405, 410, 415, 420, 425, 430, and 435 may define the first set of mass portions and may be disposed in ports 905, 910, 915, 965, 970, 975, and 980, respectively. The mass portions 440, 445, 450, 455, 460, 465, 470, 475, and 480 may define the second set of mass portions and may be disposed in ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier mass portions (i.e., the first set of mass portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
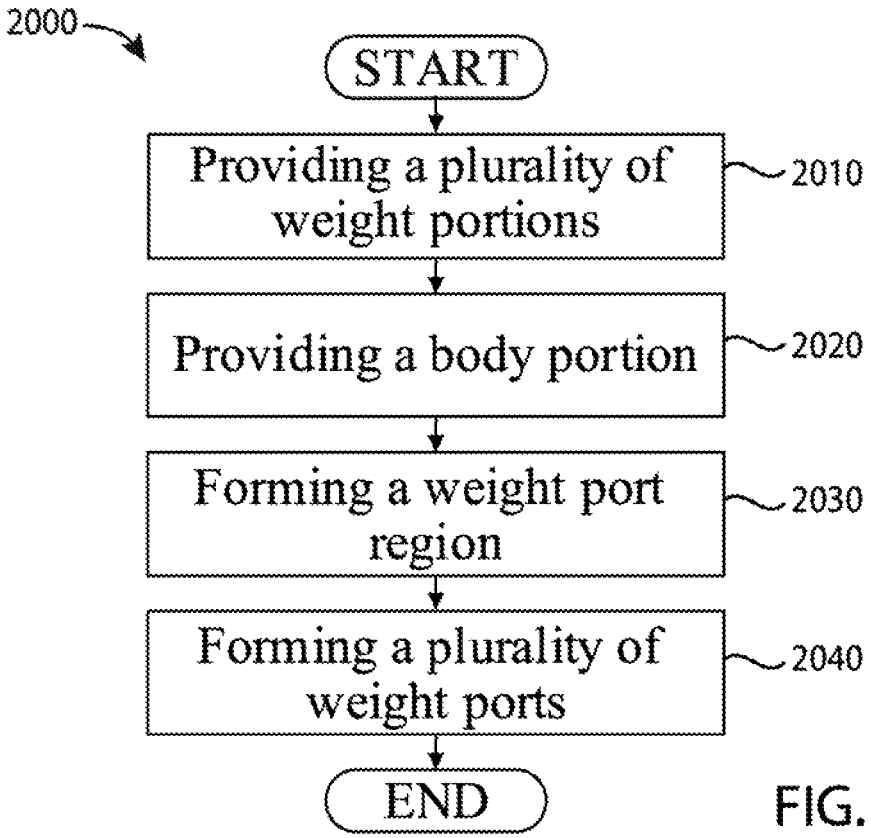
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of mass portions (block 2010). The plurality of mass portions may include a first set of mass portions and a second set of mass portions. Each mass portion of the first set of mass portions may be associated with a first mass whereas each mass portion of the second set of mass portions may be associated with a second mass. The first mass may be greater than the second mass. In one example, each mass portion of the first set of mass portions may be made of a tungsten-based material with a mass 2.6 grams whereas each mass portion of the second set of mass portions may be made of an aluminum-based material with a mass of 0.4 grams. The first set of mass portions may have a gray color or a steel color whereas the second set of mass portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a port region located at or proximate to the bottom and skirts portions (block 2030). A transition region may surround the port region. The process 2000 may form a plurality of ports along a periphery of the port region (block 2040). Each port of the plurality of ports may be associated with a port diameter and configured to receive at least one mass portion of the plurality of mass portions. Two adjacent ports may be separated by less than or equal to the port diameter. Further, each port of the plurality of ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
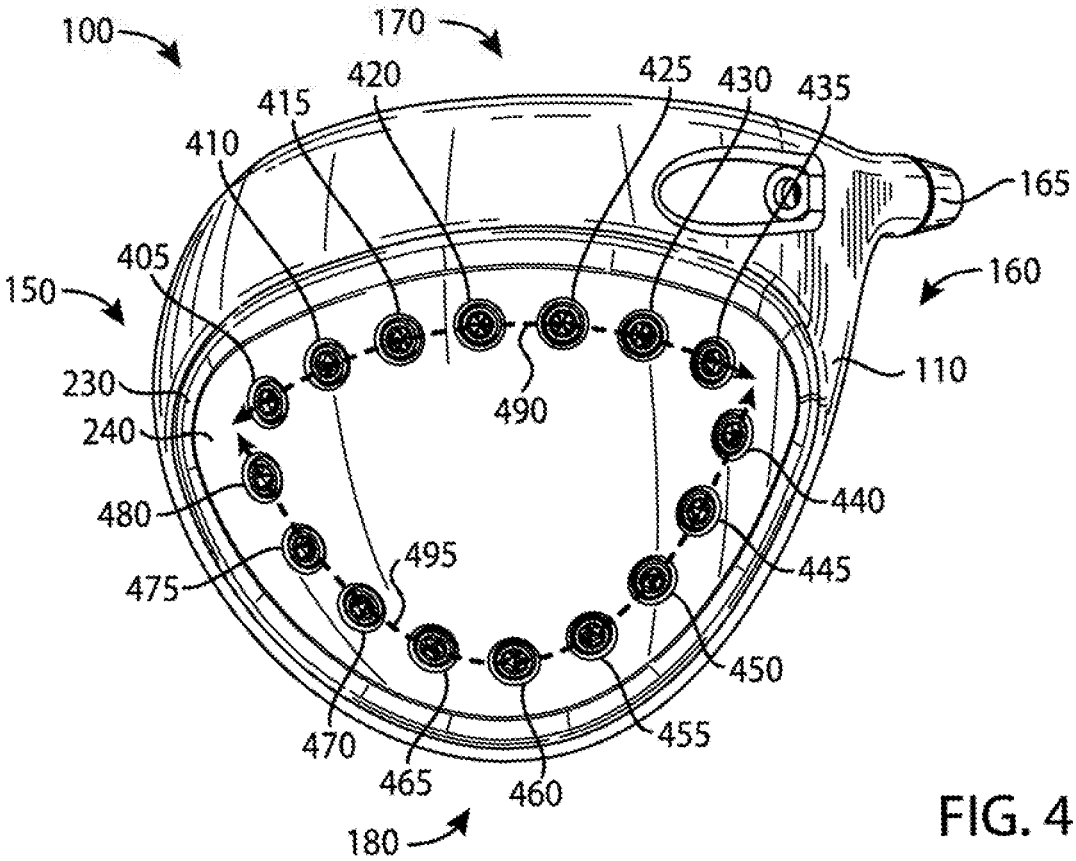
FIG. 4 depicts a bottom view of the example golf club head of FIG. 1.
Figure 5:
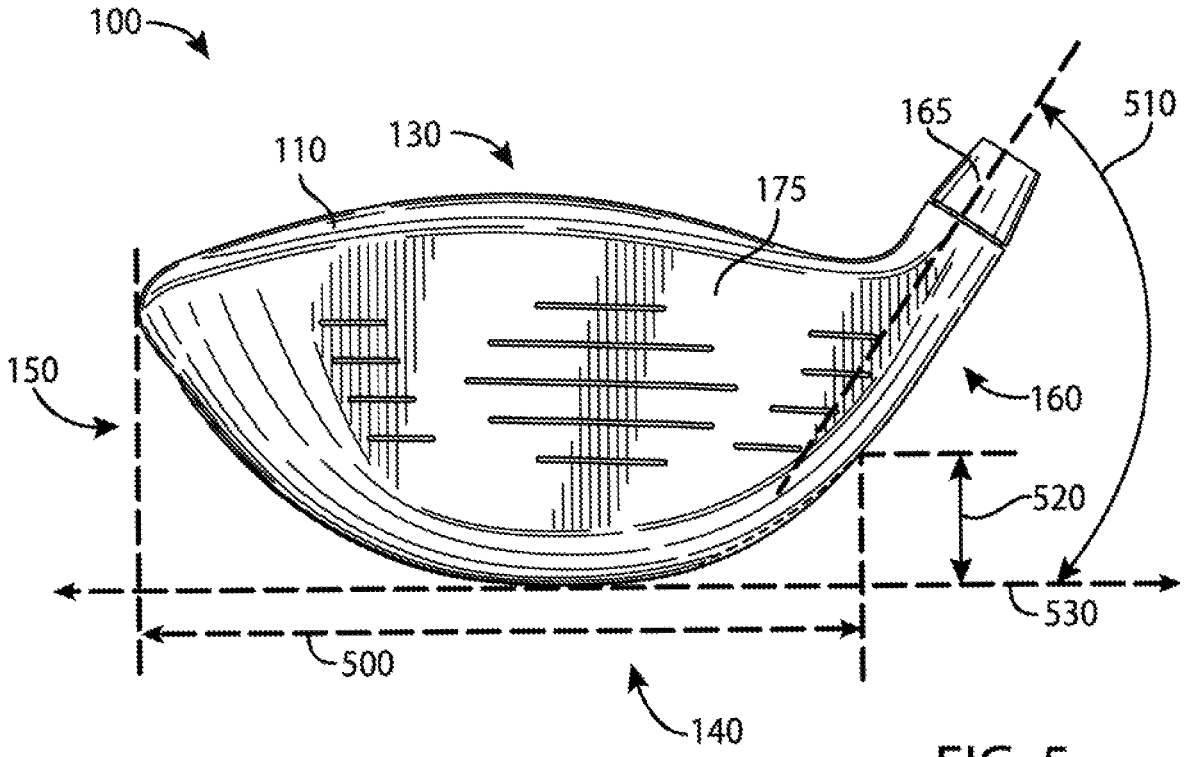
FIG. 5 depicts a front view of the example golf club head of FIG. 1.
Figure 6:
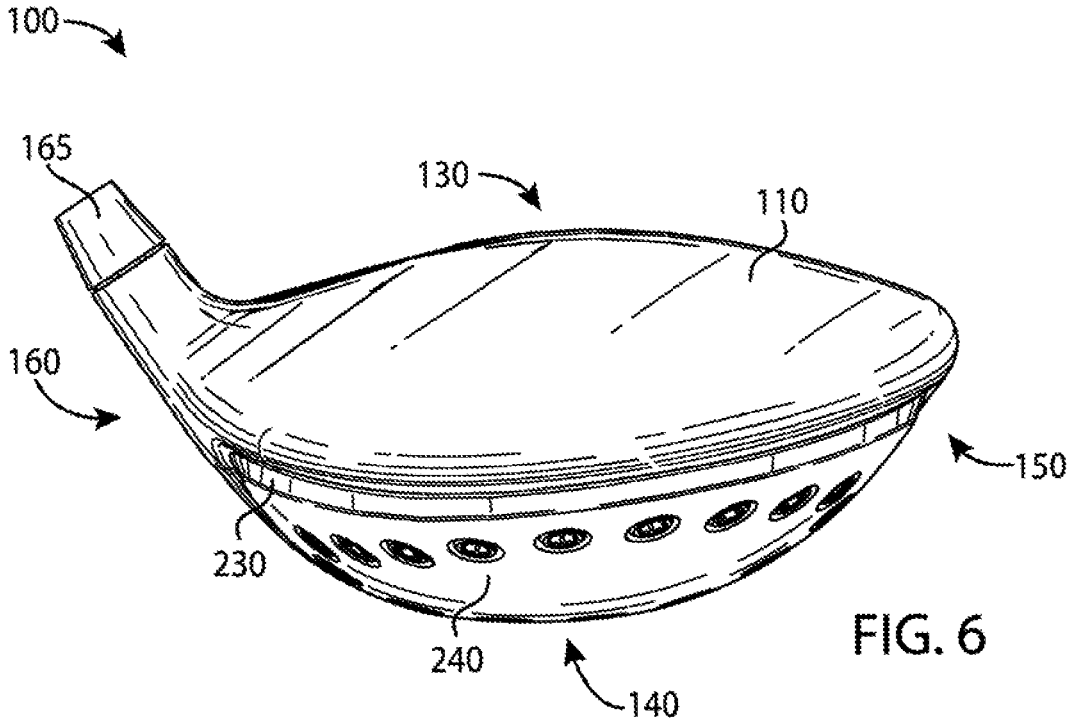
FIG. 6 depicts a rear view of the example golf club head of FIG. 1.
Figure 7:
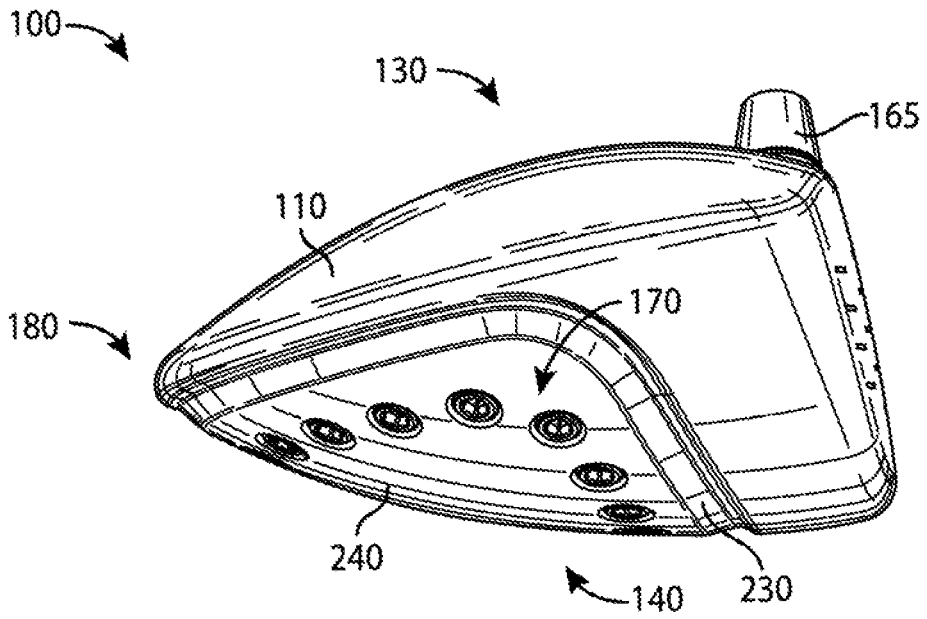
FIG. 7 depicts a toe view of the example golf club head of FIG. 1.
Figure 8:
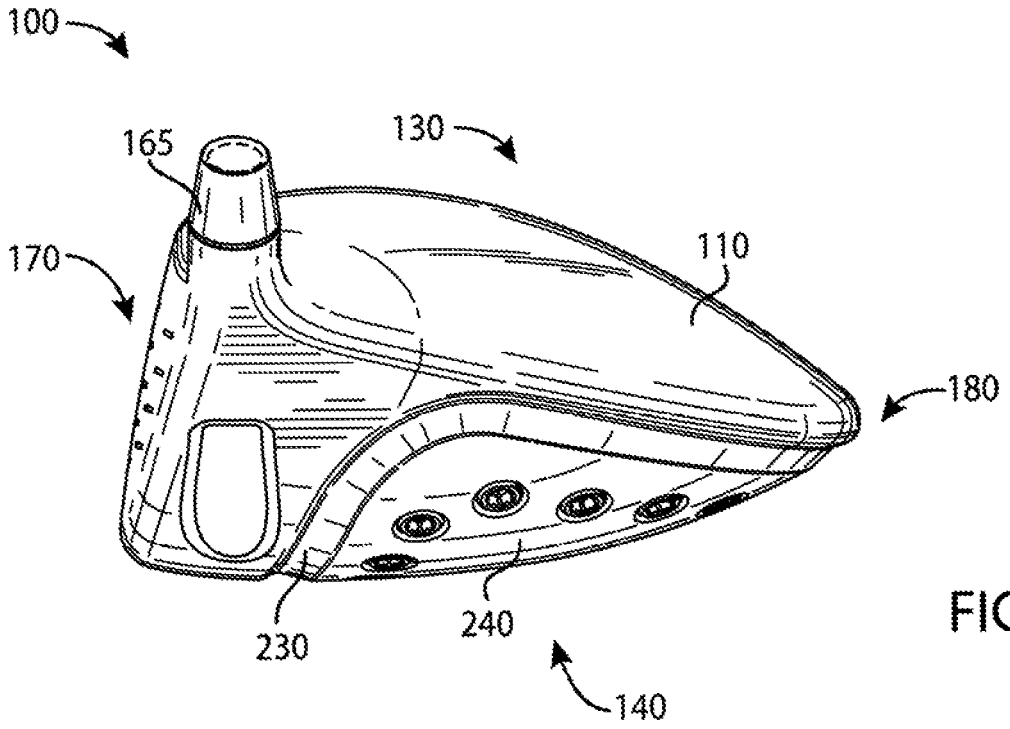
FIG. 8 depicts a heel view of the example golf club head of FIG. 1.

As shown in the above examples, the plurality of mass portions 120 and the plurality of ports 900 may be located on a periphery of the port region 240 along a path that defines a generally D-shaped loop formed with two arcs, generally shown as 490 and 495 in FIG. 4. For example, the mass portions 405, 410, 415, 420, 425, 430, and 435 (FIG. 4), and the ports 905, 910, 915, 920, 925, 930, and 935 (FIG. 9) may form the first arc 490. In particular, the first arc 490 may extend between the toe and heel portions 150 and 160, respectively, across the bottom portion 140. The mass portions 440, 445, 450, 455, 460, 465, 470, 475, and 480 (FIG. 4), the ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
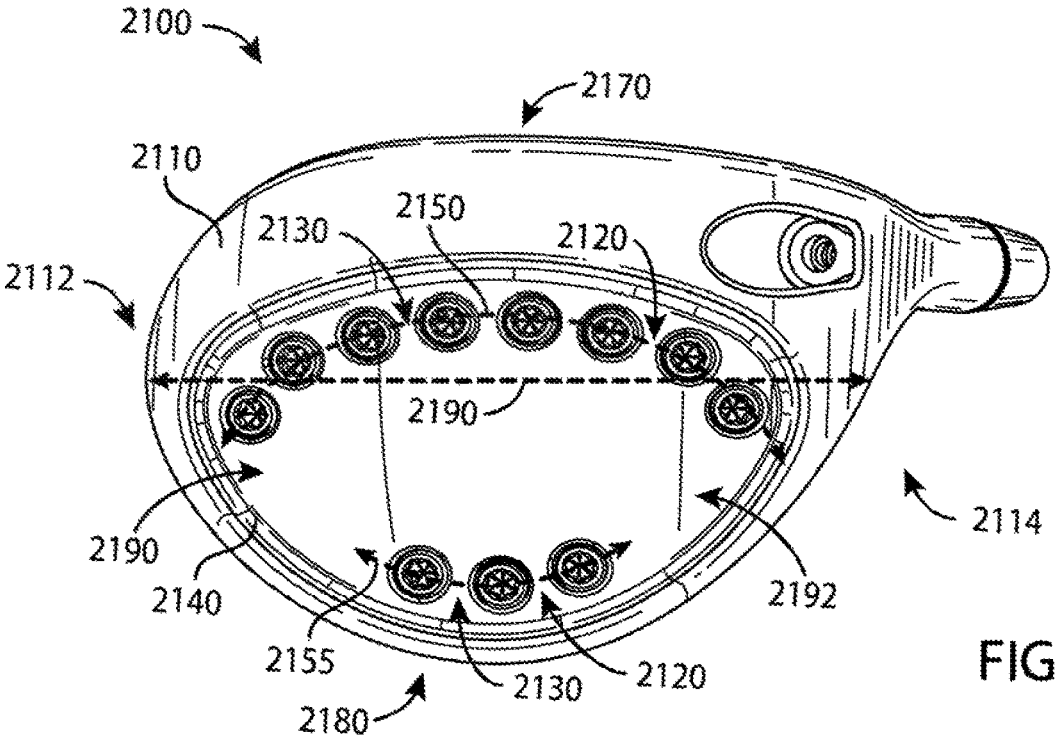
FIG. 21 depicts a bottom view of another example golf club head.

Although the above examples may depict the plurality of mass portions 120 and the plurality of ports 900 forming a particular geometric shape, the apparatus, methods, and articles of manufacture described herein may have mass portions and ports located along a periphery of a mass portion region to form other geometric shapes. Turning to FIG. 21, for example, a golf club head 2100 may include a bottom portion 2110, and a plurality of mass portions 2120 disposed in a plurality of ports 2130. The plurality of ports 2130 may be located along a periphery of a port region 2140 of the bottom portion 2110 (i.e., the plurality of ports 2130 may extend between the toe and heel portions 2112 and 2114, respectively, across the bottom portion 2110). In contrast to the plurality of mass portions 120 and the plurality of ports 900 (e.g., FIGS. 4 and 9), the plurality of ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the ports 2130 of the first arc 2150 and the ports 2130 of the second arc 2155. The gaps 2190 and/or 2192 may be greater than or equal to the port diameter of any of the ports 2130 such as the ports 2130 that are adjacent to the gaps 2190 and/or 2192. According to one example as shown in FIG. 21, the gaps 2190 and 2192 may be several orders or magnitude larger than the diameters of the ports 2130 that are adjacent to the gaps 2190 and 2192. The apparatus, methods, and articles of manufacture described herein are not limited in this regard.

Referring to FIG. 21, for example, the first arc 2150 may include a greater number of ports 2130 than the second arc 2155, which may be suitable for certain golf club heads (e.g., a fairway wood-type golf club head and/or a hybrid-type golf club head). Alternatively, the second arc 2155 may include the same or a greater number of ports 2130 than the first arc 2150. The number of ports 2130 in each of the first and second arcs 2150 and 2155, respectively, the mass portions 2120 associated with each port 2130 and the spacing between adjacent ports 2130 may be determined based on the type of golf club, a preferred weight distribution of the golf club head 2100, and/or a center of gravity location of the golf club head 2100.

The ports 2130 of the first arc 2150 and/or the second arc 2155 may be spaced from each other at the same or approximately the same distance along the first arc 2150 and/or the second arc 2155, respectively. Any variation in the spacing between the ports 2130 of the first arc 2150 or the second arc 2155 or any of the ports described herein may be due to different manufacturing considerations, such as manufacturing tolerances and/or cost effectiveness associated with manufacturing precision. For example, the variation in the spacing between the ports 2130 of the first arc 2150 and/or the second arc 2155 may be between 1/16 of an inch to 0.001 inch. As described herein, the distance between adjacent ports 2130 (i.e., port distance) may be less than or equal to the port diameter of any of the two adjacent ports. The plurality of ports 2130 may extend between the toe portion 2112 and the heel portion 2114 at a maximum toe-to heel port distance that is more than 50% of a maximum toe-to-heel club head distance 2195 of the golf club head 2100. The maximum toe-to-heel port distance may be the maximum distance between the heel-side boundary of the port farthest from the toe portion 2112 and the toe-side boundary of the port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
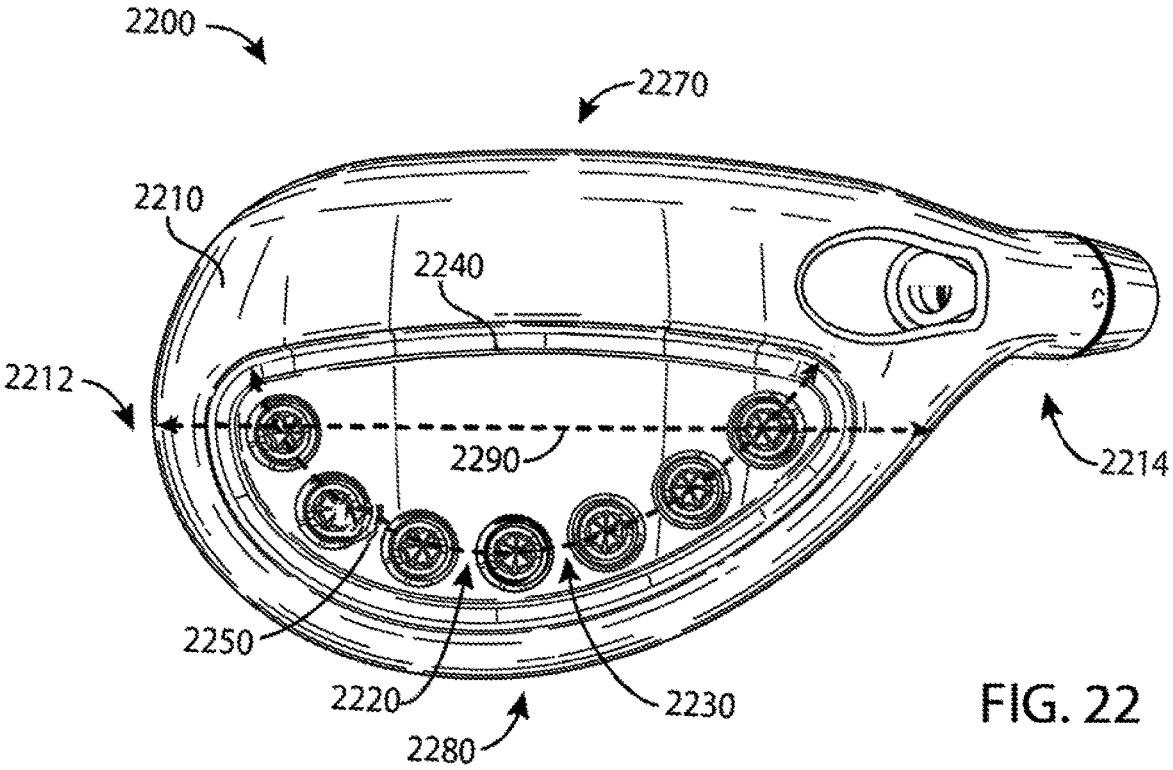
FIG. 22 depicts a bottom view of yet another example golf club head.
Figure 23:
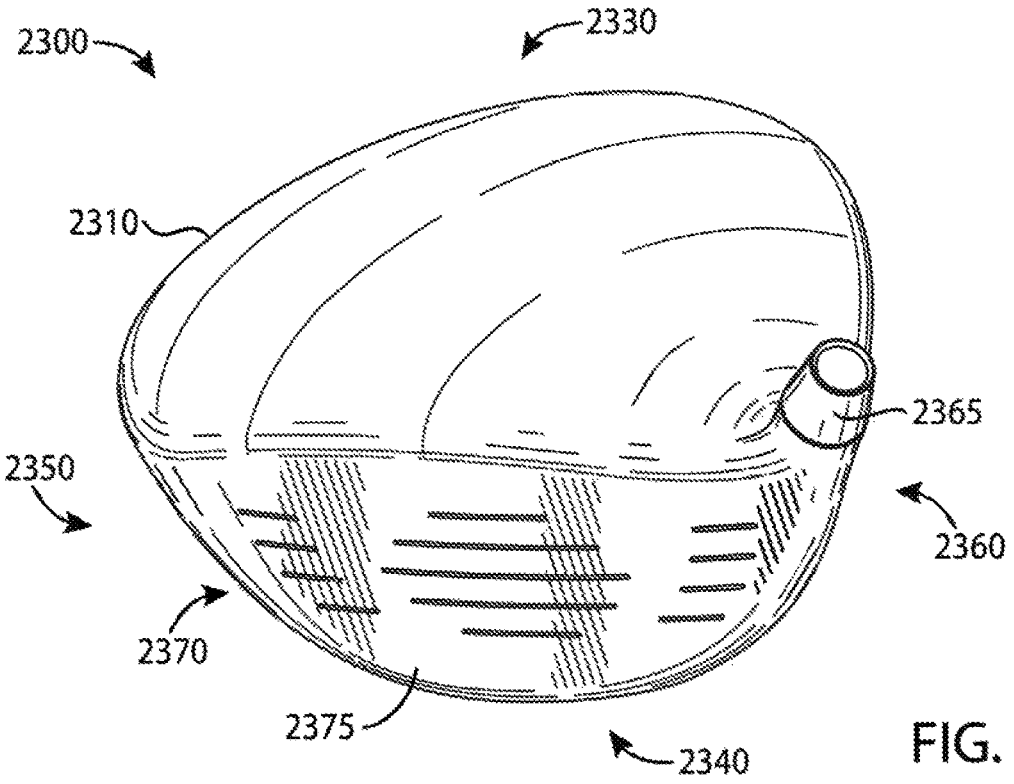
FIG. 23 is top perspective view of an example golf club head according to an embodiment of the apparatus, methods, and articles of manufacture described herein.

As illustrated in FIG. 22, for example, a golf club head 2200 may include a bottom portion 2210, and a plurality of mass portions 2220 disposed in a plurality of ports 2230. The plurality of ports 2230 located along a periphery of a port region 2240 may be arranged along a path that defines an arc, generally shown as 2250, extending across the bottom portion 2210 (i.e., the plurality of ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of ports 2230 in the arc 2250, the mass portions 2220 associated with each port 2230 and the spacing between adjacent ports 2230 may be determined based on the type of golf club, a preferred weight distribution of the golf club head 2200, and/or a center of gravity location of the golf club head 2200.

The ports 2230 of the arc 2250 may be spaced from each other at the same or approximately the same distance along the arc 2250 (e.g., the ports 2230 may be substantially similarly spaced apart from each other). Any variation in the spacing between the ports 2230 of the arc 2250 or any of the ports described herein may be due to different manufacturing considerations, such as manufacturing tolerances and/or cost effectiveness associated with manufacturing precision. For example, the variation in the spacing between the ports 2130 of the arc 2250 may be between 1/16 of an inch to 0.001 inch. As described herein, the distance between adjacent ports 2230 (i.e., port distance) may be less than or equal to the port diameter of any of the two adjacent ports. The plurality of ports 2230 may extend between the toe portion 2212 and the heel portion 2214 at a maximum toe-to heel port distance that is more than 50% of a maximum toe-to-heel club head distance of 2290 the golf club head 2200. The maximum toe-to-heel port distance may be the maximum distance between the heel-side boundary of the port farthest from the toe portion 2212 and the toe-side boundary of the port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 24:
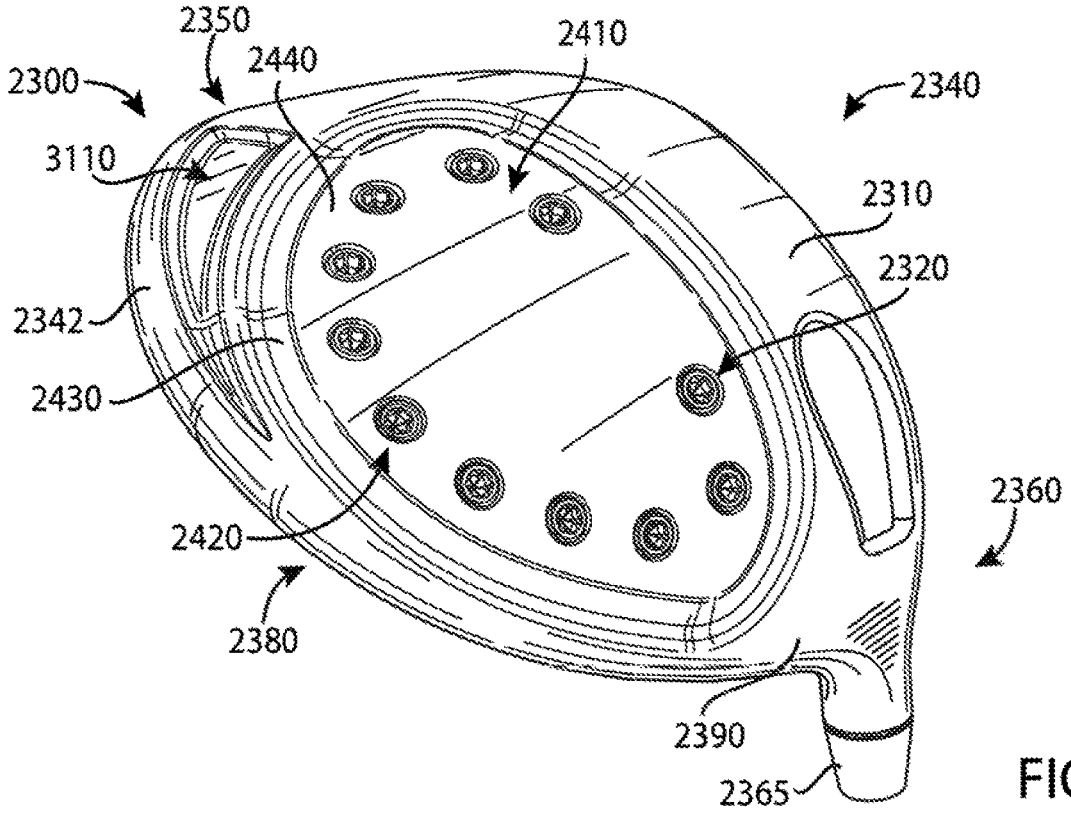
FIG. 24 depicts a bottom perspective view of the example golf club head of FIG. 23.
Figure 25:
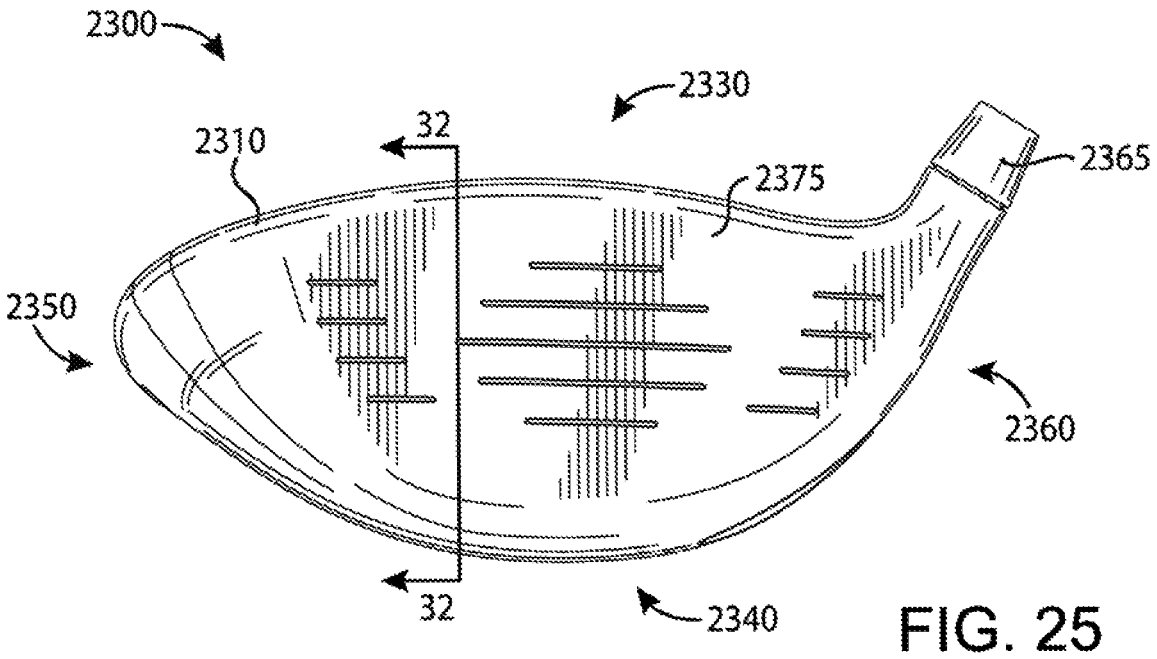
FIG. 25 depicts a front view of the example golf club head of FIG. 23.
Figure 26:
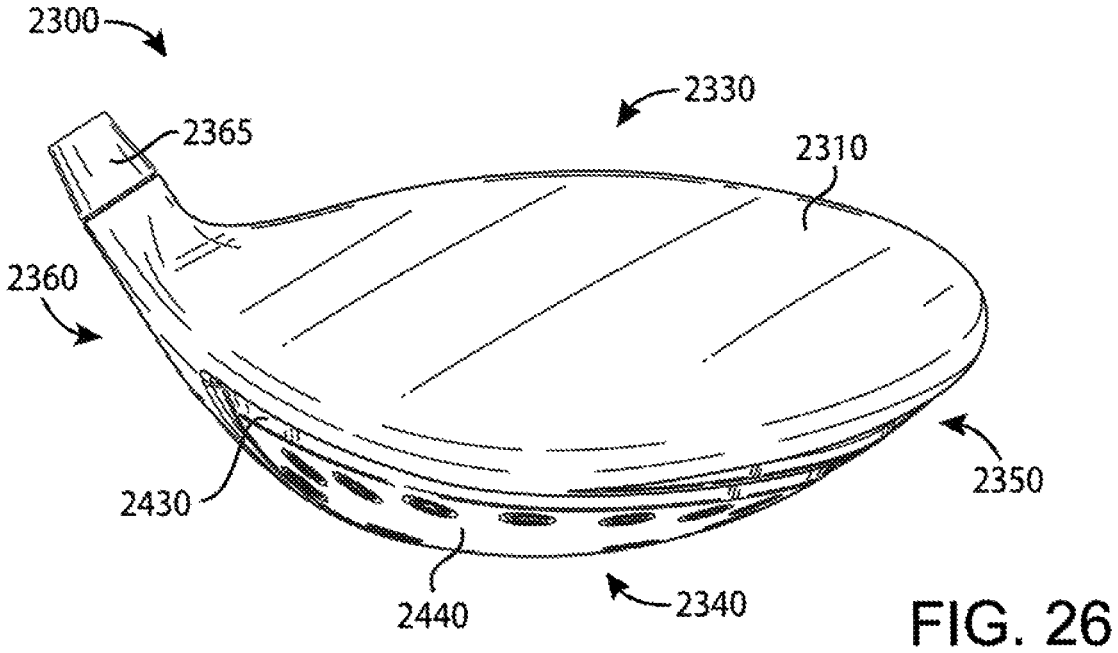
FIG. 26 depicts a rear view of the example golf club head of FIG. 23.
Figure 27:
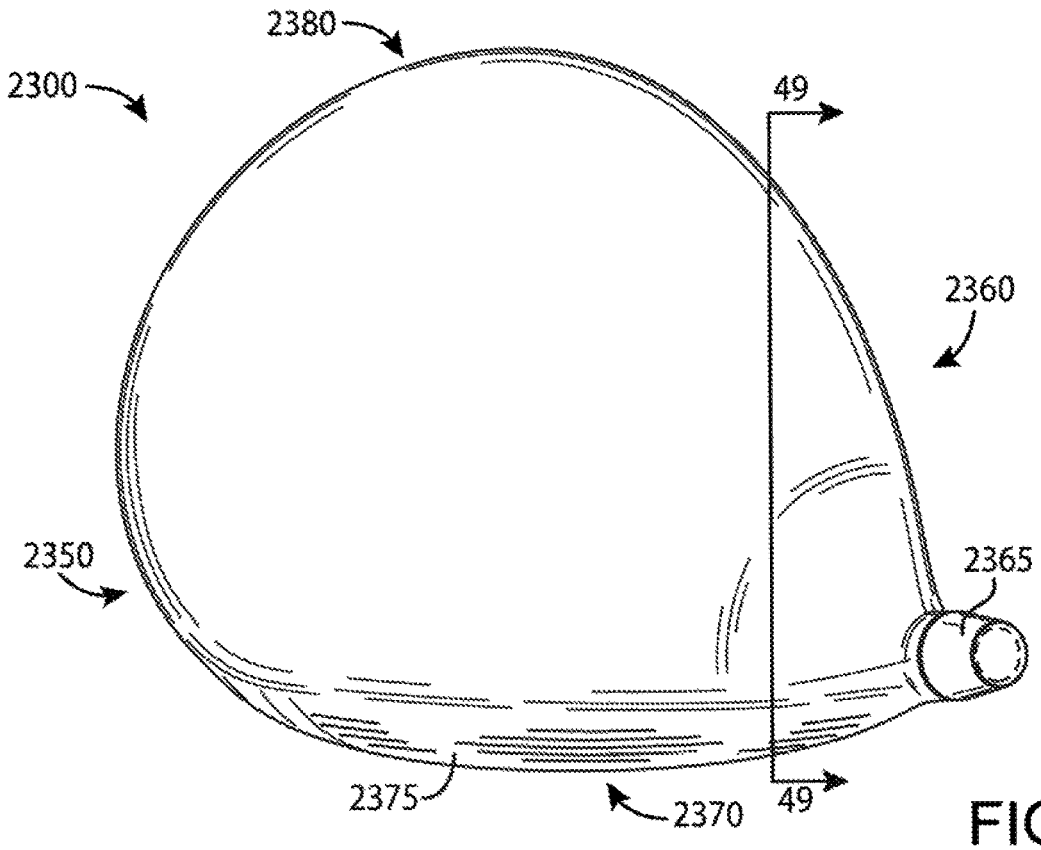
FIG. 27 depicts a top view of the example golf club head of FIG. 23.

In the example of FIGS. 23-32, a golf club head 2300 may include a body portion 2310, and a plurality of mass portions 2320, generally, shown as a first set of mass portions 2410 and a second set of mass portions 2420 (FIG. 24). The body portion 2310 may include a top portion 2330, a bottom portion 2340, a toe portion 2350, a heel portion 2360, a front portion 2370, and a rear portion 2380. The bottom portion 2340 may include a skirt portion 2390 defined as a side portion of the golf club head 2300 between the top portion 2330 and the bottom portion 2340 excluding the front portion 2370 and extending across a periphery of the golf club head 2300 from the toe portion 2350, around the rear portion 2380, and to the heel portion 2360. The bottom portion 2340 may include a transition region 2430 and a port region 2440. For example, the port region 2440 may be a D-shape region. The port region 2440 may include a plurality of ports 2800 (FIG. 28) to receive the plurality of mass portions 2320. The front portion 2370 may include a face portion 2375 to engage a golf ball (not shown). The body portion 2310 may also include a hosel portion 2365 to receive a shaft (not shown). The hosel portion 2365 may be an integral portion or a separate portion of the body portion 2310. For example, the hosel portion 2365 may include a hosel sleeve with one end to receive a shaft and an opposite end that may be inserted into the body portion 2310. Alternatively, the body portion 2310 may include a bore instead of the hosel portion 2365. The golf club head 2300 may be constructed from similar material, may have a similar volume and be the same type of golf club head as the golf club head 100 or any of the golf club heads described herein. The apparatus, methods, and articles of manufacture described herein are not limited in this regard.

Each of the first set of mass portions 2410, generally shown as 2605, 2610, 2615, and 2620 may be associated with a first mass. Each of the second set of mass portions 2420, generally shown as 2640, 2645, 2650, 2655, 2660, 2665, and 2670 may be associated with a second mass. The first mass may be greater than the second mass or vice versa. The first and second set of mass portions 2410 and 2420, respectively, may provide various weight configurations for the golf club head 2300 that may be similar to the various weight configurations for the golf club head 100 or any of the golf club heads described herein. Alternatively, all of the mass portions of the first and second set of mass portions 2410 and 2420, respectively, may have the same mass. That is, the first and second masses may be equal to each other. The plurality of mass portions 2320 may have similar or different physical properties (e.g., density, shape, mass, volume, size, color, etc.). The mass portions 2320 may be similar in many respects to the mass portions 120 of the golf club head 100 or any of the golf club heads described herein. The apparatus, methods, and articles of manufacture described herein are not limited in this regard. The apparatus, methods, and articles of manufacture described herein are not limited in this regard.

Figure 28:
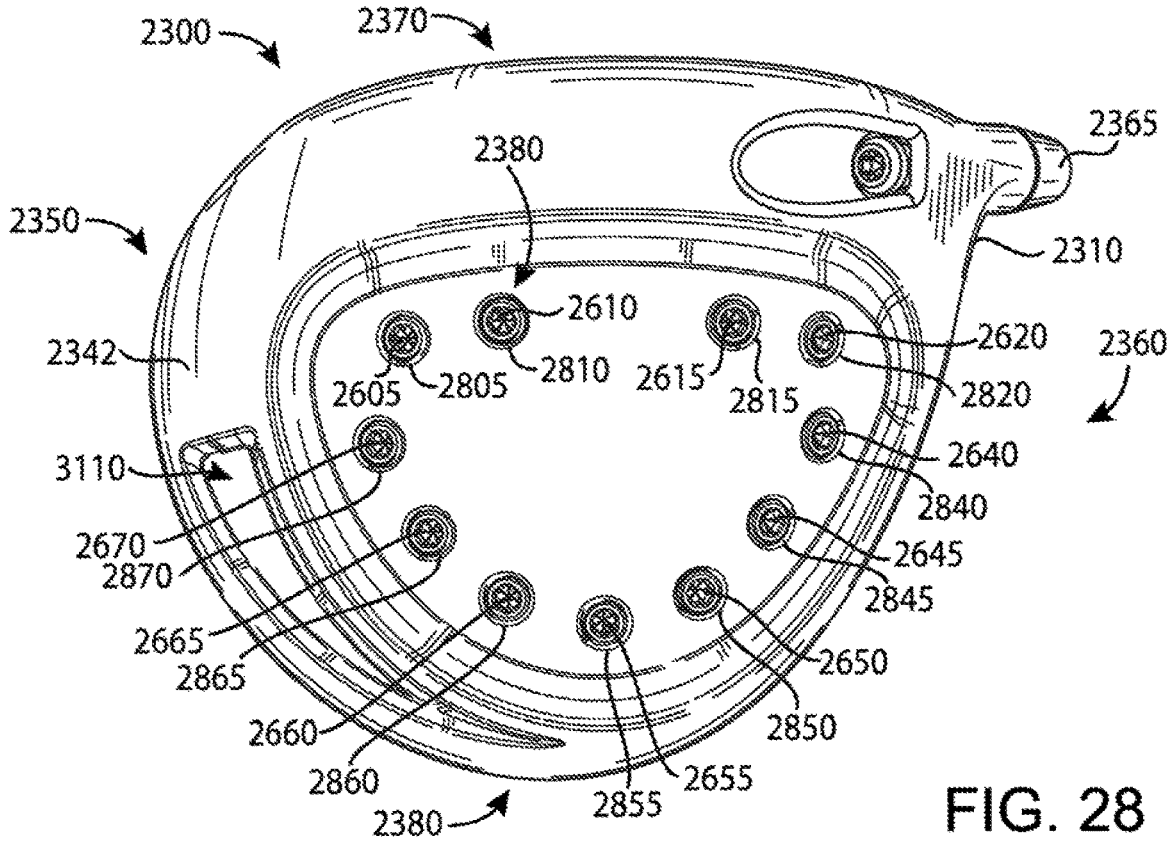
FIG. 28 depicts a bottom view of the example golf club head of FIG. 23.
Figure 29:
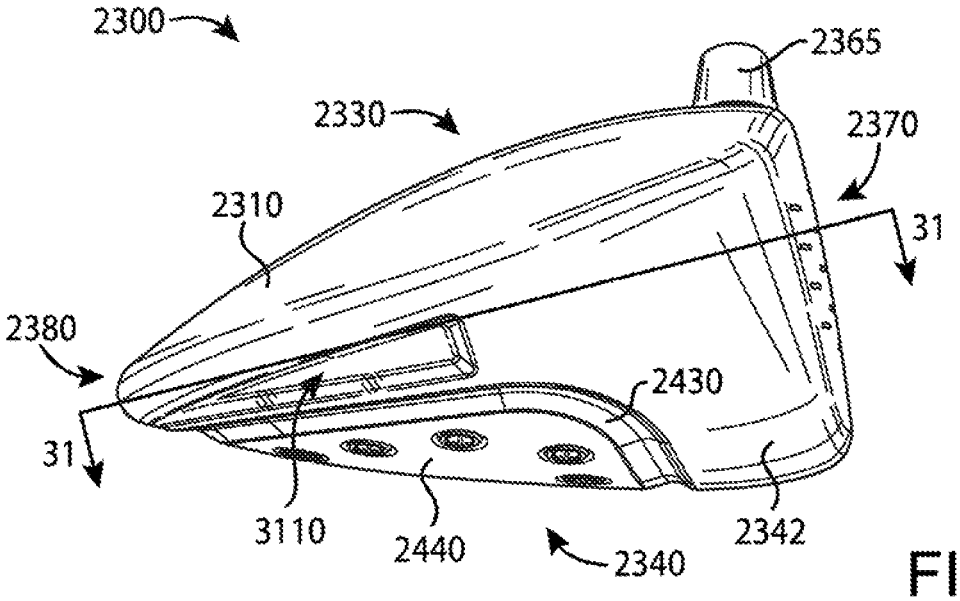
FIG. 29 depicts a toe view of the example golf club head of FIG. 23.
Figure 30:
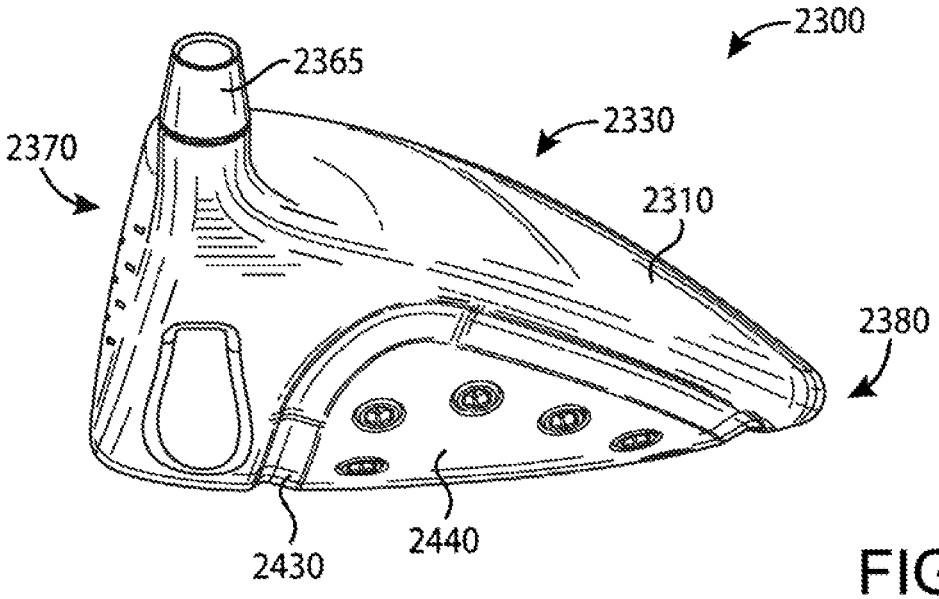
FIG. 30 depicts a heel view of the example golf club head of FIG. 23.

Referring to FIG. 28, for example, the bottom portion 2340 of the body portion 2310 may include a plurality of ports 2800. The plurality of ports 2800, generally shown as 2805, 2810, 2815, 2820, 2840, 2845, 2850, 2855, 2860, 2865, and 2870 may be located on and/or along a periphery of the port region 2440 of the bottom portion 2340. Each of the plurality of ports 2800 may be similar in many respects (e.g., port diameter) to any of the ports of the golf club head 100 or any of the golf club heads described herein. Further, each of the plurality of ports 2800 may be formed on the bottom portion 2340 similar to the formation of the ports 900 of the golf club head 100 or any of the golf club heads described herein. Further yet, the plurality of ports 2800 may extend across the bottom portion 2340 similar to the configuration of the ports 900 of the golf club head 100 or any of the golf club heads described herein. However, the configuration of the ports 2800 on the bottom portion 2340 may be different than the configuration of the ports 900 of the golf club head 100 or any of the golf club heads described herein. The apparatus, methods, and articles of manufacture described herein are not limited in this regard.

In one example shown in FIGS. 23-32, the bottom portion 2340 may include an outer surface 2342 and an inner surface 2344. Each of the outer surface 2342 and the inner surface 2344 may include one or a plurality of support portions, generally shown as 3110, 3120, and 3140. The outer surface 2342 may include at least one outer support portion 3110 and the inner surface 2344 may include a first set of inner support portions 3120 (generally shown as inner support portions 3121, 3122, 3123, 3124, 3125, 3126, 3127, 3128, 3129, 3130, 3131, 3132 and 3133), and a second set of inner support portions 3140 (generally shown as inner support portions 3141, 3142, 3143, 3144, 3145, and 3146). The apparatus, methods, and articles of manufacture described herein are not limited in this regard.

Figure 31:
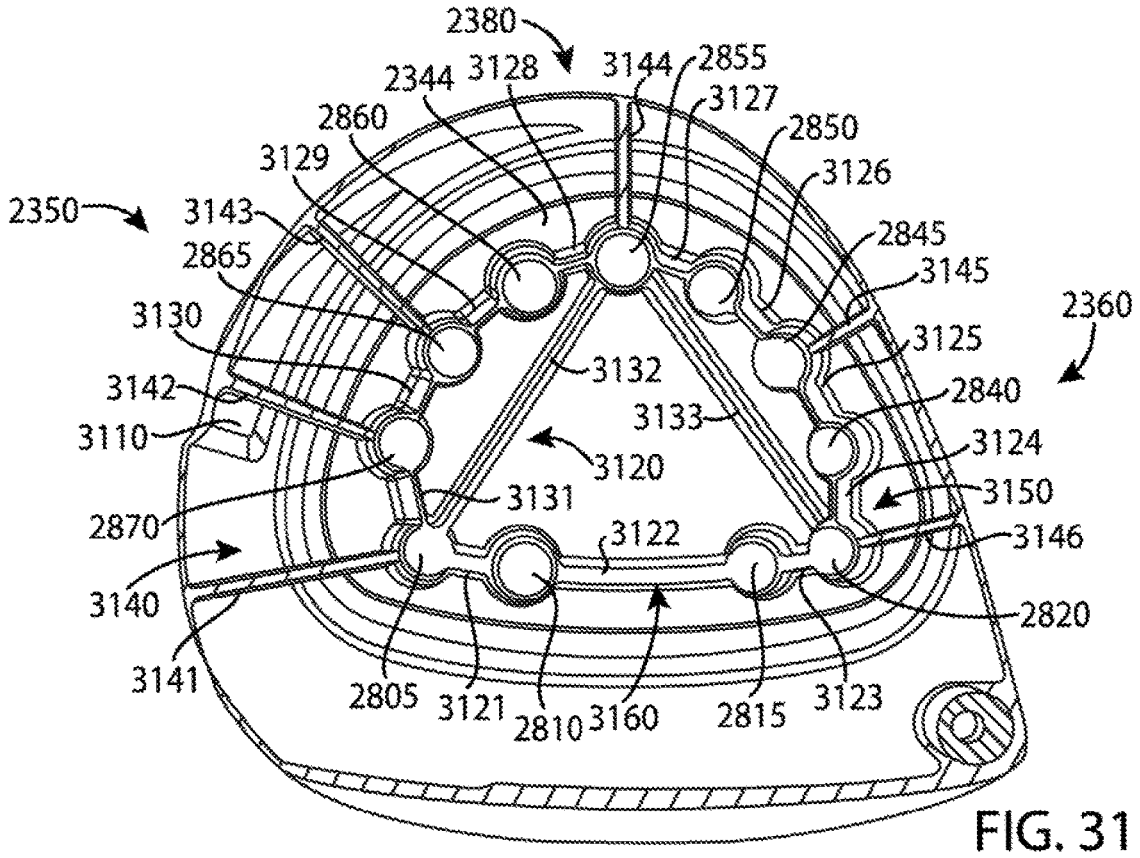
FIG. 31 depicts a cross-sectional view of the example golf club head of FIG. 23 taken at section line 31-31 of FIG. 29
Figure 32:
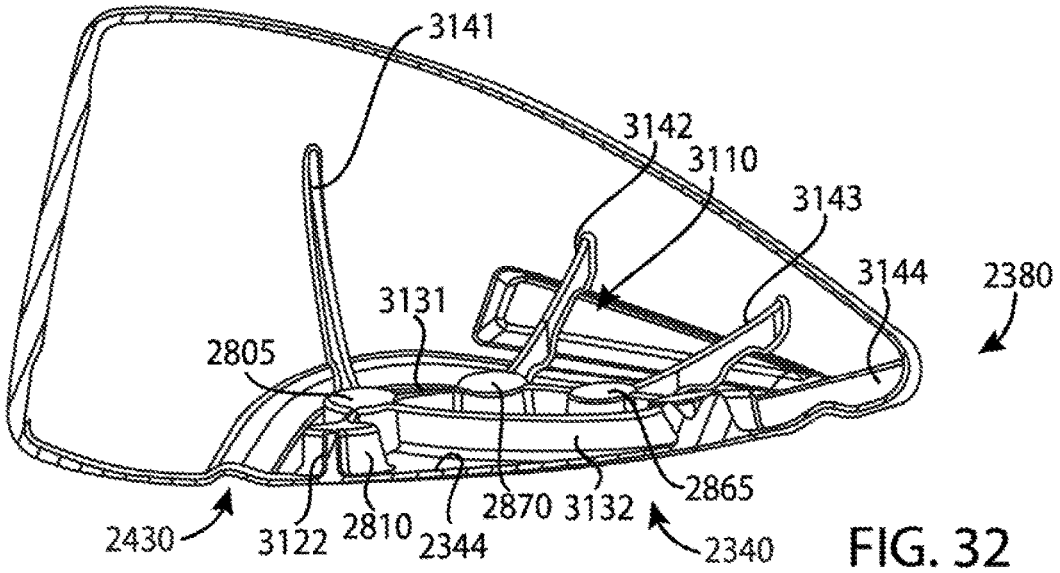
FIG. 32 depicts a cross-sectional view of the example golf club head of FIG. 23 taken at section line 32-32 of FIG. 25.

The outer support portion 3110 may be positioned on the bottom portion 2340 and/or the skirt portion 2390 between any of the ports 2800 and/or a periphery of the body portion 2310 as defined by the toe portion 2350, the heel portion 2360, the front portion 2370, and the rear portion 2380. However, the outer support portion 3110 may be positioned at any location on the golf club head 2300 for structural support of the golf club head 2300. As an example shown in FIGS. 23-32, the outer support portion 3110 may be defined by a groove or indentation that extends on the bottom portion 2340 and/or the skirt portion 2390 from the rear portion 2380 toward and/or to the toe portion 2350 proximate to a periphery of the body portion 2310. The outer support portion 3110 may have any configuration. As illustrated in FIG. 31, a width of the outer support portion 3110 may increase from the rear portion 2380 toward the toe portion 2350 while the outer support portion 3110 may follow a contour of the periphery of the body portion 2310 between the rear portion 2380 and the toe portion 2350. Accordingly, the outer support portion 3110 may resemble a curved triangular groove on the bottom portion 2340. The depth of the outer support portion 3110 may also vary. Alternatively, the depth of the outer support portion 3110 may be constant. Further, the depth of the outer support portion 3110 may be determined based on the thickness of the bottom portion 2340 and the material from which the bottom portion 2340 is formed. The apparatus, methods, and articles of manufacture described herein are not limited in this regard.

Each inner support portion of the first set of inner support portions 3120 may include walls, ribs and/or any projection from the inner surface 2344 of the bottom portion 2340. Each inner support portion of the first set of inner support portions 3120 may extend from and connect each port 2800 to an adjacent port or to one or more other non-adjacent ports 2800. As shown in FIG. 31, for example, the inner support portion 3121 may include a wall projecting from the inner surface 2344 of the bottom portion 2340 and connecting the ports 2805 and 2810. Similarly, as shown in FIG. 31, each pair of adjacent ports 2810 and 2815, 2815 and 2820, 2820 and 2840, 2840 and 2845, 2845 and 2850, 2850 and 2855, 2855 and 2860, 2860 and 2865, 2865 and 2870, 2870 and 2805 may be connected by inner support portions 3122, 3123, 3124, 3125, 3126, 3127, 3128, 3129, 3130, 3131, respectively. Accordingly, the inner support portions 3121 through 3131 of the first set of inner support portions 3120 may define a loop-shaped support region 3150 on the inner surface 2344 of the bottom portion 2340. The apparatus, methods, and articles of manufacture described herein are not limited in this regard.

Further, the inner support portion 3132 may include a wall projecting from the inner surface 2344 of the bottom portion 2340 and connecting two non-adjacent ports such as the ports 2805 and 2855. The inner support portion 3133 may include a wall projecting from the inner surface 2344 of the bottom portion 2340 and connecting two non-adjacent ports such as the ports 2820 and 2855. Accordingly, the inner support portions 3121, 3122, 3123, 3132 and 3133 may define a triangular support region 3160 on the inner surface 2344 of the bottom portion 2340 partially within the loop-shaped support region 3150 and partially overlapping the loop-shaped support region 3150. The ports 2805, 2820 and 2855 may define the vertices of the triangular support region 3160. The first set of inner support portions 3120 may have any configuration, connect any two or more of the ports, and/or define any shape. The apparatus, methods, and articles of manufacture described herein are not limited in this regard.

Each inner support portion of the second set of inner support portions 3140 may include walls, ribs and/or any projections on the inner surface 2344 of the bottom portion 2340. Each inner support portion of the second set of inner support portions 3140 may extend from one or more of the ports 2800 toward the periphery and/or the skirt portion 2390 of the body portion 2310. In one example shown in FIG. 31, the inner support portion 3141 may include a wall connected to the port 2805 and extending from the port 2805 toward and/or to the toe portion 2350. The inner support portion 3142 may include a wall connected to the port 2870 and extending from the port 2870 toward and/or to the toe portion 2350. The inner support portion 3143 may include a wall connected to the port 2865 and extending from the port 2865 toward and/or to the toe portion 2350 or the rear portion 2380. The length, height, thickness, orientation angle, and/or cross-sectional configuration of each of the inner support portions 3141, 3142 and 3143 may be configured such that the inner support portions 3141, 3142 and 3143 may provide or substantially provide structural support to the bottom portion 2340, the skirt portion 2390, the toe portion 2350, the front portion 2370 and/or the rear portion 2380. The apparatus, methods, and articles of manufacture described herein are not limited in this regard.

As illustrated in FIG. 31, the inner support portion 3144 may include a wall that may be connected to the port 2855 and may extend from the port 2855 toward and/or to the rear portion 2380. The inner support portion 3145 may include a wall connected to the port 2845 and extending from the port 2845 toward and/or to the heel portion 2360. The inner support portion 3146 may include a wall connected to the port 2820 and extending from the port 2820 toward and/or to the heel portion 2360. The length, height, thickness, orientation angle, and/or cross-sectional configuration of each of the inner support portions 3144, 3145 and 3146 may be configured such that the inner support portions 3144, 3145 and 3146 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

The first set of inner support portions 3120 may structurally support the bottom portion 2340 by distributing the impact loads exerted on the bottom portion 2340 throughout the bottom portion 2340 when the golf club head 2300 strikes a golf ball (not shown). The second set of inner support portions 3140 may further distribute the impact loads throughout the bottom portion 2340, the skirt portion 2390, toe portion 2350, the heel portion 2360, the front portion 2370, and/or the rear portion 2380. In one example, the second set of inner support portions 3140 may include additional walls, ribs and/or projections (not shown) that connect to any of the ports such as ports 2840, 2850 and 2860 to further distribute impact loads throughout the body portion 2310. While the above examples may depict a particular number of inner support portions, the bottom portion 2340 may include additional inner support portions (not shown). For example, the bottom portion 2340 may include a plurality of inner support portions (not shown) that connect non-adjacent ports 2800 (e.g., ports 2815 and 2860) and/or the second set of inner support portions 3140. The apparatus, methods, and articles of manufacture described herein are not limited in this regard.

The width (i.e., thickness), length, height, orientation angle, and/or cross-sectional shape of the inner support portions of the first set of inner support portions 3120 and/or the second set of inner support portions 3140 may be similar or vary and be configured to provide structural support to the golf club head 2300. For example, the materials from which the bottom portion 2340 and/or the body portion 2310 may be constructed may determine the width, length, height, orientation angle, and/or cross-sectional shape of the inner support portions of the first set of inner support portions 3120 and/or the second set of inner support portions 3140. For example, the inner support portions of the first set of inner support portions 3120 and/or the second set of inner support portions 3140 may be defined by walls with rectangular cross sections having heights that are similar to the depths of the mass portions 2800. The length of each inner support portion of the second set of inner support portions 3140 may be configured such that one or more inner support portions of the second set of inner support portions 3140 extend from the bottom portion 2340 to the skirt portion 2390. The apparatus, methods, and articles of manufacture described herein are not limited in this regard.

Any of the golf club heads described herein may have different configurations of outer support portions and/or inner support portions to provide structural support for the golf club head during impact with a golf ball depending on the size, thickness, materials of construction and/or other characteristics of any portions and/or parts of the golf club head. The different configurations of the outer support portions and/or inner support portions may affect vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein.

Figure 33:
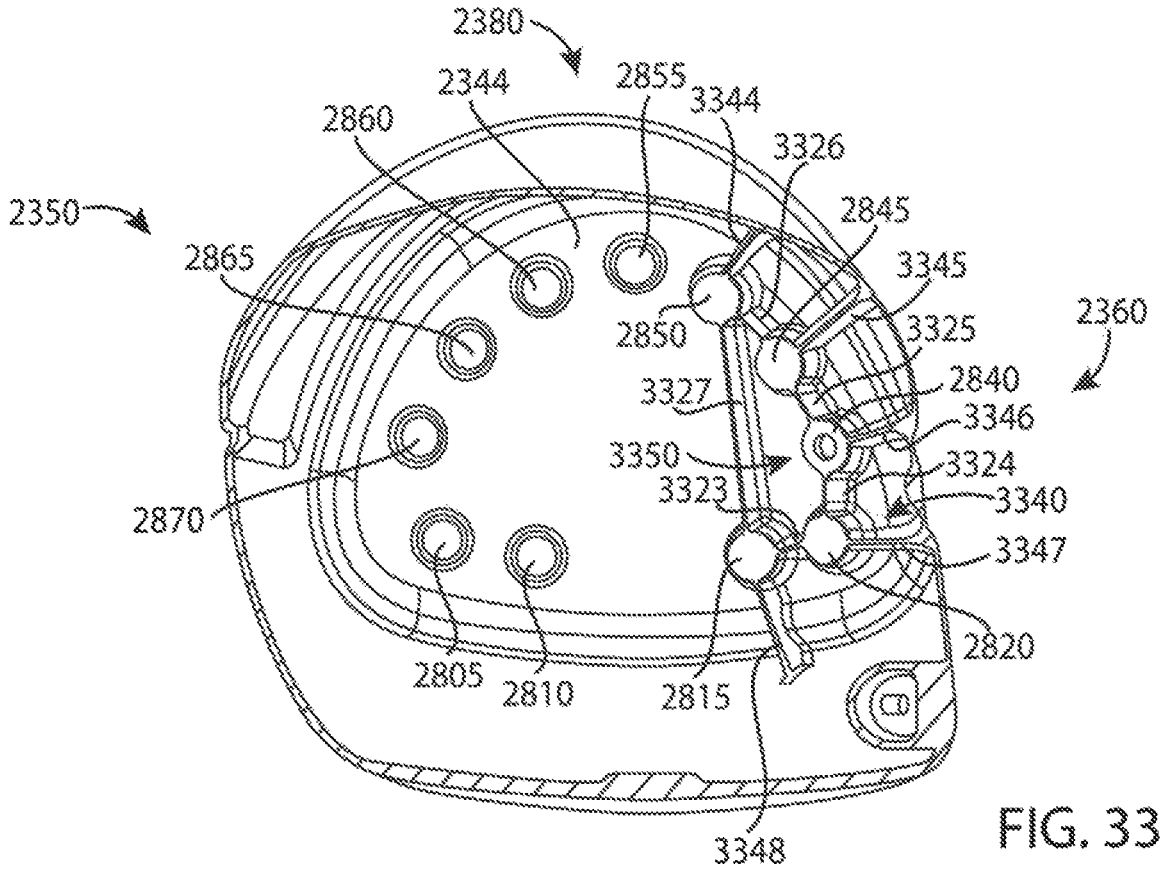
FIG. 33 depicts a cross-sectional view of an example golf club head of FIG. 23 taken at section line 31-31 of FIG. 29 according to an embodiment of the apparatus, methods, and articles of manufacture described herein.
Figure 34:
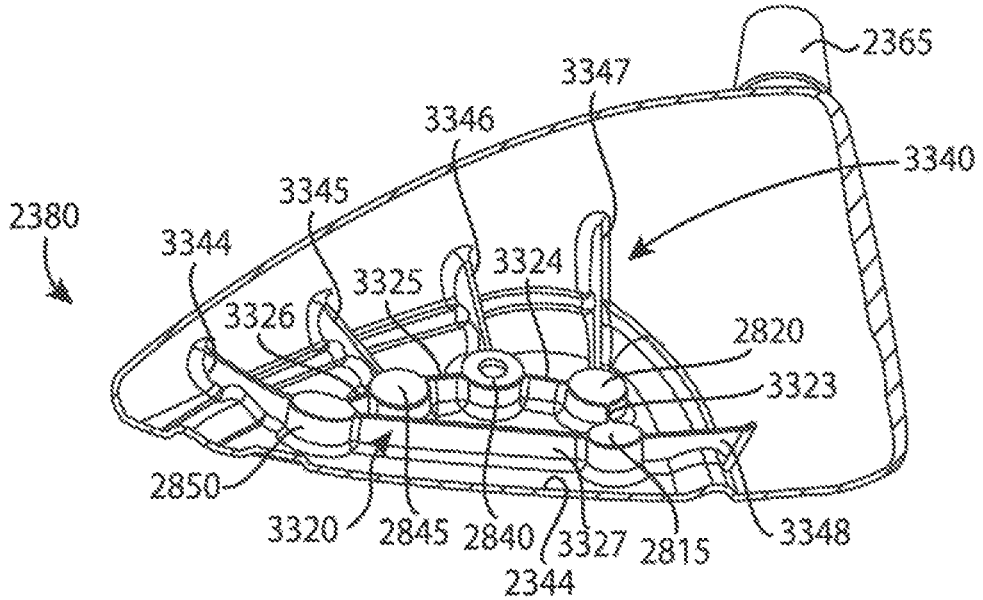
FIG. 34 depicts a cross-sectional view of the golf club head of FIG. 33 taken at section line 32-32 of FIG. 25.

FIGS. 33 and 34 show another example of the golf club head 2300 with a different configuration of inner support portions. The inner surface 2344 of the bottom portion 2340 may include a first set of inner support portions 3320 (generally shown as inner support portions 3323, 3324, 3325, 3326, and 3327), and a second set of inner support portions 3340 (generally shown as inner support portions 3344, 3345, 3346, 3347 and 3348). The first set of inner support portions 3320 and the second set of inner support portions 3340 are closer to the heel portion 2360 than to the toe portion 2350. For example, the first set of inner support portions 3320 and the second set of inner support portions 3340 may be located on the bottom portion 2340 between a midpoint (not shown) of the body portion 2310 and the heel portion 2360. The apparatus, methods, and articles of manufacture described herein are not limited in this regard.

The first set of inner support portions 3320 may be similar in many respects to any of the inner support portions described herein such as the inner support portions of the first set of inner support portions 3120 shown in FIG. 31. As shown in FIGS. 33 and 34, for example, the inner support portion 3323 may include a wall projecting from the inner surface 2344 of the bottom portion 2340 and connecting the ports 2815 and 2820. Similarly, each pair of adjacent ports 2815 and 2820, 2820 and 2840, 2840 and 2845, 2845 and 2850, and 2850 and 2815 may be connected by inner support portions 3323, 3324, 3325, 3326, and 3327, respectively. Accordingly, the inner support portions 3323 through 3327 of the first set of inner support portions 3320 may define a loop-shaped support region 3350 on the inner surface 2344 of the bottom portion 2340. The loop-shaped support region 3350 may be closer to the heel portion 2360 than to the toe portion 2350. The loop-shaped support region 3350 may be located between a midpoint (not shown) of the body portion 2310 and the heel portion 2360. The apparatus, methods, and articles of manufacture described herein are not limited in this regard.

The second set of inner support portions 3340 may be similar in many respects to any of the inner support portions described herein such as the second set of inner support portions 3140 shown in FIG. 31. As shown in FIGS. 33 and 34, for example, the inner support portion 3344 may include a wall connected to the port 2850 and extend from the port 2850 toward and/or to the rear portion 2380. The inner support portion 3345 may include a wall connected to the port 2845 and extend from the port 2845 toward and/or to the heel portion 2360 and the rear portion 2380. The inner support portion 3346 may include a wall connected to the port 2840 and extend from the port 2840 toward and/or to the heel portion 2360. The inner support portion 3347 may include a wall connected to the port 2820 and extend from the port 2820 toward and/or to the heel portion 2360. The inner support portion 3348 may include a wall connected to the port 2815 and extend from the port 3815 toward and/or to the front portion 2370. The length, height, thickness, orientation angle, and/or cross-sectional configuration of each of the inner support portions 3344, 3345, 3346, 3347 and 3348 may be configured such that the inner support portions 3344, 3345, 3346, 3347 and 3348 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

Figure 35:
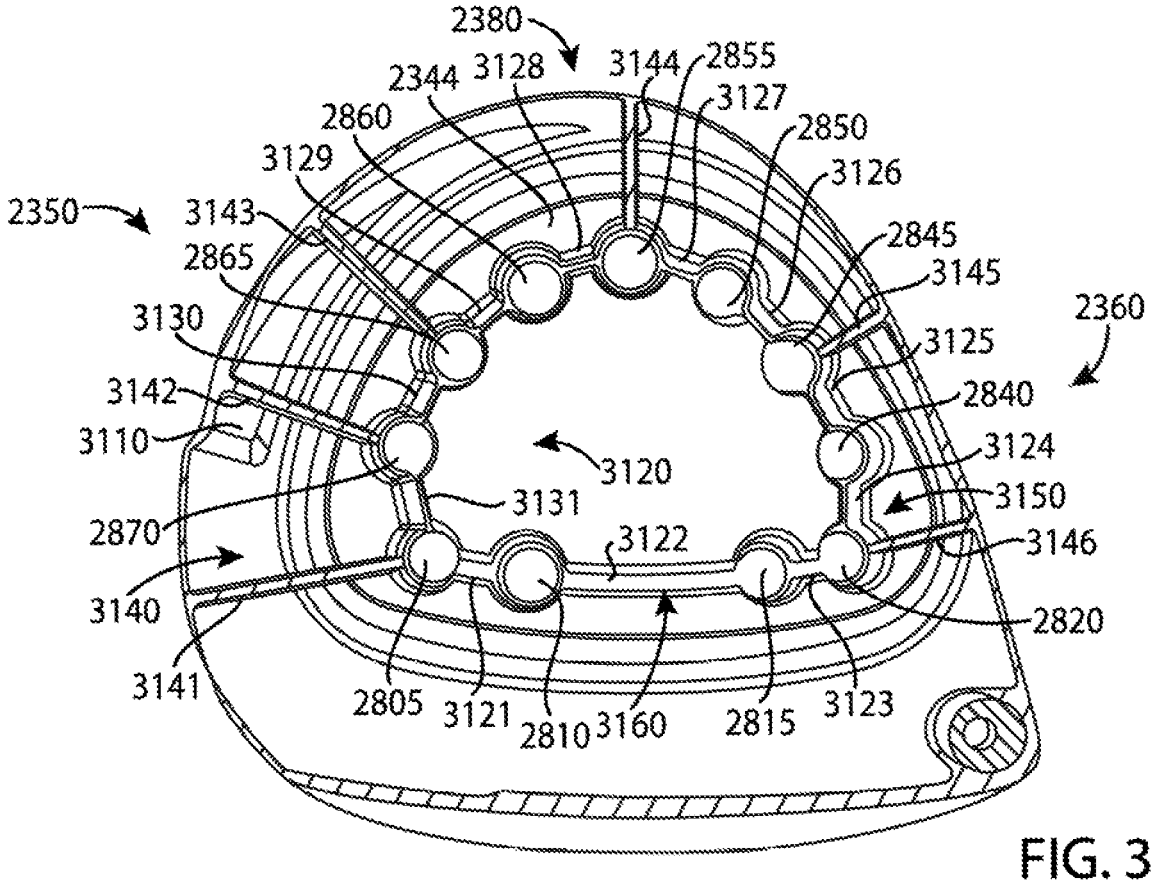
FIG. 35 depicts a cross-sectional view of an example golf club head of FIG. 23 taken at section line 31-31 of FIG. 29 according to an embodiment of the apparatus, methods, and articles of manufacture described herein.
Figure 43:
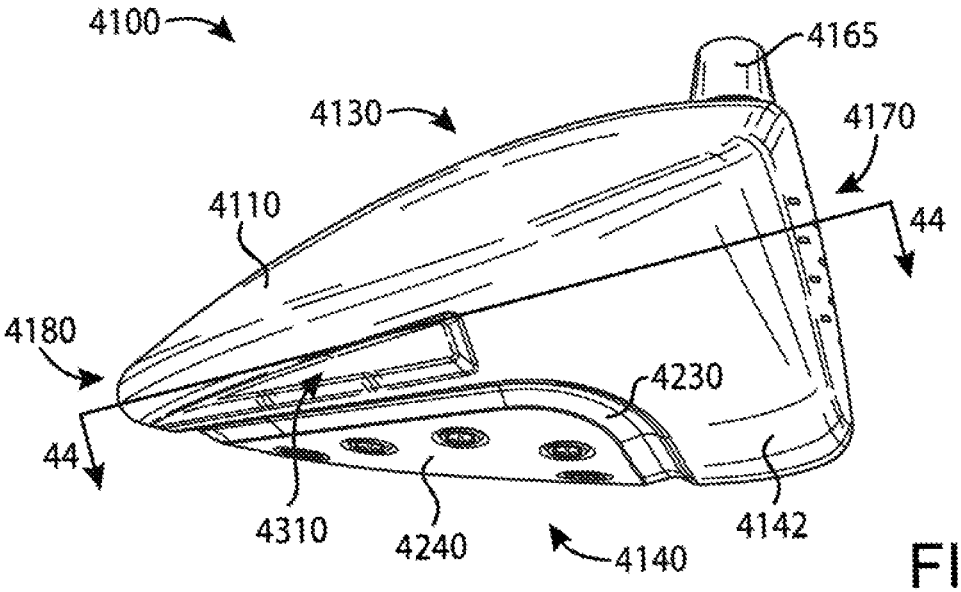
FIG. 43 depicts a toe view of the example golf club head of FIG. 41.
Figure 44:
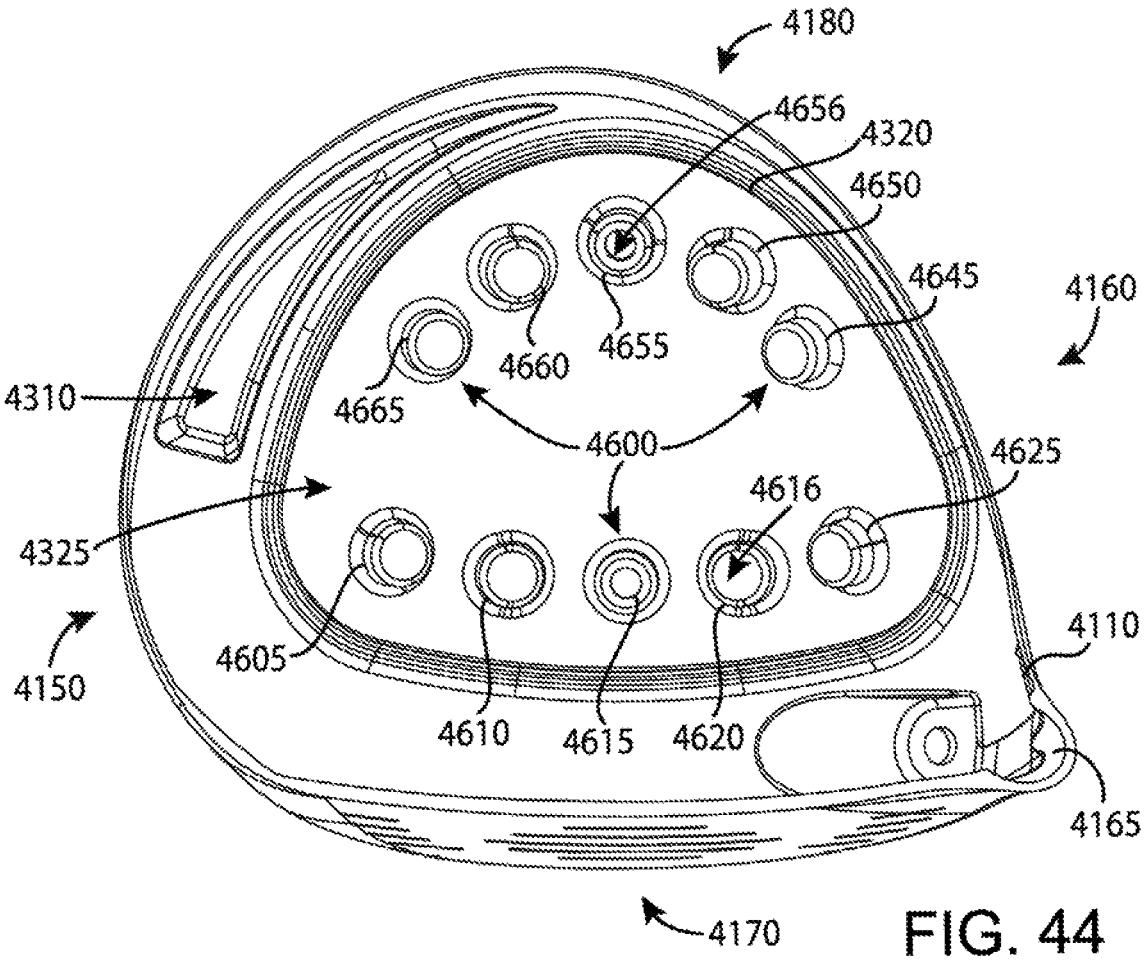
FIG. 44 depicts a top perspective cross-sectional view of the golf club head of FIG. 41 taken at section line 44-44 of FIG. 43.

FIG. 35 shows another example of the golf club head 2300 with a different configuration of the inner support portions. The inner surface 2344 may include a first set of inner support portions 3120 (generally shown as inner support portions 3121, 3122, 3123, 3124, 3125, 3126, 3127, 3128, 3129, 3130 and 3131), and a second set of inner support portions 3140 (generally shown as inner support portions 3141, 3142, 3143, 3144, 3145, and 3146). Accordingly, the golf club head 2300 of FIG. 43 may be similar to the golf club head 2300 of FIG. 31, except that the golf club head 2300 of FIG. 43 does not include the inner support portions 3132 and 3133. The apparatus, methods, and articles of manufacture described herein are not limited in this regard.

In addition to any of the golf club heads described herein having different configurations of outer support portions and/or inner support portions, any of the golf club heads described herein may have different configurations of ports in combination with different configurations of the outer support portions and/or the inner support portions. The different configurations of the ports may affect the weight distribution of the golf club head. The different configurations of the outer support portions and/or inner support portions may affect stiffness, vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more or less ports than some of the example golf club heads described herein. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein. The apparatus, methods, and articles of manufacture described herein are not limited in this regard.

Figure 36:
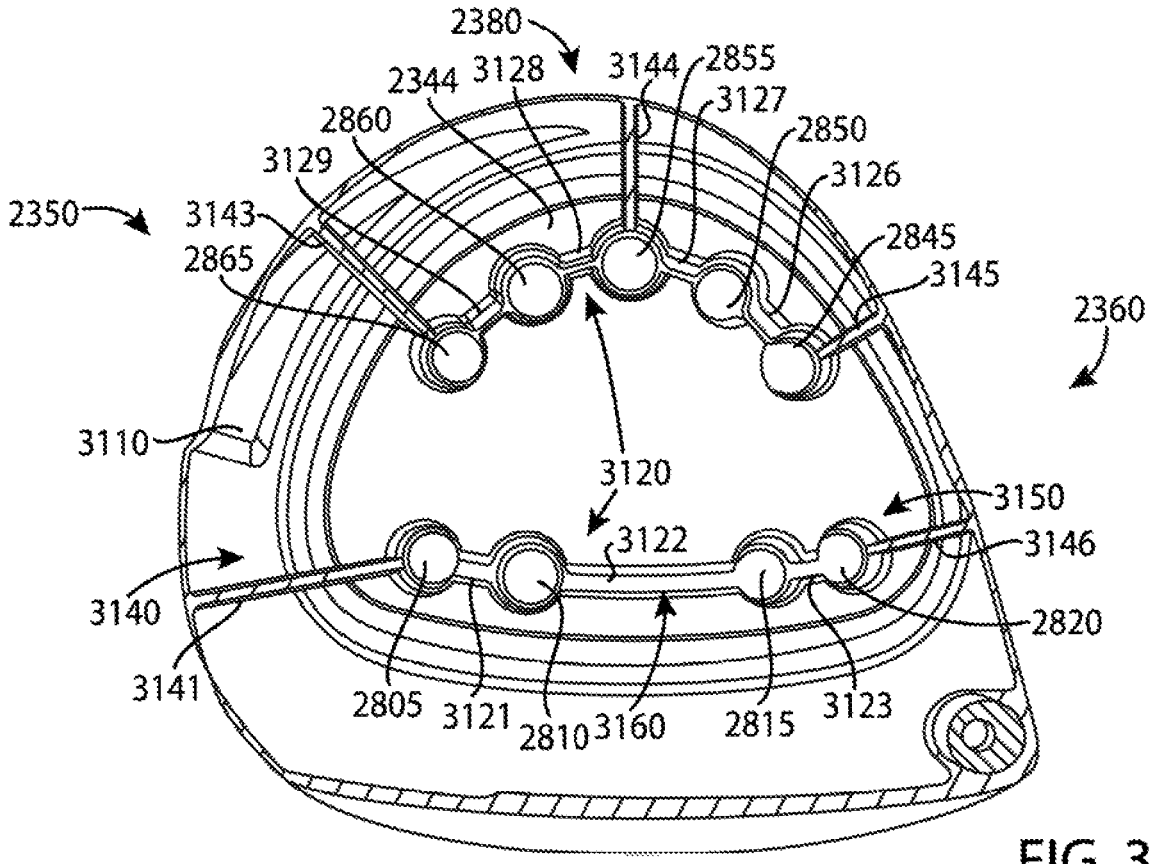
FIG. 36 depicts a cross-sectional view of an example golf club head of FIG. 23 taken at section line 31-31 of FIG. 29 according to an embodiment of the apparatus, methods, and articles of manufacture described herein.

FIG. 36 shows another example of the golf club head 2300 with a different configuration of the ports and different configuration of inner support portions. The bottom portion 2340 may include a plurality of ports 2800, which are generally shown as 2805, 2810, 2815, 2820, 2845, 2850, 2855, 2860, and 2865. Accordingly, the golf club head 2300 of FIG. 36 is similar to the golf club head 2300 of FIG. 31, except that the golf club head 2300 of FIG. 36 does not include ports 2840 and 2870. Also, in the example of FIG. 36, the inner surface 2344 of the bottom portion 2340 may include a first set of inner support portions 3120 (generally shown as inner support portions 3121, 3122, 3123, 3126, 3127, 3128, and 3129), and a second set of inner support portions 3140 (generally shown as inner support portions 3141, 3143, 3144, 3145, and 3146). Accordingly, the golf club head 2300 of FIG. 36 may be similar to the golf club head 2300 of FIG. 31, except that the golf club head 2300 of FIG. 36 does not include the inner support portions 3124, 3125, 3130, 3131, 3132, 3133 and 3142. The apparatus, methods, and articles of manufacture described herein are not limited in this regard.

Figure 37:
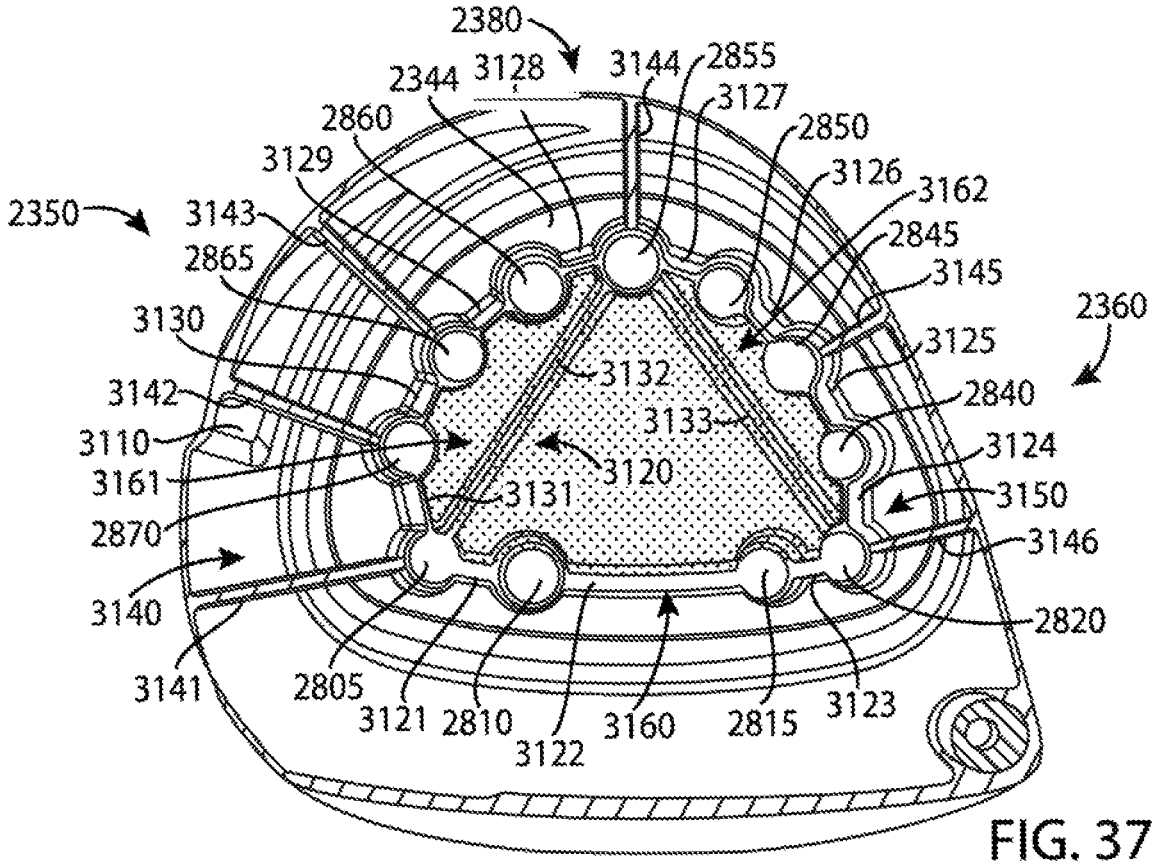
FIG. 37 depicts a cross-sectional view of an example golf club head of FIG. 23 taken at section line 31-31 of FIG. 29 according to an embodiment of the apparatus, methods, and articles of manufacture described herein.

In one example shown in FIG. 37, certain regions of the interior of the body portion 2310 of the golf club head 2300 may include an elastic polymer material or an elastomer material, which may be referred to herein as the filler material. The filler material may dampen vibration, dampen noise, lower the center of gravity and/or provide a better feel and sound for the golf club head 2300 when striking a golf ball (not shown). According to one example, the triangular support region 3160 may be filled with the filler material. The filler material may extend from the inner surface 2344 of the bottom portion 2340 up to a height of any of the inner support portions 3122, 3132 and/or 3133. However, the filler material may extend below or above the height of any of the inner support portions 3122, 3132 and/or 3133. Further, the thickness of the filler material, which may be defined as the distance the filler material extends from the inner surface 2344 of the bottom portion 2340, may vary. In one example, the thickness of the filler material may be greater around a center portion of the triangular support region 3160 than the sides of the triangular support region 3160. In another example, the thickness of the filler material may be less around a center portion of the triangular support region 3160 than the sides of the triangular support region 3160. The apparatus, methods, and articles of manufacture described herein are not limited in this regard.

According to another example, a support region 3161 defined by the inner support portions 3128, 3129, 3130, 3131 and 3132; and a support region 3162 defined by the inner support portions 3124, 3125, 3136, 3137 and 3133 may be filled with the filler material. The filler material may extend from the inner surface 2344 of the bottom portion 2340 up to a height of any of the inner support portions defining the support regions 3161 and/or 3162. However, the filler material may extend below or above the height of any of the inner support portions defining the support regions 3161 and 3162. Further, the thickness of the filler material, which may be defined as the distance the filler material extends from the inner surface 2344 of the bottom portion 2340, may vary. In one example, the thickness of the filler material may be greater around a center portion of the support region 3161 and/or the support region 3162 than the sides of the support region 3161 and/or the support region 3162, respectively. In another example, the thickness of the filler material may be less around a center portion of the support region 3161 and/or support region 3162 than the sides of the support region 3161 and/or 3162, respectively. According to one example, any one or a combination of the support regions 3160, 3161 and/or 3162 may be filled with the filler material as described herein. The apparatus, methods, and articles of manufacture described herein are not limited in this regard.

Figure 38:
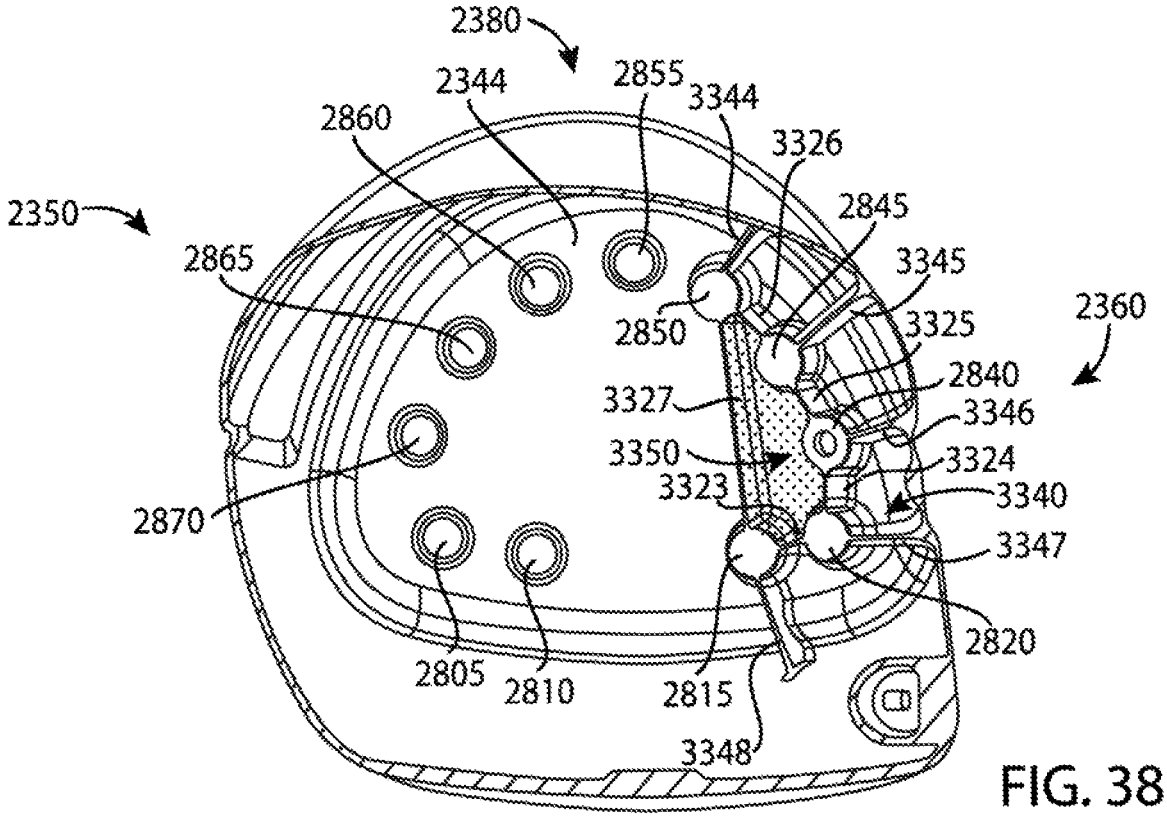
FIG. 38 depicts a cross-sectional view of an example golf club head of FIG. 23 taken at section line 31-31 of FIG. 29 according to an embodiment of the apparatus, methods, and articles of manufacture described herein.

In one example shown in FIG. 38, which is similar to many respects to the golf club head 2300 shown in FIG. 33, certain regions of the interior of the body portion 2310 of the golf club head 2300 may include the filler material, which may be an elastic polymer material or an elastomer material as described. The filler material may dampen vibration, dampen noise, lower the center of gravity and/or provide a better feel and sound for the golf club head 2300 when striking a golf ball (not shown). According to one example, the support region 3350 may be filled with the filler material. The filler material may extend from the inner surface 2344 of the bottom portion 2340 up to a height of any of the inner support portions 3323, 3324, 3325, 3326 and/or 3327. However, the filler material may extend below or above the height of any of the inner support portions 3323, 3324, 3325, 3326 and/or 3327. Further, the thickness of the filler material, which may be defined as the distance the filler material extends from the inner surface 2344 of the bottom portion 2340, may vary. In one example, the thickness of the filler material may be greater around a center portion of the support region 3350 than the sides of the support region 3350. In another example, the thickness of the filler material may be less around a center portion of the support region 3350 than the sides of the support region 3350. The apparatus, methods, and articles of manufacture described herein are not limited in this regard.

Figure 39:
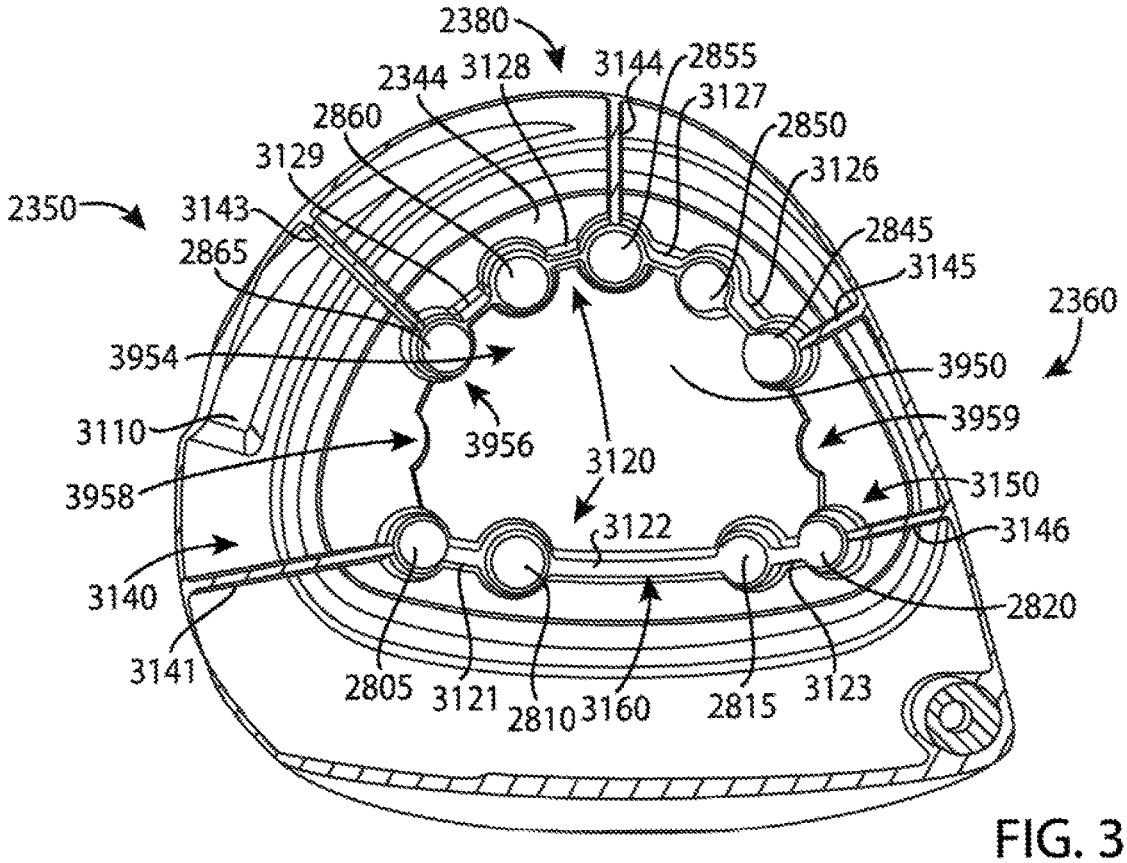
FIG. 39 depicts a cross-sectional view of an example golf club head of FIG. 23 taken at section line 31-31 of FIG. 29 according to an embodiment of the apparatus, methods, and articles of manufacture described herein.

Any of the golf club heads described herein may have one or more interior regions that may include a filler material as described. In one example, the filler material be injected into a region of the golf club head from one or more ports on the golf club head to cover or fill the region. The one or more ports that may be used to inject the filler material may be one or more of the ports described herein. Accordingly, the filler material may be molded to the shape of the region in which the filler material is injected to cover or fill the region. Alternatively, one or more inserts may be formed from elastic polymer material or an elastomer material (i.e., filler material) and placed in one or more regions of the interior of golf club head. FIG. 39 shows an example of the golf club head 2300 of FIG. 36 with an insert 3950, which may be constructed from an elastic polymer material or an elastomer material. The insert 3950 may be manufactured to have a similar shape as the shape of a region 3954 on the inner surface 2344 of the bottom portion 2340. Accordingly, the insert 3950 may have a curvature similar to the curvature of the bottom portion 2340 at the region 3954 to lay generally flat and in contact with the inner surface 2344 of the bottom portion 2340, have a shape that may be similar to the shape of the region 3954 to be inserted in the region 3954 and generally fit within the region 3954, and/or have a plurality of cutout portions 3956 to generally match the shape and/or contour of sidewall portions of each of the ports 2800. The apparatus, methods, and articles of manufacture described herein are not limited in this regard.

The insert 3950 may have a thickness that may be similar to the height of any of the ports 2800. Accordingly, when the insert 3950 is in the region 3954, the top portion of the insert 3950 at or proximate to the ports 2800 may be at the same height or substantially the same height as the ports 2800. However, the thickness of the insert 3950 may be constant or vary such that the thickness of the insert 3950 at any location of the insert 3950 may be more or less than the height of any of the ports 2800. The insert 3950 may dampen vibration, dampen noise, lower the center of gravity and/or provide a better feel and sound for the golf club head 2300 of FIG. 39 when striking a golf ball (not shown). The apparatus, methods, and articles of manufacture described herein are not limited in this regard.

The insert 3950 may be manufactured for use with any of the golf club heads described herein. As shown in FIG. 39, the insert 3950 may include a plurality of cutout portions 3956 that may generally match the shape of the outer wall portions of the ports 2800. The insert 3950 shown in FIG. 39 further includes cutout portions 3958 and 3959. Referring back to FIG. 35, when the insert 3950 is used with the golf club head 2300 of FIG. 35, the cut out portions 3958 and 3959 may generally match the shape of the outer wall portions of the weigh ports 2870 and 2840, respectively. Accordingly, the insert 3950 can be used in both the golf club head 2300 of FIG. 35 and the golf club head 2300 of FIG. 36. The apparatus, methods, and articles of manufacture described herein are not limited in this regard.

Referring back to FIG. 31, the insert 3950 may include channels, grooves or slots (not shown) that may be sized and shaped to receive the inner support portions 3132 and 3133 therein. Accordingly, an insert 3950 may be manufactured with the described channels, grooves or slot for use with the golf club heads 2300 of FIGS. 31, 33, 35 and 36. Alternatively, one or more inserts may be manufactured that may only fit one of the golf club heads described herein. For example, each of the golf club heads described herein may include one or more inserts that may have a certain shape for fitting only within one or more regions in the golf club head. Referring back to FIG. 31, for example, the golf club head 2300 may include a first insert (not shown) for fitting in the support region 3161, a second insert (not shown) for fitting in the triangular support region 3160, and a third insert (not shown) for fitting in the support region 3162. Referring back to FIG. 33, for example, the golf club head 3300 may include an insert (not shown) for fitting in the support region 3350. The apparatus, methods, and articles of manufacture described herein are not limited in this regard.

Figure 40:
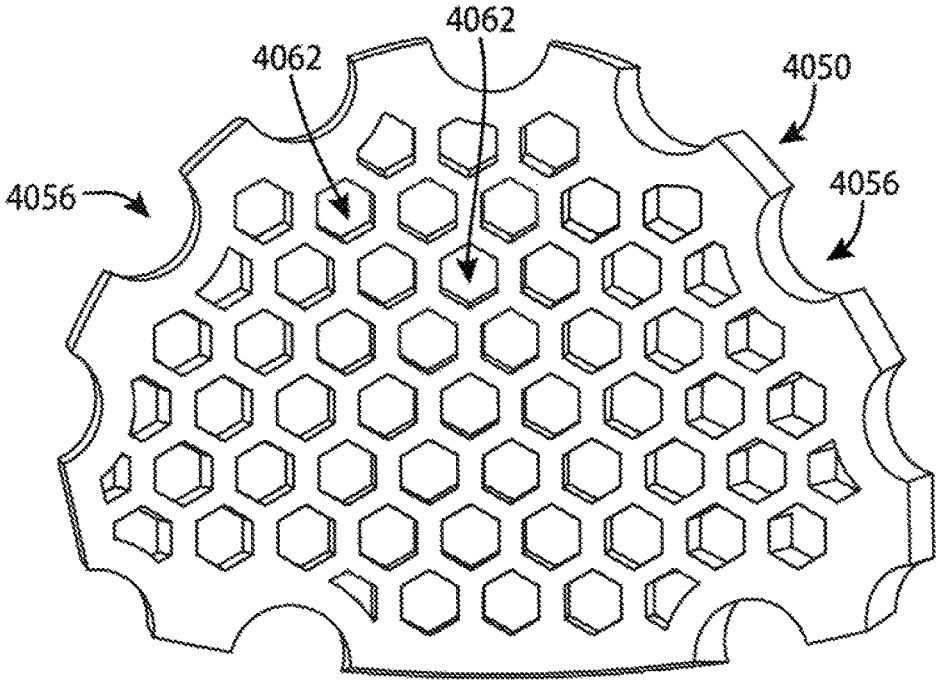
FIG. 40 depicts a perspective view of an polymer insert according to an embodiment of the apparatus, methods, and articles of manufacture described herein.
Figure 41:
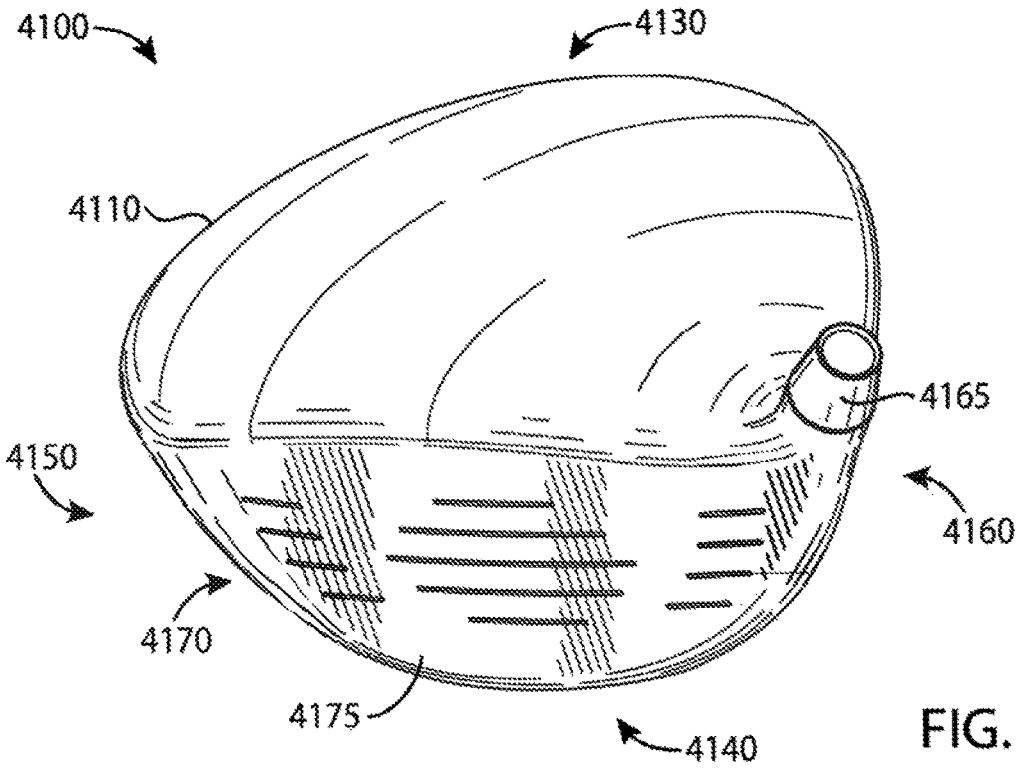
FIG. 41 is top perspective view of an example golf club head according to an embodiment of the apparatus, methods, and articles of manufacture described herein.
Figure 42:
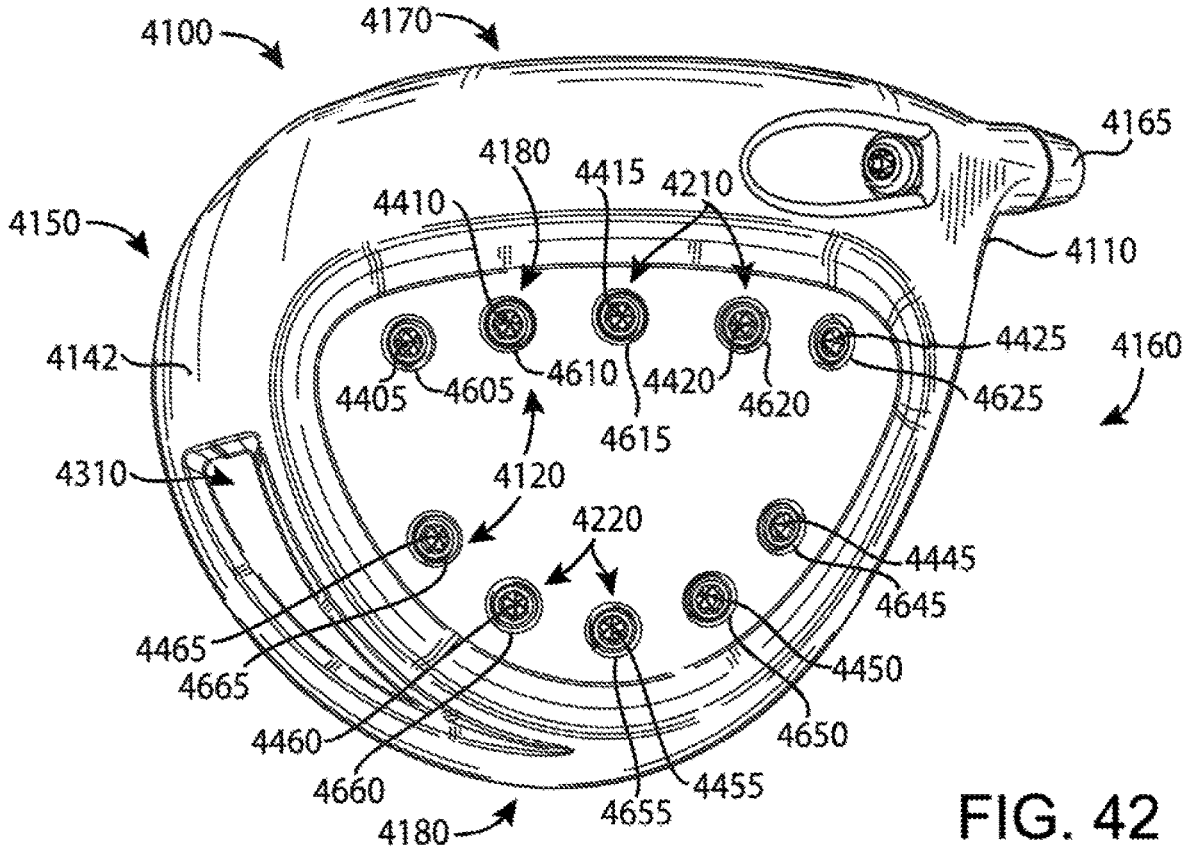
FIG. 42 depicts a bottom view of the example golf club head of FIG. 41.

Any of the inserts described herein may be manufactured from an elastic polymer material as a one-piece continuous part. In the example of FIG. 39, the insert 3950 may be a one-piece continuous part without any recesses and/or holes. FIG. 40 illustrates an insert 4050 that is similar in many respects to the insert 3950. Accordingly, in one example, the insert 4050 may be manufactured to have a similar shape as the shape of the region 3954 on the inner surface 2344 of the bottom portion 2340 of the golf club head 23 of FIG. 39 and further include a plurality of cutout portions 4056 similar to the cutout portions 3956, 3958 and 3959 as described herein. The insert 4050 further includes a plurality of holes 4062 that may reduce the weight of the insert 4050 and/or the amount of material used for the construction of the insert 4050. The insert 4050 may include any number of holes 4062 arranged in any configuration on the insert 4050. In the example of FIG. 40, the insert 4050 includes a plurality of hexagonal holes 4062 that extend through the thickness of the insert 4050 and are arranged on the insert 4050 to define a pattern similar to a honeycomb pattern. The holes 4062 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the holes 4062 may be similar or different in shape, size and/or arrangement on the insert 4050. In one example, the insert 4050 may include a plurality of round holes (not shown). In another example, the insert 4050 may include a plurality of slots, grooves and/or slits (not shown). In yet another example, the insert 4050 may include recesses (not shown) that do not extend through the insert 4050. The apparatus, methods, and articles of manufacture described herein are not limited in this regard.

Any of the filler materials and or inserts described herein may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E. I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material including any of the inserts that may be manufactured from the filler material as described herein may be bonded, attached and/or connected to any of the golf club heads described herein by a bonding portion (not shown) to improve adhesion and/or mitigate delamination between the body portion of any of the golf club heads described herein and the filler material. The bonding portion may be a bonding agent, an epoxy, a combination of bonding agents, a bonding structure or attachment device, a combination of bonding structures and/or attachment devices, and/or a combination of one or more bonding agents, one or more bonding structures and/or one or more attachment devices. In one example, the bonding portion may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion may be LOCTITE® materials manufactured by Henkel Corporation, Rocky Hill, Conn. The apparatus, methods, and articles of manufacture are not limited in this regard.

In the example of FIGS. 41-47, a golf club head 4100 may include a body portion 4110 with a top portion 4130, a bottom portion 4140, a toe portion 4150, a heel portion 4160, a front portion 4170, and a rear portion 4180. The bottom portion 4140 may include a skirt portion (not shown) defined as a side portion of the golf club head 4100 between the top portion 4130 and the bottom portion 4140 excluding the front portion 4170 and extending across a periphery of the golf club head 4100 from the toe portion 4150, around the rear portion 4180, and to the heel portion 4160. The bottom portion 4140 may include a transition region 4230 and a port region 4240. The transition region 4230 may be defined by a groove or a channel on the bottom portion 4140. Further, the transition region 4230 may define the boundary of the port region 4240. The front portion 4170 may include a face portion 4175 to engage a golf ball (not shown). The body portion 4110 may also include a hosel portion 4165 that may be similar in many respects to any of the hosel portions described herein. Alternatively, the body portion 4110 may include a bore instead of the hosel portion 4165. The body portion 4110 may be made partially or entirely from any of the materials described herein. Further, the golf club head 4100 may be any type of golf club head having a club head volume similar to the club head volume of any of the golf club heads described herein. The apparatus, methods, and articles of manufacture described herein are not limited in this regard.

The body portion 4110 may include a plurality of mass portions 4120 (FIG. 42), generally, shown as a first set of mass portions 4210 (generally shown as mass portions 4405, 4410, 4415, 4420 and 4425) and a second set of mass portions 4220 (generally shown as mass portions 4445, 4450, 4455, 4460 and 4465). The port region 4240 may have a shape similar to the port regions of any of the golf club heads described herein. The port region 4240 may include a plurality of ports 4600 (generally shown as ports 4605, 4610, 4615, 4620, 4625, 4645, 4650, 4655, 4660 and 4665) to receive the plurality of mass portions 4120. The characteristics (e.g., density, shape, volume, size, color, dimensions, depth, diameter, materials of construction, mass, method of formation, etc.), location on the golf club head (e.g., location relative to the periphery of the golf club head and/or location relative to other mass portions and/or ports), and/or any other properties of each mass portion of the plurality of mass portions 4120 and each port of the plurality of ports 4600 may be similar in many respects to each mass portion and port, respectively, of any of the golf club heads described herein. The apparatus, methods, and articles of manufacture described herein are not limited in this regard.

The outer surface 4142 and/or the inner surface 4144 of the bottom portion 4140 may include one or a plurality of support portions similar to any of the inner or outer support portions described herein. The outer surface 4142 may include at least one outer support portion 4310. The outer support portion 4310 may be similar in many respects including the function thereof to the outer support portion 3110 of the golf club head 2300. The apparatus, methods, and articles of manufacture described herein are not limited in this regard.

The inner surface 4144 may include an inner support portion 4320, which may be also referred to herein as the inner support portion 4320. The inner support portion 4320 may include a wall, a rib and/or any projection extending from the inner surface 4144 of the bottom portion 4140. The inner support portion 4320 may extend around some or all of the ports 4600 to partially or fully surround the ports 4600. In the example of FIGS. 41-47, the inner support portion 4320 fully surrounds the ports 4600. Accordingly, the inner support portion 4320 may define an inner port region 4325 on the inner surface 4144 of the bottom portion 4140. The inner support portion 4320 may structurally support the bottom portion 4140 by distributing the impact loads exerted on the bottom portion 4140 throughout the bottom portion 4140 when the golf club head 100 strikes a golf ball (not shown). While the above examples may depict a particular inner support portion, the bottom portion 4140 may include additional inner support portions and/or any type of support portions (not shown). The apparatus, methods, and articles of manufacture described herein are not limited in this regard.

The width (i.e., thickness), length, height, orientation angle, and/or cross-sectional shape of the inner support portion 4320 may be similar or vary along the length of the inner support portion 4320 and be configured to provide structural support to the golf club head 4100. For example, characteristics of the body portion 4110 and/or the bottom portion 4140 including the materials from which the bottom portion 4140 and/or the body portion 4110 is constructed may determine the width, length, height, orientation angle, and/or cross-sectional shape of the inner support portion 4320 along the length of the inner support portion 4320. In one example, the inner support portion 4320 may be defined by a wall having a height that may be similar to the depths of the mass portions 4600. In another example, the inner support portion 4320 may be defined by a wall having a height that may be greater than the depths of the mass portions 4600. In yet another example, the inner support portion 4320 may be defined by a wall having a height that may be smaller than the depths of the mass portions 4600. The apparatus, methods, and articles of manufacture described herein are not limited in this regard.

Figure 45:
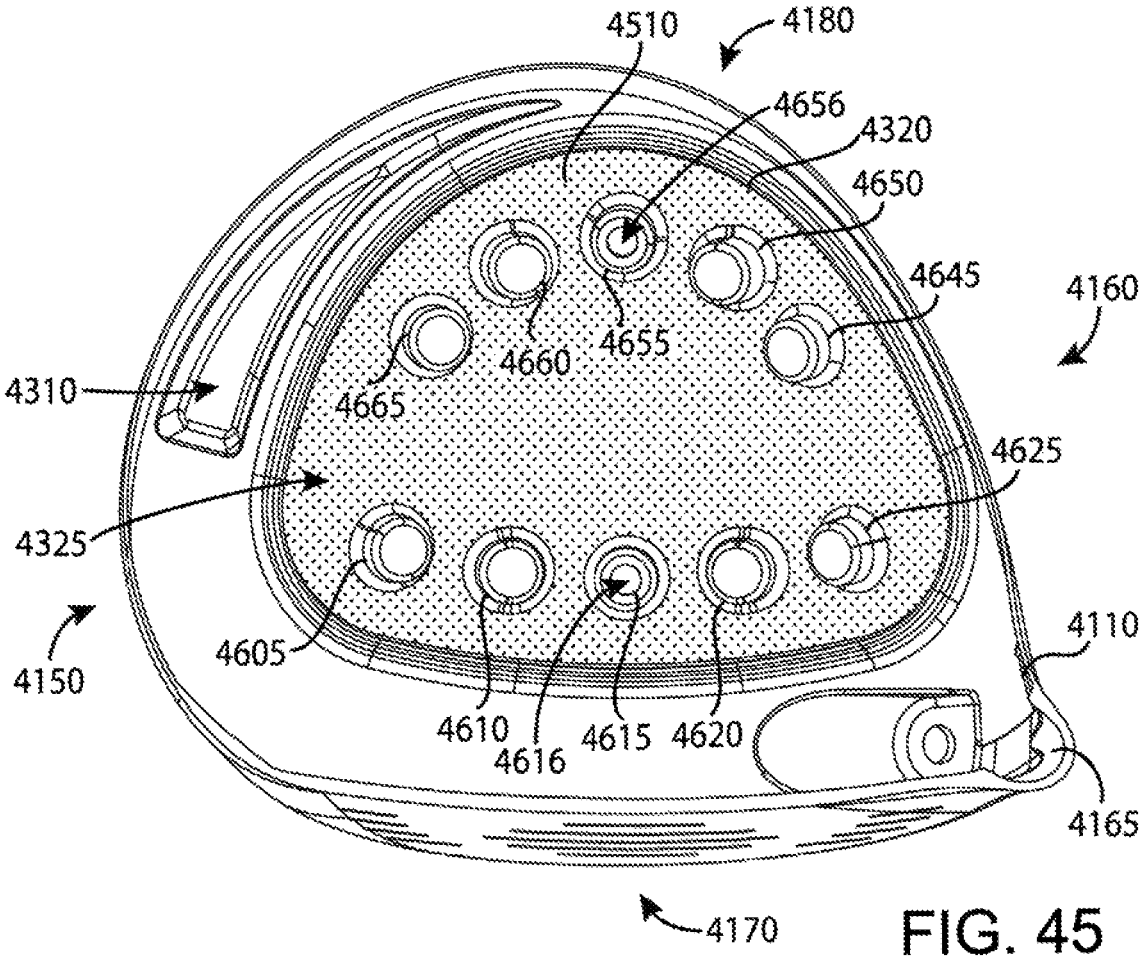
FIG. 45 depicts a top perspective cross-sectional view of an example of the golf club head of FIG. 41 taken at section line 44-44 of FIG. 43 according to an embodiment of the apparatus, methods, and articles of manufacture described herein.

In one example shown in FIG. 45, certain regions of the interior of the body portion 4110 of the golf club head 4100 may include an elastic polymer material or an elastomer material, which may be referred to herein as the filler material 4510. The filler material 4510 may dampen vibration, dampen noise, lower the center of gravity and/or provide a better feel and sound for the golf club head 4100 when striking a golf ball (not shown). According to one example, the inner port region 4325, which may be defined by the inner surface 4144 of the bottom portion 4140 and the inner support portion 4320, may partially or fully include the filler material 4510. The filler material 4510 may extend from the inner surface 4144 of the bottom portion 4140 up to the height of the inner support portion 4320. However, the filler material 4510 may extend below or above the inner support portion 4320. Accordingly, if the height of the inner support portion 4320 is greater than or equal to the depth of the ports 4600, the ports 4600 may be surrounded and/or covered by the filler material 4510, respectively, which may provide vibration dampening, noise dampening, and/or a better feel and sound for the golf club head 4100 when striking a golf ball (not shown). The apparatus, methods, and articles of manufacture described herein are not limited in this regard.

The height or thickness of the filler material 4510 in the inner port region 4325 may be constant or may vary. In one example, the thickness of the filler material 4510 may be greater around a center portion of the inner port region 4325 than at one or more perimeter portions of the inner port region 4325. In another example, the thickness of the filler material 4510 may be less around a center portion of the inner port region 4325 than at one or more perimeter portions of the inner port region 4325. In yet another example, the thickness of the filler material 4510 may be greater at or around the ports 4600 than at other locations of the inner port region 4325. In one example, the entire inner port region 4325 may be filled with a filler material 4510. In another example, only portions of the inner port region 4325 may be filled with a filler material 4510. Accordingly, some of the ports 4600 may not be partially or fully surrounded and/or covered with the filler material 4510. The apparatus, methods, and articles of manufacture described herein are not limited in this regard.

Any of the golf club heads described herein, including the golf club head 4100, may have one or more interior regions that may include a filler material as described herein. In one example, the filler material 4510 may be injected into the inner port region 4325 of the body portion 4110 from one or more of the ports 4600. In the example of FIGS. 41-47, each of the ports 4615 and 4655 may include an opening 4616 and 4656, respectively, into the inner port region 4325 or the interior of the body portion 4110. Accordingly, the openings 4616 and 4656 may be used to inject the filler material 4510 into the inner port region 4325. In one example, one of the openings 4616 or 4656 may be used to inject filler material into inner port region 4325, while the other opening 4656 or 4616, respectively, may be used for the air that is displaced by the filler material injected into the body portion 4110 to escape. The inner support portion 4320 may provide a boundary or a holding perimeter for the filler material 4510 when the filler material 4510 is injected into the body portion 4110. The filler material 4510 may be injected into the inner port region 4325 until the height of the filler material 4510 is similar, substantially similar, or greater than to the height of the inner support portion 4320. Accordingly, the filler material may be molded to the shape of the inner port region 4325. Alternatively, the inner port region 4325 may be partially filled with the filler material 4510. The apparatus, methods, and articles of manufacture described herein are not limited in this regard.

Figure 46:
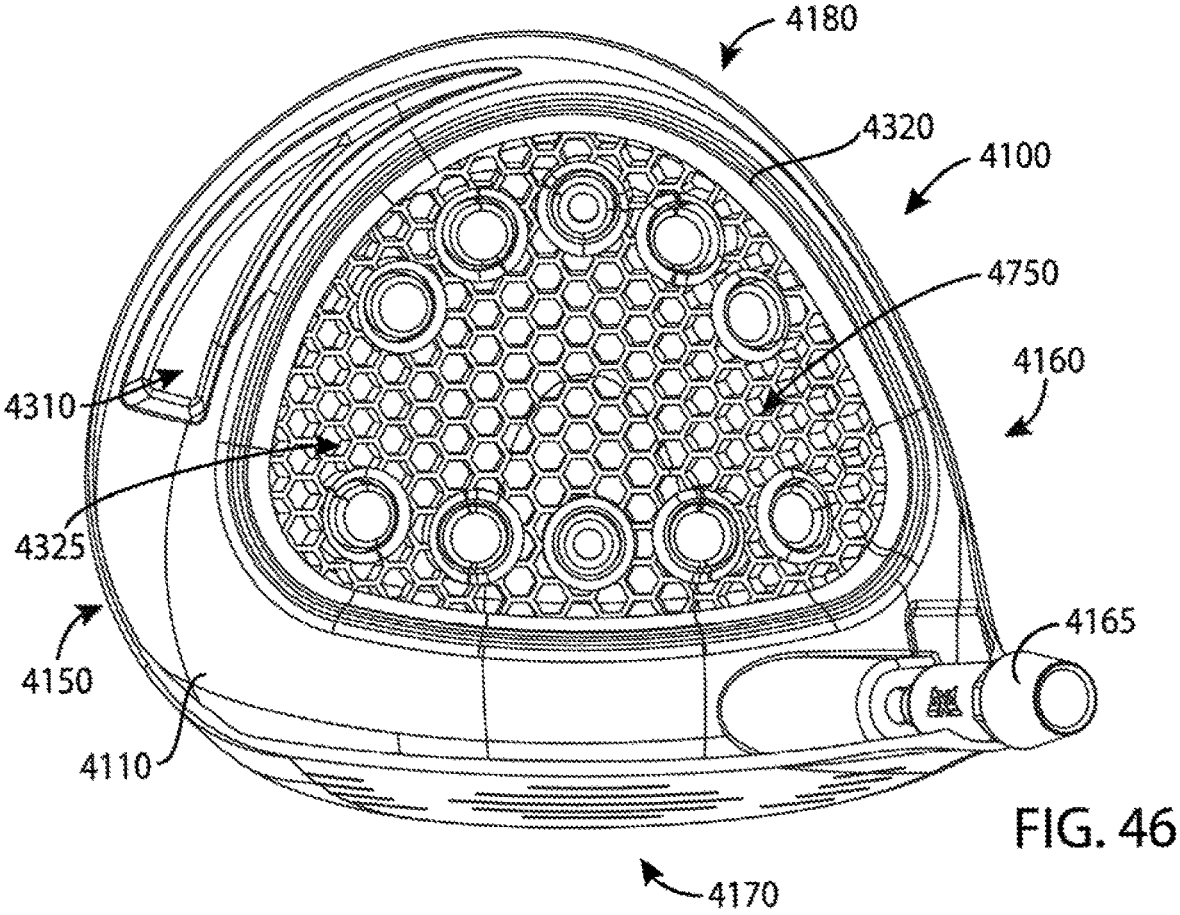
FIG. 46 depicts a top perspective cross-sectional view an example of the golf club head of FIG. 41 taken at section line 44-44 of FIG. 43 according to an embodiment of the apparatus, methods, and articles of manufacture described herein.

Alternatively, one or more inserts may be formed from an elastic polymer material or an elastomer material (e.g., filler material) and placed in one or more regions of the interior of golf club head. FIG. 46 shows an example of the golf club head 4100 of FIG. 41 with an insert 4750, which may be constructed from an elastic polymer material or an elastomer material. The insert 4750 may be manufactured to have a similar shape as the shape of the inner port region 4325. Accordingly, the insert 4750 may have a curvature similar to the curvature of the bottom portion 4140 at the inner port region 4325 to lay generally flat and in contact with the inner surface 4144 of the bottom portion 4140. The insert 4750 may have a shape that may be similar to the shape of the inner port region 4325 to be inserted in the inner port region 4325 and generally fit within the inner port region 4325. Further, the insert 4750 may be surrounded and/or in contact with the inner support portion 4320. The inner support portion 4320 may engage all or portions of the perimeter of the insert 4750 to assist in maintaining the insert in the inner port region 4325 or maintain the insert in the inner port region 4325. The insert 4750 may have a plurality of cutout portions 4756 to generally match the shape and/or contour of the sidewall portions of each of the ports 4600. Accordingly, when the insert 4750 is placed in the inner port region 4325, each port of the plurality of ports 4600 is received in a corresponding cutout portion 4756. The apparatus, methods, and articles of manufacture described herein are not limited in this regard.

The insert 4750 may have a thickness that may be similar or substantially similar to the height of any of the ports 4600. Accordingly, when the insert 4750 is in the inner port region 4325, the top portion of the insert 4750 at or proximate to the ports 4600 may be at the same or substantially the same height as the ports 4600. However, the thickness of the insert 4750 may vary such that the thickness of the insert 4750 at any location of the insert 4750 may be more or less than the height of any of the ports 4600. The insert 4750 may dampen vibration, dampen noise, lower the center of gravity and/or provide a better feel and sound for the golf club head 4100 when striking a golf ball (not shown). The apparatus, methods, and articles of manufacture described herein are not limited in this regard.

Figure 47:
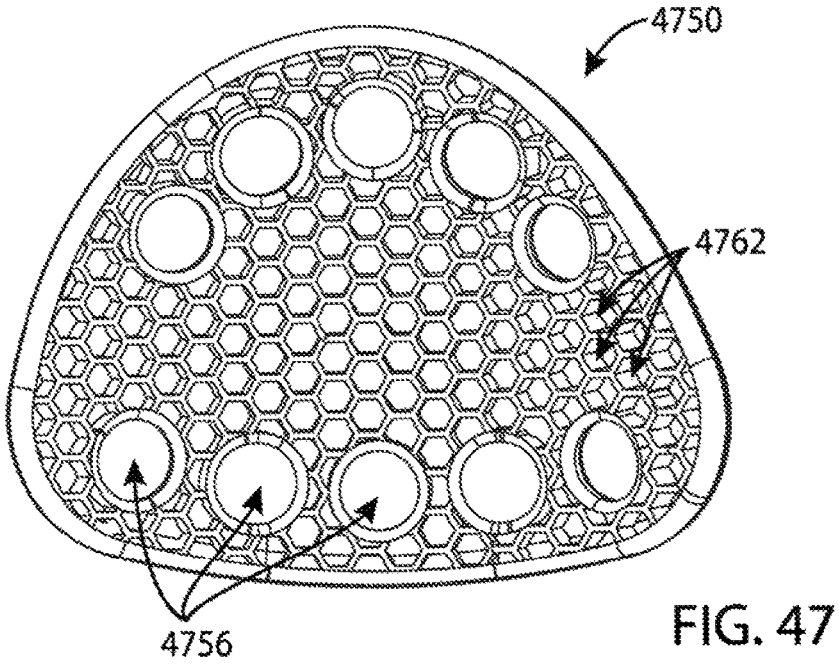
FIG. 47 depicts a perspective view of a polymer insert according to an embodiment of the apparatus, methods, and articles of manufacture described herein.
Figure 48:
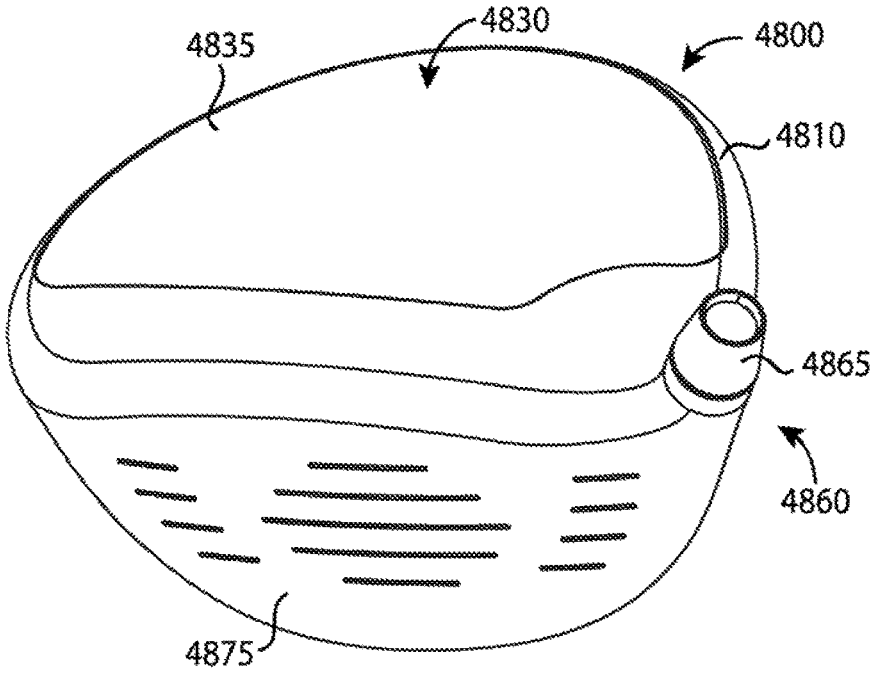
FIG. 48 is top perspective view of an example golf club head according to an embodiment of the apparatus, methods, and articles of manufacture described herein.
Figure 49:
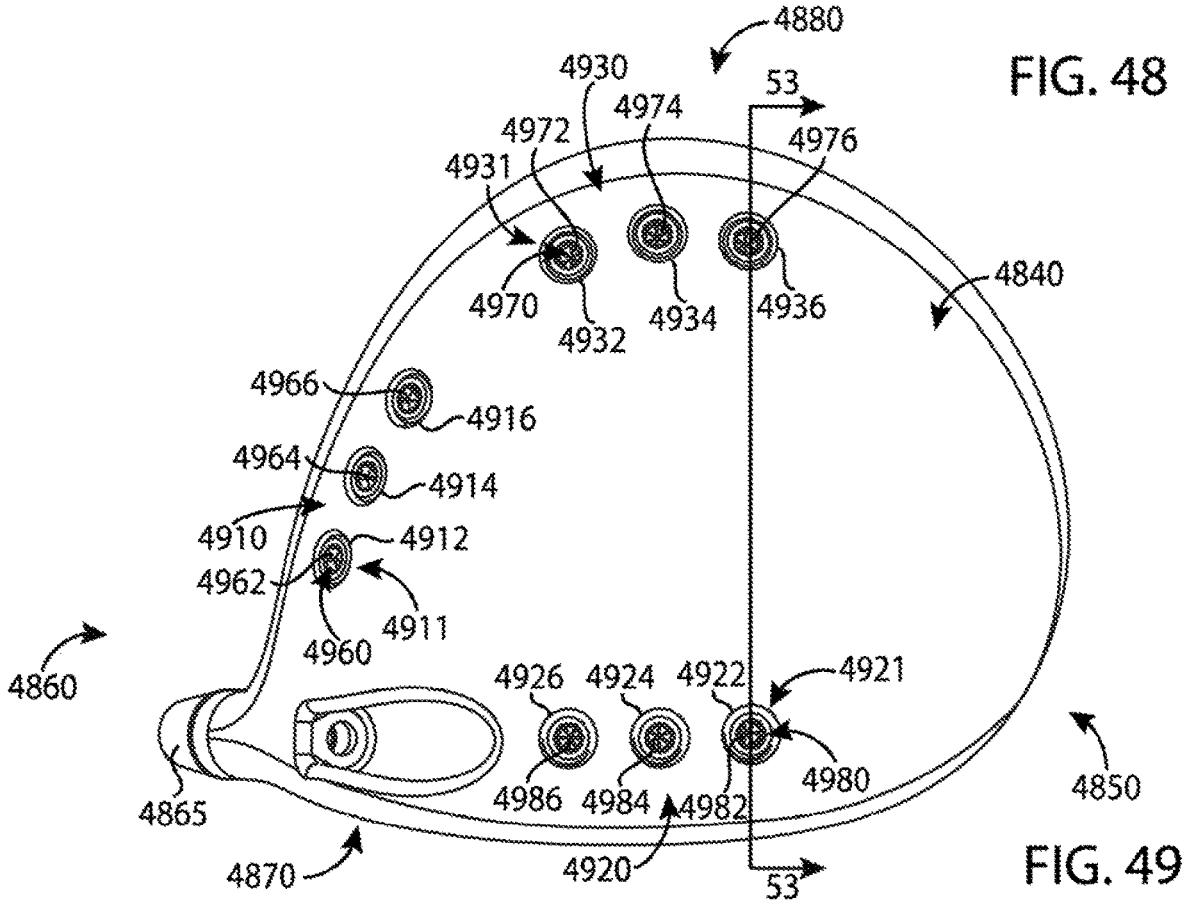
FIG. 49 depicts a bottom view of the example golf club head of FIG. 48.
Figure 50:
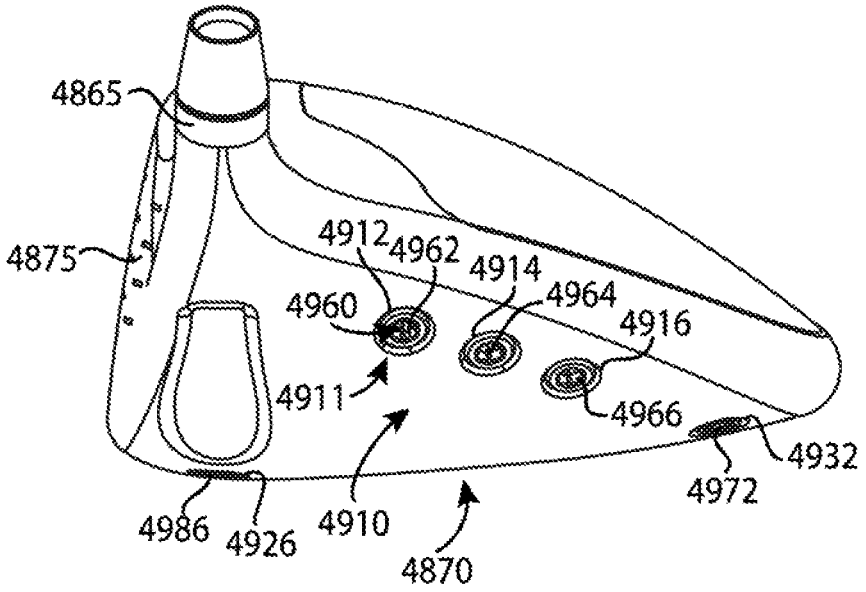
FIG. 50 depicts a toe view of the example golf club head of FIG. 48.
Figure 51:
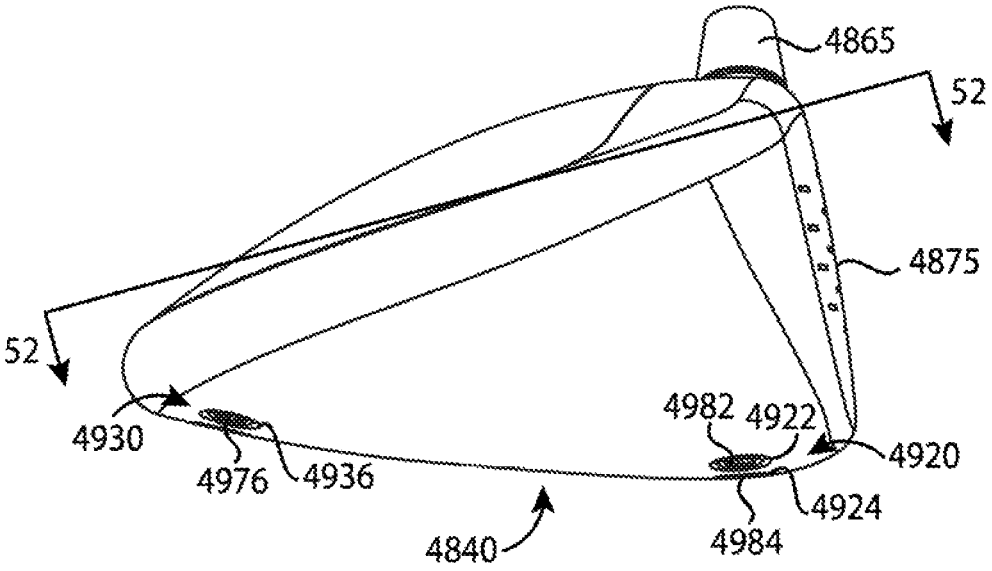
FIG. 51 depicts a heel view of the example golf club head of FIG. 48.

Any of the inserts described herein may be manufactured from an elastic polymer material as a one-piece continuous part. The insert 4750 may be a one-piece continuous part without any recesses and/or holes. According to the example shown in FIG. 47, the insert 4750 may include a plurality of holes 4762 that may reduce the weight of the insert 4750. The insert 4750 may include any number of holes 4762 arranged in any configuration on the insert 4750. In the example of FIG. 47, the insert 4750 includes a plurality of hexagonal holes 4762 that extend through the thickness of the insert 4750 and are arranged on the insert 4750 to define a pattern that is similar to a honeycomb pattern. The holes 4762 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 4750. In one example, the insert 4750 may include a plurality of round holes (not shown). In another example, the insert 4750 may include a plurality of slots, grooves and/or slits (not shown). In yet another example, the insert 4750 may include recesses (not shown) instead of holes that do not extend through the insert 4750. The apparatus, methods, and articles of manufacture described herein are not limited in this regard.

The filler material 4510 and or the insert 4750 may be manufactured from any of the materials described herein. The filler material 4510 or the insert 4750 may be bonded, attached and/or connected to the body portion 4110 of the golf club head 4100 by a bonding portion (not shown) to improve adhesion and/or mitigate delamination between the body portion 4110 and the filler material 4510 or the insert 4750. Further, as described herein, the inner support portion 4320 may engage the insert 4750 to partially or fully maintain the insert 4750 in the inner port region 4325. In one example, the insert 4750 may be maintained in the inner port region 4325 by frictionally engaging the inner support portion 4320 and/or a bonding portion bonding the insert 4750 to the inner support portion 4320 and/or the inner surface 4144 of the bottom portion 4140. The bonding portion may be any of the bonding portions described herein such as a bonding agent, an epoxy, a combination of bonding agents, a bonding structure or attachment device, a combination of bonding structures and/or attachment devices, and/or a combination of one or more bonding agents, one or more bonding structures and/or one or more attachment devices. The apparatus, methods, and articles of manufacture described herein are not limited in this regard.

In the example of FIGS. 48-55, a golf club head 4800 may include a body portion 4810 with a top portion 4830 having a crown portion 4835, a bottom portion 4840, a toe portion 4850, a heel portion 4860, a front portion 4870, and a rear portion 4880. The bottom portion 4840 may include a skirt portion (not shown) defined as a side portion of the golf club head 4800 between the top portion 4830 and the bottom portion 4840 excluding the front portion 4870 and extending across a periphery of the golf club head 4800 from the toe portion 4850, around the rear portion 4880, and to the heel portion 4860. The front portion 4870 may include a face portion 4875 to engage a golf ball (not shown). The body portion 4810 may also include a hosel portion 4865 that may be similar in many respects to any of the hosel portions described herein. Alternatively, the body portion 4810 may include a bore instead of the hosel portion 4865. The body portion 4810 may be made partially or entirely from any of the materials described herein. Further, the golf club head 4800 may be any type of golf club head having a club head volume similar to the club head volume of any of the golf club heads described herein. The apparatus, methods, and articles of manufacture described herein are not limited in this regard.

The crown portion 4835 may be a separate piece that may be attached to the top portion 4830. The crown portion 4835 may be constructed from one or more different materials than the body portion 4810. In one example (not shown), the crown portion 4835 may be at least partially constructed from a composite material such as a graphite-based composite material. In another example (not shown), the crown portion 4835 may include two outer layers constructed from a composite material, such as a graphite epoxy composite material, and an inner layer constructed from an elastic polymer material. The apparatus, methods, and articles of manufacture described herein are not limited in this regard.

The bottom portion 4840 may include a plurality of port regions, which are shown for example as a first port region 4910, a second port region 4920 and a third port region 4930. The first port region 4910 may be near the heel portion 4860 or be closer to the heel portion 4860 than the toe portion 4850 and include a first set of ports 4911 (generally shown as ports 4912, 4914 and 4916). The second port region 4920 may be near the front portion 4870 or be closer to the front portion 4870 than the rear portion 4880 and include a second set of ports 4921 (generally shown as ports 4922, 4924 and 4926). The third port region 4930 may be near the rear portion 4880 or be closer to the rear portion 4880 than the front portion 4870 and include a third set of ports 4931 (generally shown as ports 4932, 4934 and 4936). The bottom portion may include more than three port regions or less than three port regions with each port region including any number of ports. The body portion 4810 may include a plurality of mass portions, shown as a first set of mass portions 4960 (generally shown as mass portions 4962, 4964, and 4966), a second set of mass portions 4970 (generally shown as mass portions 4972, 4974, and 4976), and a third set of mass portions 4980 (generally shown as mass portions 4982, 4984 and 4986). Each port may receive a mass portion similar to any of the golf club heads described herein. In one example, one or more ports may not include mass portions. The characteristics (e.g., density, shape, volume, size, color, dimensions, depth, diameter, materials of construction, mass, method of formation, etc.) and/or any other properties of each mass portion of the plurality of mass portions and each port of the plurality of ports may be similar in many respects to each mass portion and port, respectively, of any of the golf club heads described herein. In one example, the ports and the mass portions of the golf club head of FIGS. 48-55 may have greater dimensions (i.e., length, width, diameter, depth, etc.) than any of the ports and/or mass portions, respectively, described herein. The apparatus, methods, and articles of manufacture described herein are not limited in this regard.

The mass portions of the first set of mass portions 4960, the second set of mass portions 4970 and/or the third set of mass portions 4980 may have similar or different masses. In one example, the overall mass of the first set of mass portions 4960 may be greater than the overall mass of the second set of mass portions 4970 and/or the third set of mass portions 4980. In another example, the overall mass of the second set of mass portions 4970 may be greater than the overall mass of the first set of mass portions 4960 and/or the third set of mass portions 4980. In yet another example, the overall mass of the third set of mass portions 4980 may be greater than the overall mass of the second set of mass portions 4970 and/or the first set of mass portions 4960. The masses of the mass portions in each of the first set of mass portion 4960, the second set of mass portions 4970 and/or the third set of mass portions 4980 may be similar or different. Accordingly, by using mass portions having similar or different masses in each of the port regions 4910, 4920 and/or 4930, the overall mass in each port region and/or the mass distribution in each port region may be adjusted to generally optimize and/or adjust the swing weight, center of gravity, moment of inertia, and/or an overall feel of the golf club head for an individual using the golf club head 4800. The apparatus, methods, and articles of manufacture described herein are not limited in this regard.

The outer surface 4842 and/or the inner surface 4844 of the bottom portion 4840 may include one or more inner support portions (not shown) and/or one or more outer support portion (not shown) similar to any of the inner support portions and the outer support portions described herein. The apparatus, methods, and articles of manufacture described herein are not limited in this regard.

Certain regions of the interior of the body portion 4810 may include an elastic polymer material or an elastomer material similar to any of the golf club heads described herein. The filler material may dampen vibration, dampen noise, lower the center of gravity and/or provide a better feel and sound for the golf club head 4800 when striking a golf ball (not shown). The golf club head 4800, may have one or more interior regions that may include a filler material as described herein. In one example, the filler material may be injected into the body portion 4810 from one or more of the ports as described herein. In the example of FIGS. 48-55, each of the ports 4924 and 4934 may include an opening 4925 and 4935, respectively, into the interior of the body portion 4810. Accordingly, the openings 4925 and/or 4935 may be used to inject the filler material into the body portion 4810. In one example, one of the openings 4925 or 4935 may be used to inject filler material into the body portion 4810, while the other opening 4935 or 4925, respectively, may be used for the air that is displaced by the filler material injected into the body portion 4810 to escape. The body portion may include one or more inner support portions (not shown) similar to any of the inner support portions described herein that may provide a boundary or a holding perimeter for the filler material when the filler material is injected into the body portion 4810. The filler material may be injected into the body portion 4810 until the height of the filler material is similar, substantially similar, or greater than to the height of one or of the ports of the first set of ports 4911, second set of ports 4921 and/or third set of ports 4931. Accordingly, the filler material may be molded to the shape of one or more portions of the bottom portion 4840 or the entire bottom portion 4840. The apparatus, methods, and articles of manufacture described herein are not limited in this regard.

Figure 55:
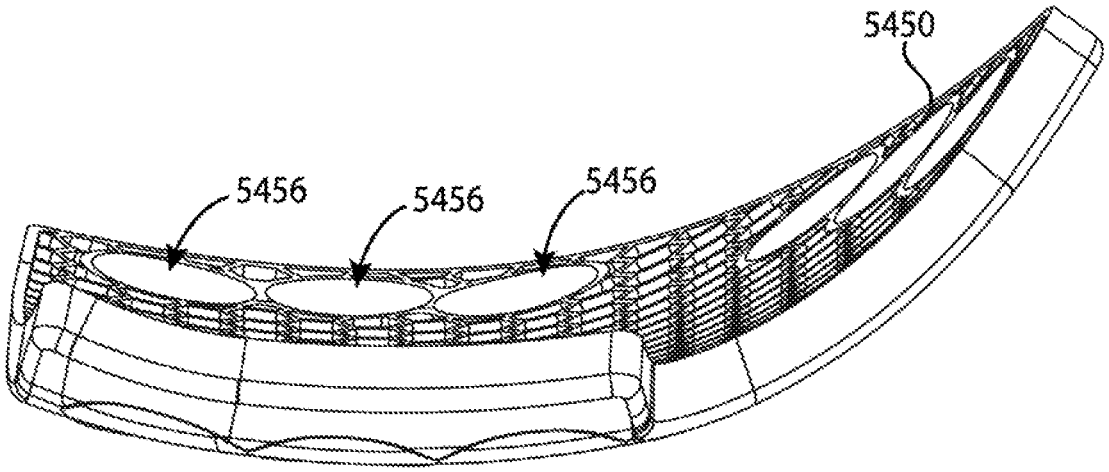
FIG. 55 depicts a side perspective view of the polymer insert of FIG. 54.

Alternatively, one or more inserts may be formed from an elastic polymer material or an elastomer material (e.g., filler material) and placed in one or more regions of the interior of golf club head 4800. FIGS. 52-55 show an example of the golf club head 4800 of FIG. 48 with an insert 5450, which may be constructed from an elastic polymer material or an elastomer material. The insert 5450 may be manufactured to have a similar shape as the shape of all or portions of the inner surface 4844 of the bottom portion 4840. Accordingly, as shown in FIG. 55, the insert 5450 may have a curvature similar to the curvature of the bottom portion 4840 so as to lay generally flat and in contact with the inner surface 4844 of the bottom portion 4840. The insert 5450 may be partially and/or fully surrounded and/or in contact with any inner support portions (not shown) on the inner surface 4844 of the body portion 4810. The insert 5450 may have a plurality of cutout portions 5456 to generally match the shape and/or contour of the sidewall portions of each of the ports of the first set of ports 4911, second set of ports 4921 and/or third set of ports 4931. Accordingly, when the insert 5450 is placed on the inner surface 4844 of the bottom portion 4840, each port of the plurality of ports is received in a corresponding cutout portion 5456. Each port extending through a corresponding cutout portion 5456 may assist in maintaining the position of the insert 5450 on the inner surface 4844 of the bottom portion 4840. The apparatus, methods, and articles of manufacture described herein are not limited in this regard.

Figure 52:
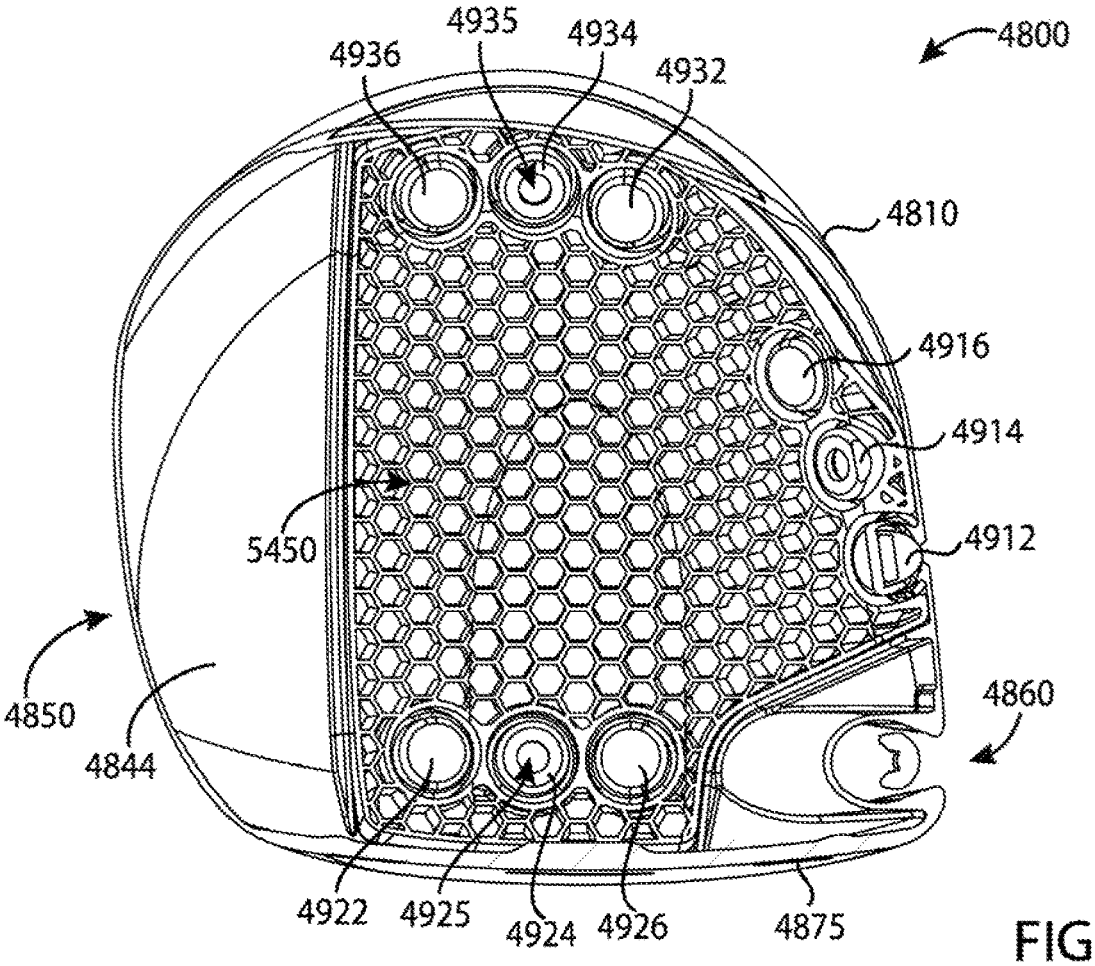
FIG. 52 depicts a top perspective cross-sectional view of the golf club head of FIG. 48 taken at section line 52-52 of FIG. 51.
Figure 53:
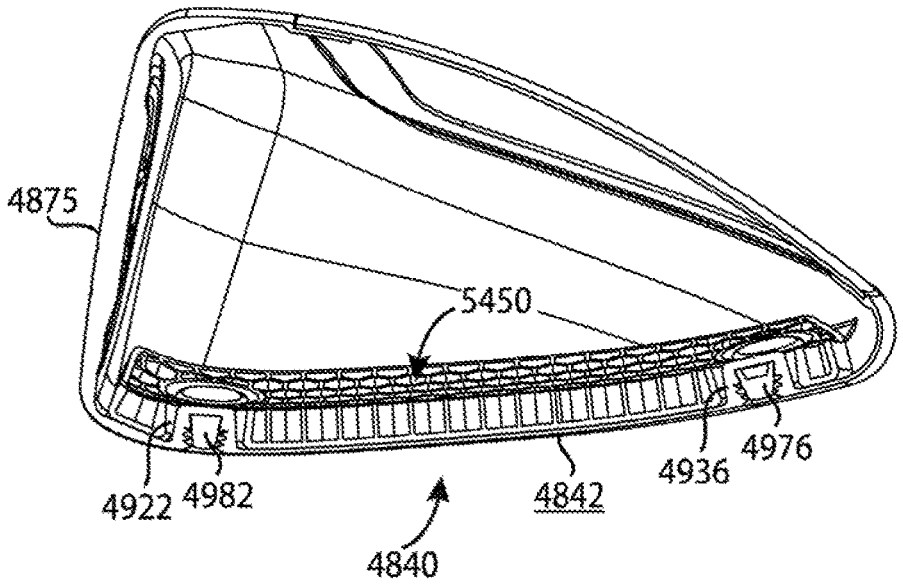
FIG. 53 depicts a top perspective cross-sectional view of the golf club head of FIG. 48 taken at section line 53-53 of FIG. 49.
Figure 54:
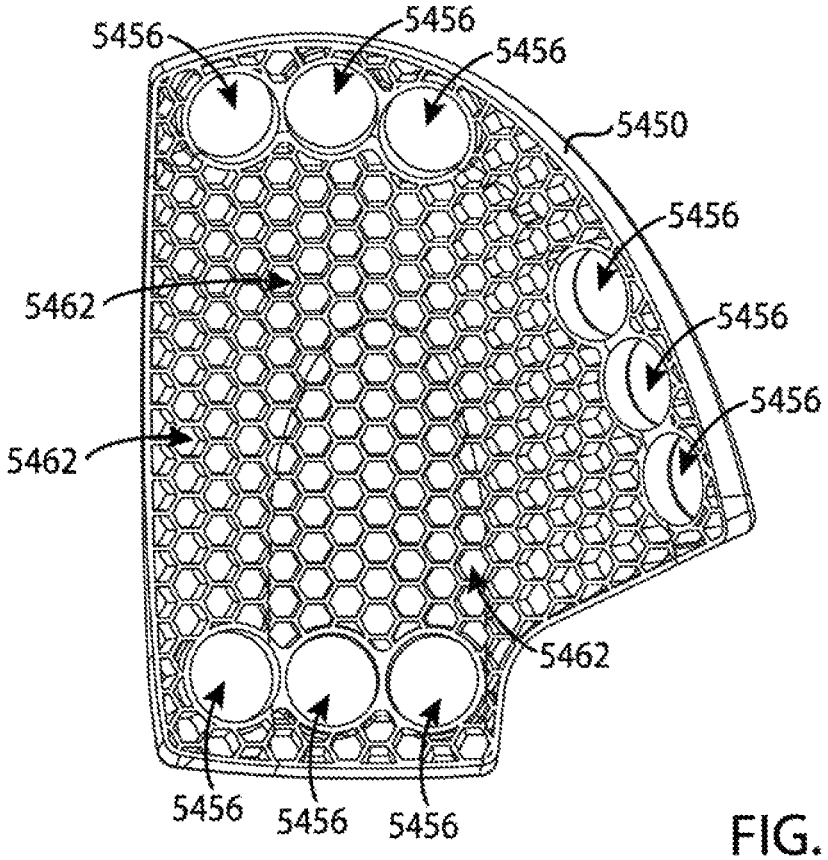
FIG. 54 depicts a top perspective view of an polymer insert according to an embodiment of the apparatus, methods, and articles of manufacture described herein.

The insert 5450 may partially cover and/or fully cover the inner surface 4844 of the bottom portion 4840. In the example of FIGS. 52-55, the insert 5450 extends from the front portion 4870 to the rear portion 4880 and from a location at or near the heel portion 4860 to a location on the inner surface 4844 of the bottom portion 4840 near the toe portion 4850. In one example, the insert 5450 may not extend to the toe portion 5640. In another example (not shown), the insert 5450 may extend to the toe portion 4850. The insert 5450 may cover any portion of the inner surface 4844 of the bottom portion 4840 so that the insert 5450 surrounds and/or contacts all of the ports that may be on the bottom portion 4840. For example, as shown in FIG. 52, the insert 5450 extends from the heel portion 4860 until past the ports 4922 and 4936 to surround and/or contact all of the ports of the first set of ports 4911, second set of ports 4921 and/or third set of ports 4931. Accordingly, the insert 5450 may dampen vibration and/or dampen noise at or around each of the ports of the first set of ports 4911, second set of ports 4921 and/or third set of ports 4931 to provide a better feel and sound for the golf club head 4800 when striking a golf ball (not shown). The apparatus, methods, and articles of manufacture described herein are not limited in this regard.

The insert 5450 may have a thickness that may be similar or substantially similar to the height of any of the ports of the first set of ports 4911, second set of ports 4921 and/or third set of ports 4931. Accordingly, when the insert 5450 is in contact with the inner surface 4844 of the bottom portion 4840, the top portion of the insert 5450 at or proximate to the ports of the first set of ports 4911, second set of ports 4921 and/or third set of ports 4931 may be at the same or substantially the same height as the ports of the first set of ports 4911, second set of ports 4921 and/or third set of ports 4931. However, the thickness of the insert 5450 may vary such that the thickness of the insert 5450 at any location of the insert 5450 may be more or less than the height of any of the ports of the first set of ports 4911, second set of ports 4921 and/or third set of ports 4931. The insert 5450 may dampen vibration, dampen noise, lower the center of gravity and/or provide a better feel and sound for the golf club head 4800 when striking a golf ball (not shown). The apparatus, methods, and articles of manufacture described herein are not limited in this regard.

Any of the inserts described herein may be manufactured from an elastic polymer material as a one-piece continuous part. The insert 5450 may be a one-piece continuous part without any recesses and/or holes. According to the example shown in FIGS. 52-55, the insert 5450 may include a plurality of holes 5462 that may reduce the weight of the insert 5450. The insert 5450 may include any number of holes 5462 arranged in any configuration on the insert 5450. The insert 5450 includes a plurality of hexagonal holes 5462 that extend through the thickness of the insert 5450 and are arranged on the insert 5450 to define a pattern that is similar to a honeycomb pattern. The holes 5462 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 5450. In one example, the insert 5450 may include a plurality of round holes (not shown). In another example, the insert 5450 may include a plurality of slots, grooves and/or slits (not shown). In yet another example, the insert 5450 may include recesses (not shown) instead of holes that do not extend through the insert 5450. The apparatus, methods, and articles of manufacture described herein are not limited in this regard.

The filler material and or the insert 5450 may be manufactured from any of the materials described herein. The filler material or the insert 5450 may be bonded, attached and/or connected to the body portion 4810 of the golf club head 4800 by a bonding portion (not shown) to improve adhesion and/or mitigate delamination between the body portion 4810 and the filler material or the insert 5450. The bonding portion may be any of the bonding portions described herein such as a bonding agent, an epoxy, a combination of bonding agents, a bonding structure or attachment device, a combination of bonding structures and/or attachment devices, and/or a combination of one or more bonding agents, one or more bonding structures and/or one or more attachment devices. Further, one or more inner support portions (not shown) may engage the insert 5450 to partially or fully maintain the position of the insert 5450 similar to any of the golf club heads described herein. The apparatus, methods, and articles of manufacture described herein are not limited in this regard.

Figure 56:
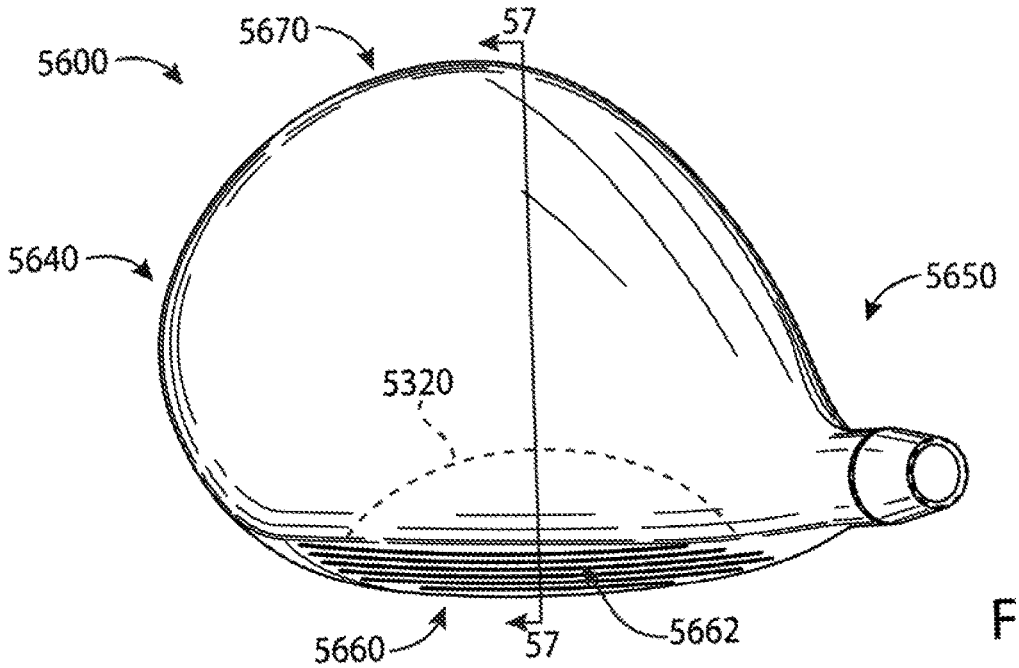
FIG. 56 depicts a top view of a golf club head according to another embodiment of the apparatus, methods, and articles of manufacture described herein.
Figure 57:
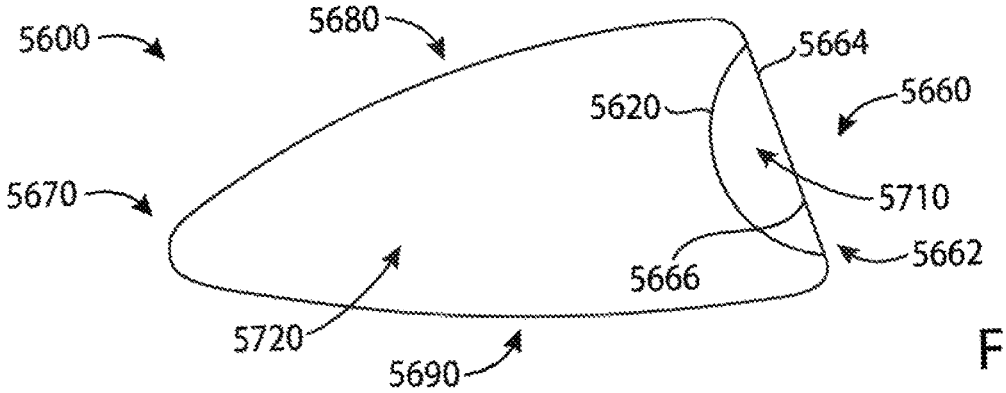
FIG. 57 depicts a schematic cross-sectional view of the example golf club head of FIG. 56 along line 57-57.
Figure 58:
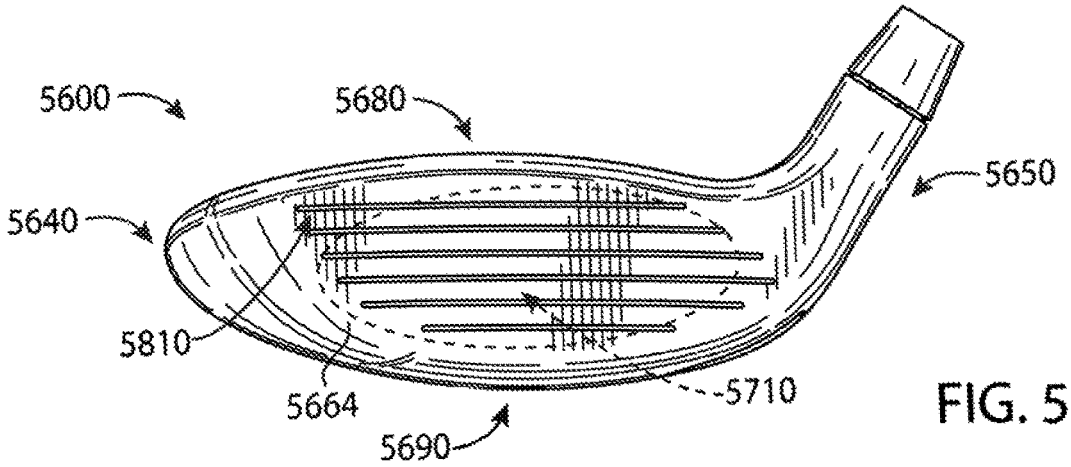
FIG. 58 depicts a front view of the example golf club head of FIG. 56.

While the above examples may describe a certain type of golf club head, the apparatus, methods, and articles of manufacture described herein may be applicable to other types of golf club heads. Referring to FIGS. 56-58, for example, a golf club head 5600 may include a body portion 5610 and a cavity wall portion 5620. The golf club head 5600 may have a club head volume greater than or equal to 300 cubic centimeters (cm3 or cc). In one example, the golf club head 5600 may be about 460 cc. Alternatively, the golf club head 5600 may have a club head volume less than or equal to 300 cc. For example, the golf club head 5600 may have a club head volume between 100 cc and 200 cc. The club head volume of the golf club head 5600 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIGS. 56-58 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 5610 may include a toe portion 5640, a heel portion 5650, a front portion 5660, a rear portion 5670, a top portion 5680 (e.g., a crown portion), and a bottom portion 5690 (e.g., a sole portion). The body portion 5610 may be a hollow body made partially or entirely of an aluminum-based material, a magnesium-type material, a steel-based material, a titanium-based material, any other suitable material, or any combination thereof. In another example, the body portion 5610 may be made partially or entirely of a non-metal material such as a ceramic material, a composite material, any other suitable material, or any combination thereof. The front portion 5660 may include a face portion 5662 (e.g., a strike face). The face portion 5662 may include a front surface 5664 and a back surface 5666. The front surface 5664 may include a plurality of grooves, generally shown as 5810 in FIG. 58.

The cavity wall portion 5620 may form a first interior cavity portion 5710 and a second interior cavity portion 5720 within the body portion 5610. For example, the cavity wall portion 5620 may be made partially or entirely of an aluminum-based material, a steel-based material, any other suitable material, or any combination thereof. In another example, the cavity wall portion 5620 may be made partially or entirely of a non-metal material such as a ceramic material, a composite material, any other suitable material, or any combination thereof. The first interior cavity portion 5710 may be associated with a first volume, and the second interior cavity portion 5720 may be associated with a second volume. In one example, the first volume may be less than the second volume. Further, the first volume may be less than or equal to 50% of the second volume.

As illustrated in FIG. 57, for example, the cavity wall portion 5620 may extend from the back surface 5666 of the face portion 5662. In one example, the cavity wall portion 5620 may extend no more than one inch from the back surface 5666. In another example, the cavity wall portion 5620 may extend no more than two inches from the back surface 5666. The cavity wall portion 5620 may be a single curved wall section. In particular, the cavity wall portion 5620 may have a convex arc profile relative to the back surface 5666 (e.g., C shape) to form a dome-like structure with an elliptical base (e.g., FIG. 58) or a circular base on the back surface 5666. In another example, the cavity wall portion 5620 may form a cone-like structure or a cylinder-like structure with the body portion 5610. Alternatively, the cavity wall portion 5620 may be a concave arc profile relative to the back surface 5666. The apparatus, methods, and articles of manufacture described herein are not limited in this regard.

The first interior cavity portion 5710 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, dampen noise, and/or provide structural support. The elastic polymer material may be injected into the first interior cavity portion 5710 via an injection molding process via a port on the face portion 5662. For example, at least 50% of the first interior cavity portion 5710 may be filled with a TPE material to absorb shock, isolate vibration, dampen noise, and/or provide structural support when the golf club head 5600 strikes a golf ball via the face portion 5662. With the support of the cavity wall portion 5620 to form the first interior cavity portion 5710 and filling at least a portion of the first interior cavity portion 5710 with an elastic polymer material, the face portion 5662 may be relatively thin without degrading the structural integrity, sound, and/or feel of the golf club head 5600. In one example, the face portion 5662 may have a thickness of less than or equal to 0.075 inch (e.g., a distance between the front surface 5664 and the back surface 5666). In another example, the face portion 5662 may have a thickness of less than or equal to 0.060 inch. In yet another example, the face portion 5662 may have a thickness of less than or equal to 0.050 inch. Further, the face portion 5662 may have a thickness of less than or equal to 0.030 inch. The apparatus, methods, and articles of manufacture described herein are not limited in this regard.

Figure 59:
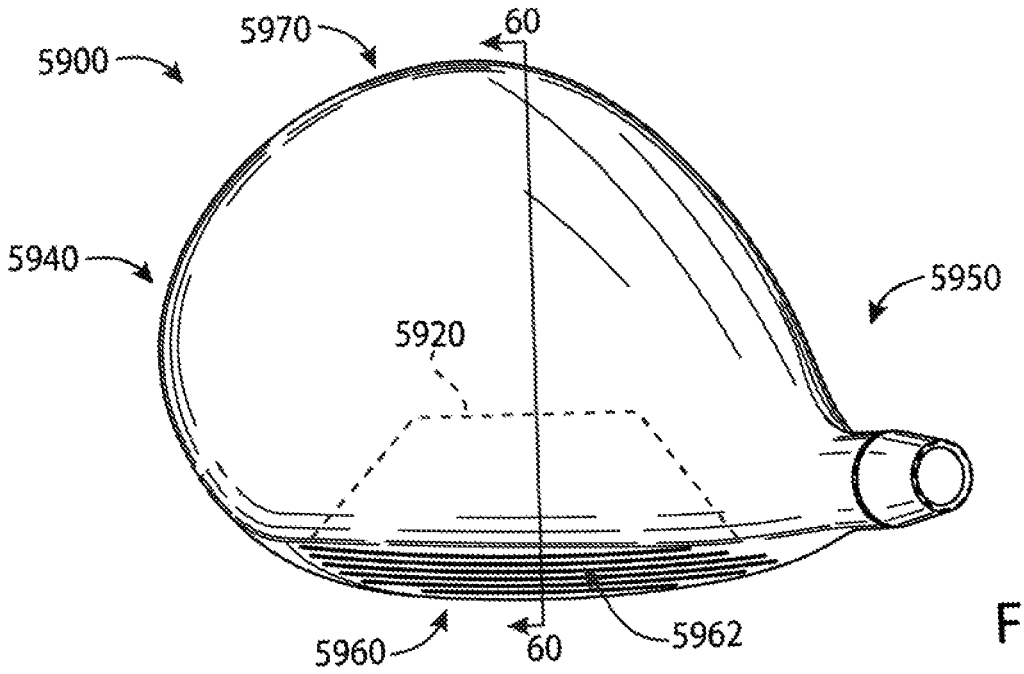
FIG. 59 depicts a top view of a golf club head according to yet another embodiment of the apparatus, methods, and articles of manufacture described herein.
Figure 60:
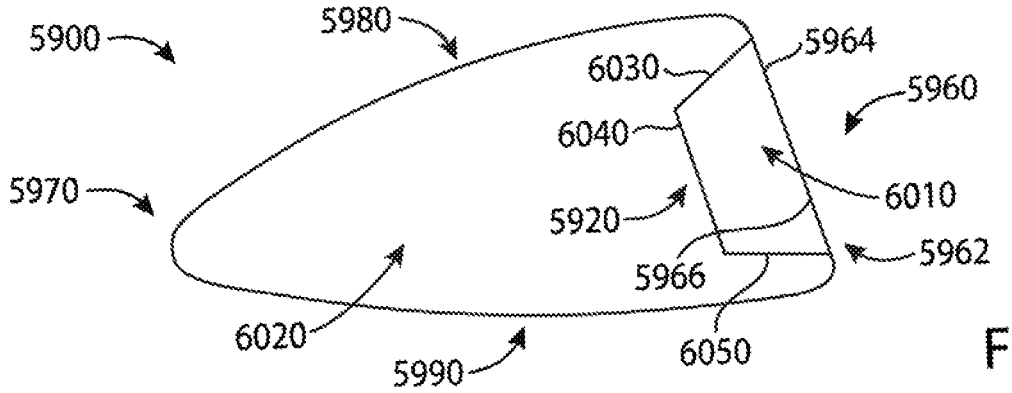
FIG. 60 depicts a schematic cross-sectional view of the example golf club head of FIG. 59 along line 60-60.
Figure 61:
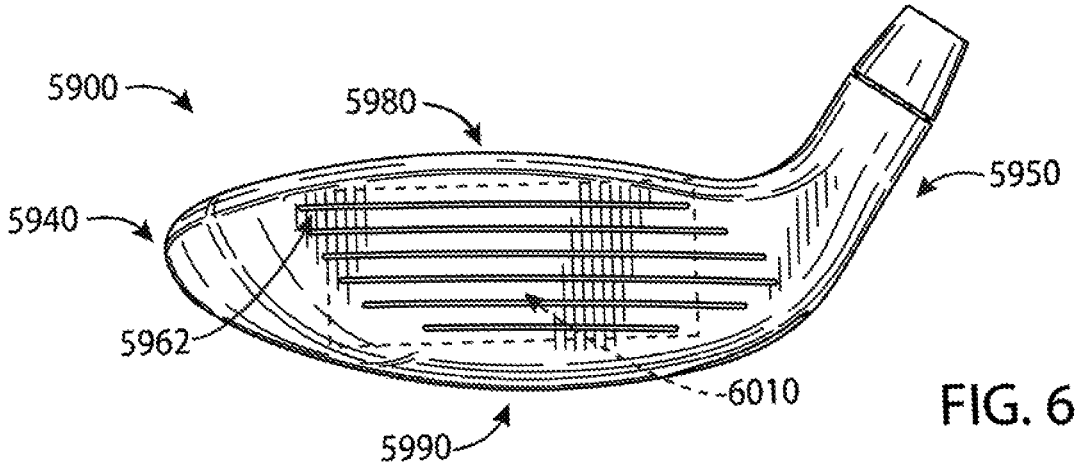
FIG. 61 depicts a front view of the example golf club head of FIG. 59.

The cavity wall portion 5620 may include multiple sections. Turning to FIGS. 59-61, for example, a golf club head 5900 may include a body portion 5910 and a cavity wall portion 5920. The body portion 5910 may include a toe portion 5940, a heel portion 5950, a front portion 5960, a rear portion 5970, a top portion 5980 (e.g., a crown portion), and a bottom portion 5990 (e.g., a sole portion). The front portion 5960 may include a face portion 5962 (e.g., a strike face) with a front surface 5964 and a back surface 5966. The cavity wall portion 5920 may extend from the back surface 5966 to form a first interior cavity portion 6010 and a second interior cavity portion 6020 within the body portion 5910. The cavity wall portion 5920 may include two or more wall sections, generally shown as 6030, 6040, and 6050 in FIG. 60. The cavity wall portion 5920 may form a truncated pyramid-like structure with a rectangular base (e.g., FIG. 61) or a square base on the back surface 5966. Alternatively, the cavity wall portion 5920 may form a cuboid-like structure (i.e., with a rectangular base) or a cuboid-like structure (i.e., with a square base) on the back surface 5966. In another example, the cavity wall portion 5920 may form a square-based, pyramid-like structure on the back surface 5966. In yet another example, the cavity wall portion 5920 may form a triangular-based, pyramid-like structure or a triangular prism-like structure on the back surface 5966. Similar to the first interior cavity portion 5710 (FIGS. 56-58), the first interior cavity portion 6010 may be partially or entirely filled with an elastic polymer or elastomer material (e.g., a TPE material, a TPU material, etc.). The elastic polymer material may be injected into the first interior cavity portion 6010 via an injection molding process via a port on the face portion 5962. The apparatus, methods, and articles of manufacture described herein are not limited in this regard.

Figure 62:
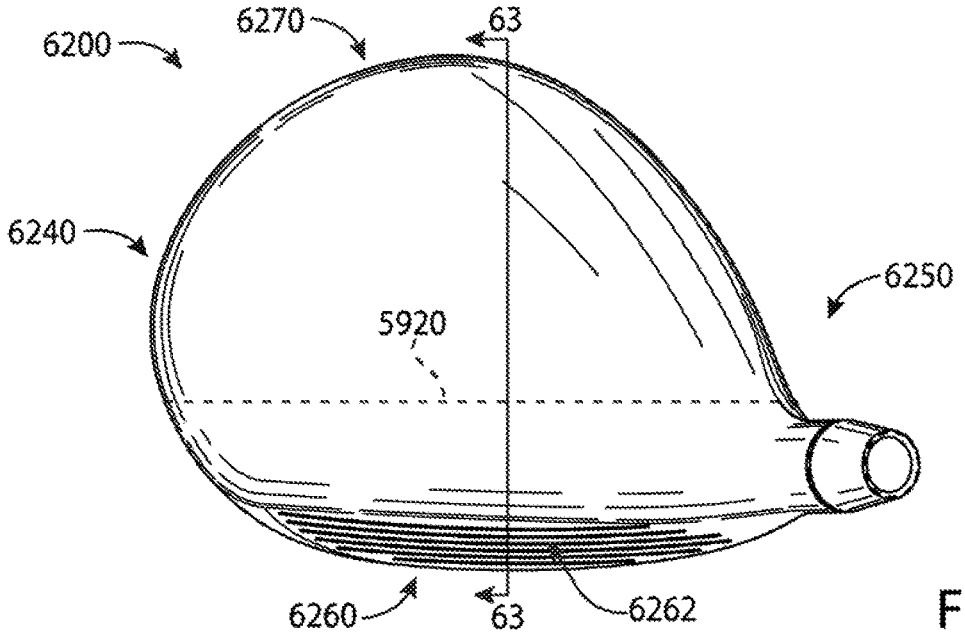
FIG. 62 depicts a top view of a golf club head according to yet another embodiment of the apparatus, methods, and articles of manufacture described herein.
Figure 63:
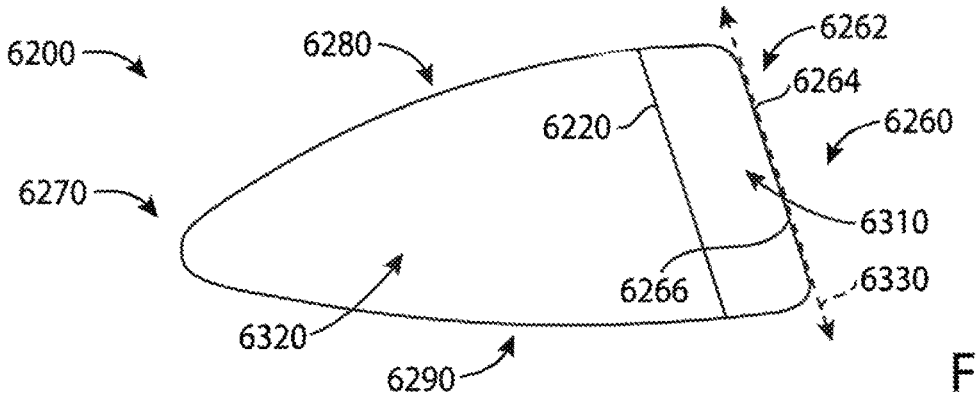
FIG. 63 depicts a schematic cross-sectional view of the example golf club head of FIG. 62 along line 63-63.

As illustrated in FIGS. 62 and 63, for example, a golf club head 6200 may include a body portion 6210 and a cavity wall portion 6220. The body portion 6210 may include a toe portion 6240, a heel portion 6250, a front portion 6260, a rear portion 6270, a top portion 6280 (e.g., a crown portion), and a bottom portion 6290 (e.g., a sole portion). The front portion 6260 may include a face portion 6262 (e.g., a strike face) with a front surface 6264 and a back surface 6266. The face portion 6262 may be associated with a loft plane 6305 that defines the loft angle of the golf club head 6200.

Figure 64:
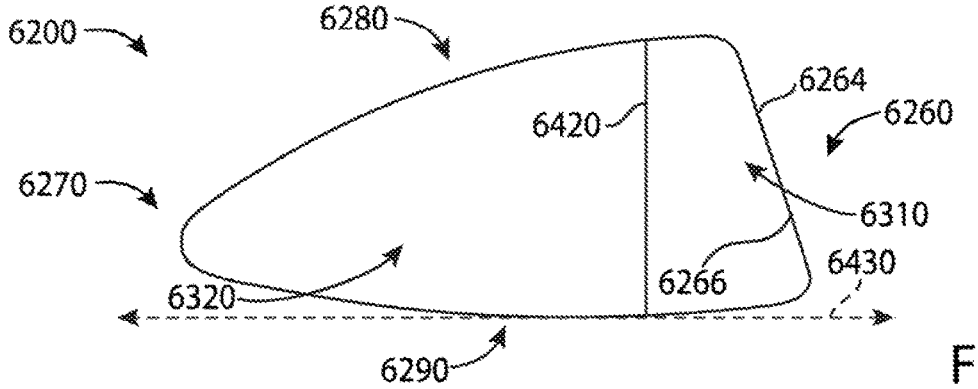
FIG. 64 depicts a schematic cross-sectional view of the example golf club head of FIG. 62 along line 63-63 according to another embodiment of the apparatus, methods, and articles of manufacture described herein.
Figure 65:
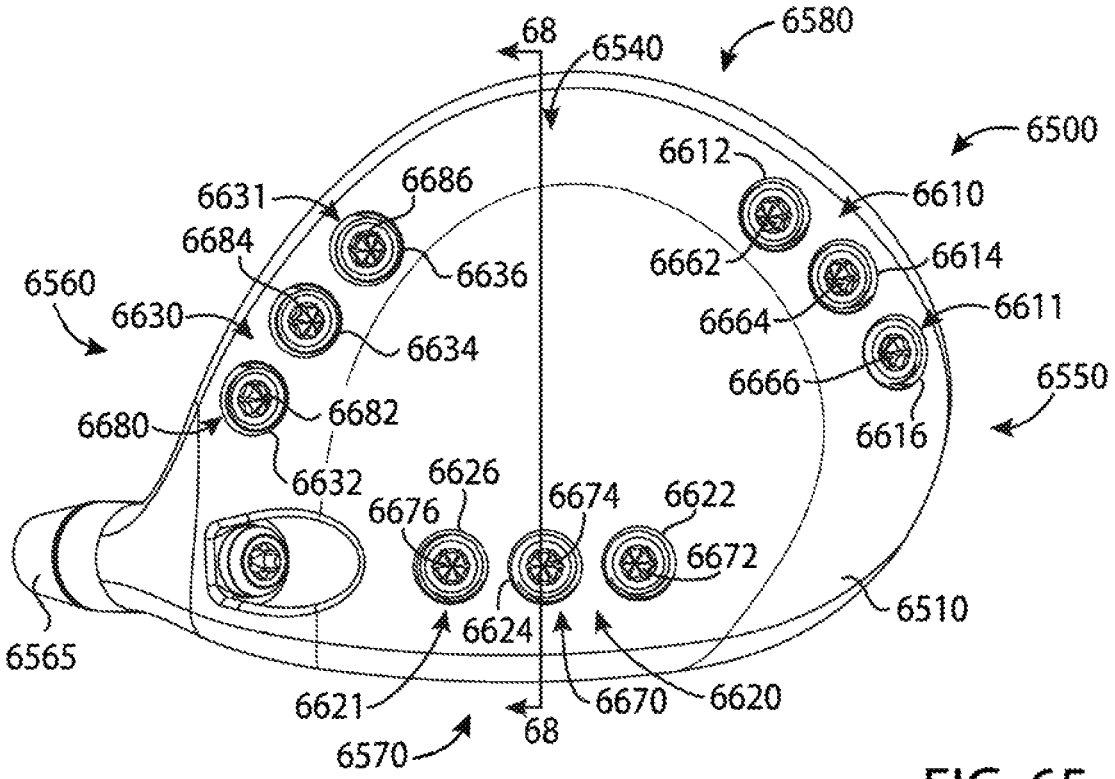
FIG. 65 depicts a bottom perspective view of a golf club head according to yet another embodiment of the apparatus, methods, and articles of manufacture described herein.
Figure 66:
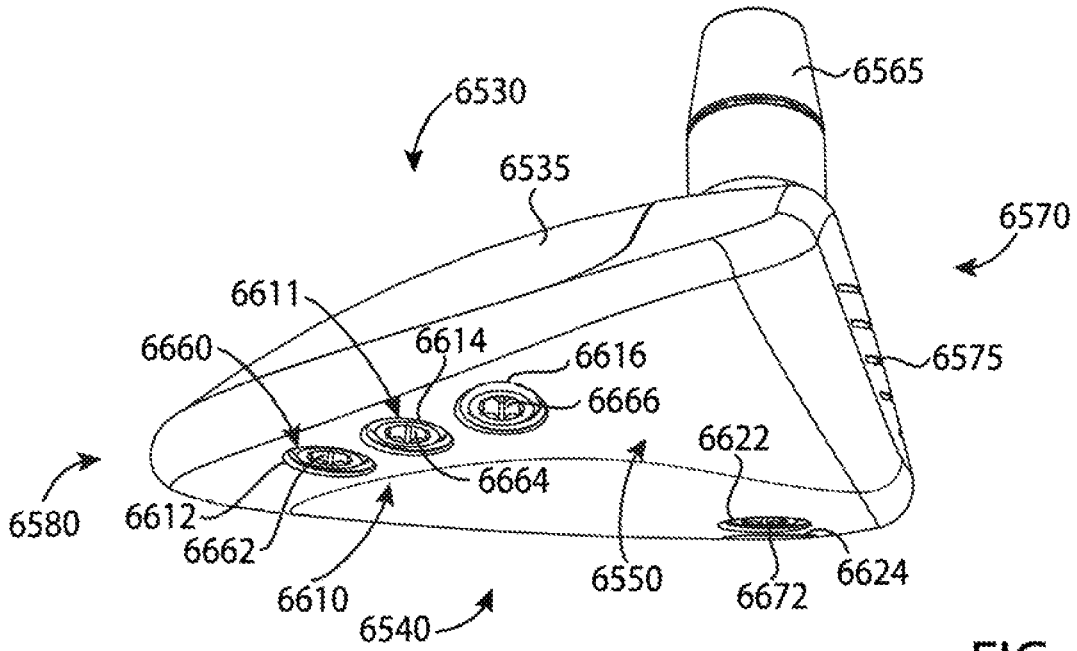
FIG. 66 depicts a toe-side perspective view of the golf club head of FIG. 65.
Figure 67:
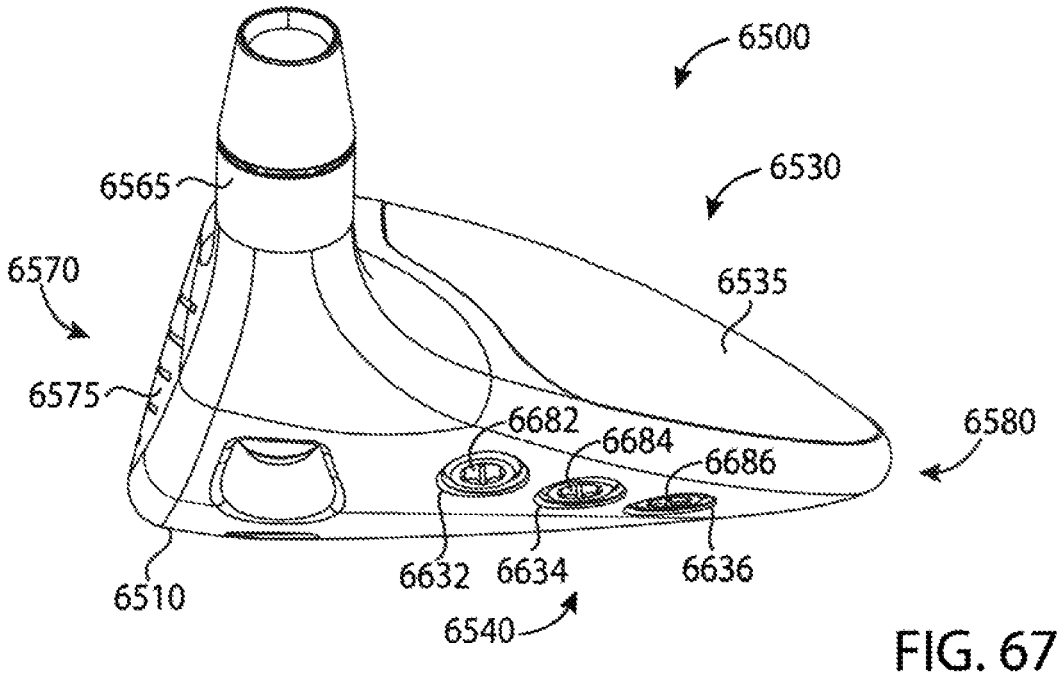
FIG. 67 depicts a heel-side perspective view of the golf club head of FIG. 65.

The cavity wall portion 6220 may be a single flat wall section. In particular, the cavity wall portion 6220 may extend between the toe portion 6240 and the heel portion 6250 and between the top portion 6280 and the bottom portion 6290 to form a first interior cavity portion 6310 and a second interior cavity portion 6320 within the body portion 6210. The cavity wall portion 6220 may be parallel or substantially parallel to the loft plane 6305. Alternatively, as shown in FIG. 64, a cavity wall portion 6420 may be perpendicular or substantially perpendicular to a ground plane 6430. Similar to the first interior cavities 5710 (FIGS. 56-58) and 6010 (FIGS. 59-61), the first interior cavity portion 6310 may be partially or entirely filled with an elastic polymer or elastomer material. The elastic polymer material may be injected into the first interior cavity portion 6310 via an injection molding process via a port on the face portion 6262 and/or the bottom portion 6290. The apparatus, methods, and articles of manufacture described herein are not limited in this regard.

Alternatively, the cavity wall portion 6220 may extend between the bottom portion 6290 and a top-and-front transition region (i.e., a transition region between the top portion 6280 and the front portion 6260) so that the cavity wall portion 6220 and the loft plane 6330 may not be parallel to each other. In another example, the cavity wall portion 6220 may extend between the top portion 6280 and a bottom-and-front transition region (i.e., a transition region between the bottom portion 6290 and the front portion 6260) so that the cavity wall portion 6220 and the loft plane 6330 may be not parallel to each other. Although FIGS. 62-64, may depict the cavity wall portions 6220 and 6420 being flat or substantially flat, the cavity wall portions 6220 and/or 6420 may be concaved or convexed relatively to the face portion 6262. The apparatus, methods, and articles of manufacture described herein are not limited in this regard.

While above examples may describe a cavity wall portion dividing an interior cavity of a hollow body portion to form two separate interior cavities with one interior cavity partially or entirely filled with an elastic polymer material, the apparatus, methods, and articles of manufacture described herein may include two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

In the example of FIGS. 65-68, a golf club head 6500 may include a body portion 6510 with a top portion 6530 having a crown portion 6535, a bottom portion 6540, a toe portion 6550, a heel portion 6560, a front portion 6570, and a rear portion 6580. The bottom portion 6540 may include a skirt portion (not shown) defined as a side portion of the golf club head 6500 between the top portion 6530 and the bottom portion 6540 excluding the front portion 6570 and extending across a periphery of the golf club head 6500 from the toe portion 6550, around the rear portion 6580, and to the heel portion 6560. The front portion 6570 may include a face portion 6575 to engage a golf ball (not shown). The golf club head 6500 may have a neutral axis 6801. The neutral axis 6801 may be perpendicular to the face portion 6575 and may intersect a center of the face portion 6575. The body portion 6510 may also include a hosel portion 6565 that may be similar in many respects to any of the hosel portions described herein. Alternatively, the body portion 6510 may include a bore instead of the hosel portion 6565. The body portion 6510 may be made partially or entirely from any of the materials described herein. The golf club head 6500 may have a club head volume greater than or equal to 300 cubic centimeters (cm3 or cc). In one example, the golf club head 6500 may be about 460 cc. Alternatively, the golf club head 6500 may have a club head volume less than or equal to 300 cc. For example, the golf club head 6500 may have a club head volume between 100 cc and 200 cc. Further, the golf club head 6500 may be any type of golf club head having a club head volume similar to the club head volume of any of the golf club heads described herein. A maximum front-to-rear distance of the golf club head 6500 may be greater than a maximum heel-to-toe distance of the golf club head 6500. The apparatus, methods, and articles of manufacture described herein are not limited in this regard.

The crown portion 6535 may be a separate piece that may be attached to the top portion 6530. The crown portion 6535 may be constructed from one or more different materials than the body portion 6510. In one example (not shown), the crown portion 6535 may be at least partially constructed from a composite material such as a graphite-based composite material. In another example (not shown), the crown portion 6535 may include two outer layers constructed from a composite material, such as a graphite epoxy composite material, and an inner layer constructed from a polymer material. The apparatus, methods, and articles of manufacture described herein are not limited in this regard.

The bottom portion 6540 may include a plurality of port regions, which are shown for example as a first port region 6610, a second port region 6620 and a third port region 6630. The first port region 6610 may be near the toe portion 6550, closer to the toe portion 6550 than the heel portion 6560, or between the toe portion 6550 and the rear portion 6580 at or proximate to a periphery of the body portion 6510. The first port region 6610 may include a first set of ports 6611 (generally shown as ports 6612, 6614 and 6616). The second port region 6620 may be near the front portion 6570 or be closer to the front portion 6570 than the rear portion 6580 and include a second set of ports 6621 (generally shown as ports 6622, 6624 and 6626). The third port region 6630 may be near the heel portion 6560, be closer to the heel portion 6560 than the toe portion 6550, or between the heel portion 6560 and the rear portion 6580 at or proximate to a periphery of the body portion 6510. The third port region 6630 may include a third set of ports 6631 (generally shown as ports 6632, 6634 and 6636). The bottom portion may include more than three port regions or less than three port regions with each port region including any number of ports. The body portion 6510 may include a plurality of mass portions, shown as a first set of mass portions 6660 (generally shown as mass portions 6662, 6664, and 6666), a second set of mass portions 6670 (generally shown as mass portions 6672, 6674, and 6676), and a third set of mass portions 6680 (generally shown as mass portions 6682, 6684 and 6686). Each port may receive a mass portion similar to any of the golf club heads described herein. In one example, one or more ports may not include mass portions. The characteristics (e.g., density, shape, volume, size, color, dimensions, depth, diameter, materials of construction, mass, method of formation, etc.) and/or any other properties of each port and/or mass portion may be similar or different. Further, the characteristics (e.g., density, shape, volume, size, color, dimensions, depth, diameter, materials of construction, mass, method of formation, etc.) and/or any other properties of each port and/or mass portion may be similar in many respects to or different from each mass portion and port, respectively, of any of the golf club heads described herein. In one example, the ports and the mass portions of the golf club head of FIGS. 65-68 may have one or more greater dimensions (i.e., length, width, diameter, depth, etc.) than any of the ports and/or mass portions, respectively, described herein. In another example, the ports and the mass portions of the golf club head of FIGS. 65-68 may have one or more smaller dimensions (i.e., length, width, diameter, depth, etc.) than any of the ports and/or mass portions, respectively, described herein. The apparatus, methods, and articles of manufacture described herein are not limited in this regard.

The mass portions of the first set of mass portions 6660, the second set of mass portions 6670 and/or the third set of mass portions 6680 may have similar or different masses. In one example, the overall mass of the first set of mass portions 6660 may be greater than the overall mass of the second set of mass portions 6670 and/or the third set of mass portions 6680. In another example, the overall mass of the second set of mass portions 6670 may be greater than the overall mass of the first set of mass portions 6660 and/or the third set of mass portions 6680. In yet another example, the overall mass of the third set of mass portions 6680 may be greater than the overall mass of the second set of mass portions 6670 and/or the first set of mass portions 6660. The masses of the mass portions in each of the first set of mass portion 6660, the second set of mass portions 6670 and/or the third set of mass portions 6680 may be similar or different. Accordingly, by using mass portions having similar or different masses in each of the port regions 6610, 6620 and/or 6630, the overall mass in each port region and/or the mass distribution in each port region may be adjusted to generally optimize and/or adjust the swing weight, center of gravity, moment of inertia, and/or an overall feel of the golf club head for an individual using the golf club head 6500. The apparatus, methods, and articles of manufacture described herein are not limited in this regard.

The outer surface 6542 and/or the inner surface 6544 of the bottom portion 6540 may include one or more inner support portions (not shown) and/or one or more outer support portion (not shown) similar to any of the inner support portions and the outer support portions described herein. The apparatus, methods, and articles of manufacture described herein are not limited in this regard.

Figure 68:
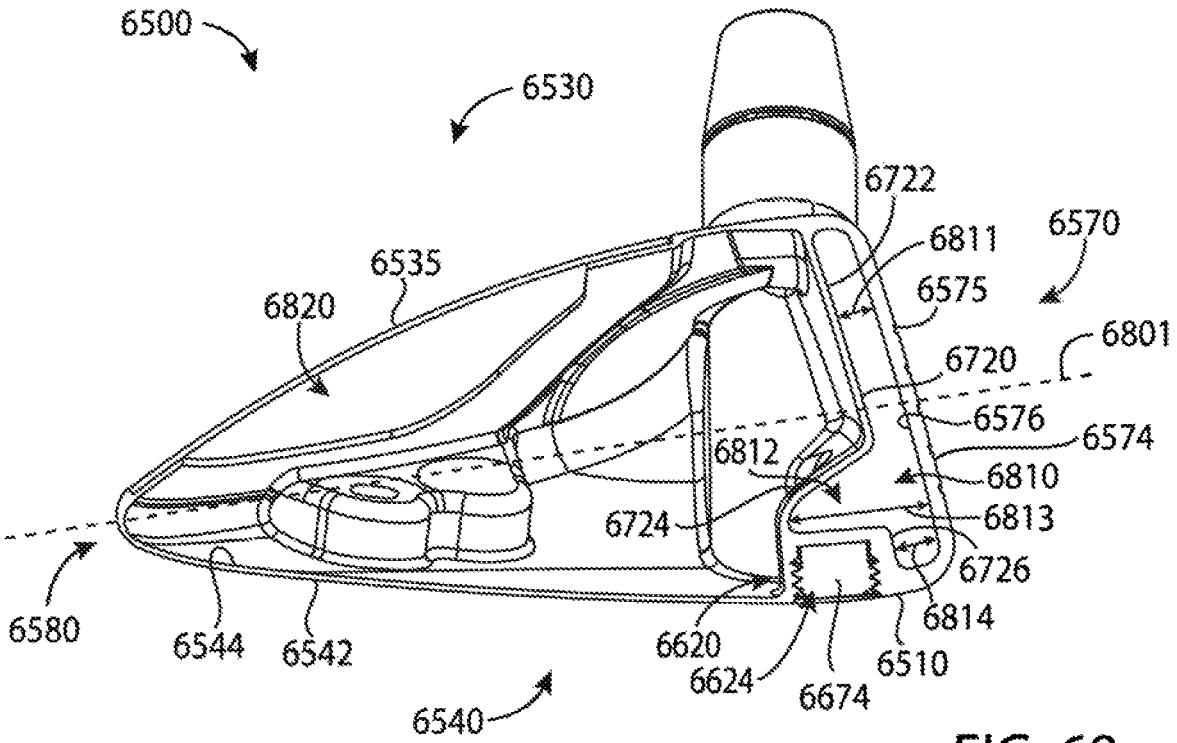
FIG. 68 depicts a cross-sectional view of the golf club head of FIG. 65 along line 68-68 of FIG. 65.

Certain regions of the interior of the body portion 6510 may include a polymer material, which may also be referred to herein as the filler material, similar to any of the polymer materials described herein. The filler material may dampen vibration, dampen noise, lower the center of gravity and/or provide a better feel and sound for the golf club head 6500 when striking a golf ball (not shown). The golf club head 6500, may have one or more interior regions and/or cavities that may include a filler material similar to any of the golf club heads described herein. In one example, as shown in FIG. 68, the body portion 6510 may include a cavity wall portion 6720. The cavity wall portion 6720 may form a first interior cavity portion 6810 and a second interior cavity portion 6820 within the body portion 6510. The first interior cavity portion 6810 and the second interior cavity portion 6820 may be separated by the cavity wall portion 6720. Alternatively, the first interior cavity portion 6810 and the second interior cavity portion 6820 may be connected through one or more openings in the cavity wall portion 6720. The apparatus, methods, and articles of manufacture described herein are not limited in this regard.

For example, the cavity wall portion 6720 may be made partially or entirely of an aluminum-based material, a steel-based material, any other suitable material, or any combination thereof. In another example, the cavity wall portion 6720 may be made partially or entirely of a non-metal material such as a ceramic material, a composite material, any other suitable material, or any combination thereof. In another example, the cavity wall portion 6720 may be formed with the body portion 6510. The first interior cavity portion 6810 may be associated with a first volume, and the second interior cavity portion 6820 may be associated with a second volume. The first volume may be less than, equal to, or greater than the second volume. In one example, the first volume may be less than or equal to 50% of the second volume. In another example, the first volume may be less than or equal to 40% of the second volume. In yet another example, the first volume may be between 30% and 70% of the second volume. In yet another example, the first volume may be between 10% and 90% of the second volume. The apparatus, methods, and articles of manufacture described herein are not limited in this regard.

As illustrated in FIG. 68, the cavity wall portion 6720 may include a first wall portion 6722 extending from a location at or proximate to the top portion 6530 toward the bottom portion 6540. The first wall portion 6722 may extend toward the bottom portion 6540 at a certain angle or orientation relative to the face portion 6575. In one example, the first wall portion 6722 may extend toward the bottom portion 6540 and away from the face portion 6575. Accordingly, a first width 6811 ($W_{C1}$) of the first interior cavity portion 6810 may increase in a direction from the top portion 6530 to the bottom portion 6540. In another example, the first wall portion 6722 may extend toward the bottom portion 6540 and toward the face portion 6575. Accordingly, the first width 6811 of the first interior cavity portion 6810 may decrease in a direction from the top portion 6530 to the bottom portion 6540. In the illustrated example of FIG. 68, the first wall portion 6722 of the of the cavity wall portion 6720 may extend from a location at or proximate to the top portion 6530 generally parallel or substantially parallel with the face portion 6575. Accordingly, the first width 6811 of the first interior cavity portion 6810 may be constant or substantially constant. The apparatus, methods, and articles of manufacture described herein are not limited in this regard.

The first interior cavity portion 6810 may include an enlarged cavity portion 6812 between the top portion 6530 and the bottom portion 6540. As shown in the illustrated example of FIG. 68, the enlarged cavity portion 6812 extends partially or fully over the second port region 6620. Accordingly, the enlarged cavity portion 6812 may have a second width 6813 ($W_{c2}$) of the first interior cavity portion 6810 that may be greater than the first width 6811 of the first interior cavity portion 6810. The second width 6813 may be about two times greater than the first width 6811. The second width 6813 may be at least two times greater than the first width 6811. The enlarged cavity portion 6812 may be located at least partially below the neutral axis 6801 of the golf club head 6500. The enlarged cavity portion 6812 may be located wholly below a neutral axis 6801 of the golf club head 6500. The first width 6811 may be located above the neutral axis 6801. The second width 6813 may be located below the neutral axis 6801. The enlarged cavity portion 6812 may be defined by a second wall portion 6724 that may extend from the first wall portion 6722 toward the rear portion 6580 and the bottom portion 6540, and traverse back over the second port region 6620. The first interior cavity portion 6810 may include a third wall portion 6726 that extends from the second wall portion 6724 to a location at or proximate to the bottom portion 6540. The first interior cavity portion 6810 may have a third width 6814 ($W_{c3}$) extending from the third wall portion 6726 to the back surface 6576 of the face portion 6575. The third width 6814 may be located below the enlarged cavity portion 6812. The third width 6814 may be located below the second width 6813. The third width 6814 may be less than the second width 6813. The third width 6814 may be substantially equal to the first width 6811. As shown in the illustrated example of FIG. 68, the third width 6814 may be located between the second port region 6620 and the face portion 6575. The third width 6814 may be located proximate to the bottom portion.

In other examples, the first interior cavity portion 6810 may be configured similar any of the interior cavities described herein and shown in FIGS. 56-64. The apparatus, methods, and articles of manufacture described herein are not limited in this regard.

In another example, the first width 6811 may be similar to the second width 6813 of the first interior cavity portion 6810 (not shown). Accordingly, the first wall portion 6722 of the cavity wall portion 6720 may located farther back toward the rear portion 6580 than the location of the first wall portion 6722 shown in FIG. 68 such that the portion of the first interior cavity portion 6810 above the second port region 6620 extends over the one or more ports of the second port region 6620. The apparatus, methods, and articles of manufacture described herein are not limited in this regard.

In one example, the first interior cavity portion 6810 may be unfilled (i.e., empty space). Alternatively, the first interior cavity portion 6810 may be partially or entirely filled with a filler material (i.e., a cavity filling portion), which may include one or more similar or different types of materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material (s) (e.g., adhesive), and/or other suitable types of materials that may absorb shock, isolate vibration, and/or dampen noise. For example, at least 50% of the first interior cavity portion 6810 may be filled with a TPE material to absorb shock, isolate vibration, and/or dampen noise when the golf club head 100 strikes a golf ball via the face portion 6575. In one example, the first interior cavity portion 6810 may be partially or entirely filled with a filler material through a port (e.g. 6624) located in the bottom portion 6540. In one example, as shown in FIG. 68, the port 6624 may include an opening that accesses the first interior cavity portion 6810. The opening may provide a fluid pathway for filler material to be introduced to the first interior cavity portion 6810. The apparatus, methods, and articles of manufacture described herein are not limited in this regard.

In another example, the filler material may be a polymer material such as an ethylene copolymer material that may absorb shock, isolate vibration, and/or dampen noise when the golf club head 6500 strikes a golf ball via the face portion 6575. In particular, at least 50% of the first interior cavity portion 6810 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard.

For example, the filler material may have a density of less than or equal to 1.5 g/cm$^3$. The filler material may have a compression deformation value ranging from about 0.0787 inch (2 mm) to about 0.1968 inch (5 mm). The filler material may have a surface Shore D hardness ranging from 40 to 60. As mentioned above, the filler material may be associated with a relatively high coefficient of restitution (COR). The filler material may be associated with a first COR ($COR_1$) and the face portion 6575 may be associated with a second COR ($COR_2$), which may be similar or different from the first COR. The first and second CORs may be associated with a COR ratio (e.g., $COR_{12}$ ratio=$COR_1/COR_2$ or $COR_{21}$ ratio=$COR_2/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The golf club head 6500 may be associated with a third COR ($COR_3$), which may be similar or different from the first COR and/or the second COR. As mentioned above, the filler material may be associated with the first COR. The first and third CORs may be associated with a COR ratio (e.g., $COR_{13}$ ratio=$COR_1/COR_3$ or $COR_{31}$ ratio=$COR_3/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The CORs of the filler material, the face portion 6575, and/or the golf club head 6500 (e.g., the first COR ($COR_1$), the second COR ($COR_2$), and/or the third COR ($COR_3$), respectively) may be measured by methods similar to methods that measure the COR of a golf ball and/or a golf club head as defined by one or more golf standard organizations and/or governing bodies (e.g., United States Golf Association (USGA)). In one example, an air cannon device may launch or eject an approximately 1.55 inch (38.1 mm) spherical sample of the filler material at an initial velocity toward a steel plate positioned at about 4 feet (1.2 meters) away from the air cannon device. The sample may vary in size, shape or any other configuration. A speed monitoring device may be located at a distance in a range from 2 feet (0.6 meters) to 3 feet (0.9 meters) from the air cannon device. The speed monitoring device may measure a rebound velocity of the sample of the filler material after the sample of the filler material strikes the steel plate. The COR may be the rebound velocity divided by the initial velocity. In one example, the filler material may have a COR value in a range from approximately 0.50 to approximately 0.95 when measured with an initial velocity in a range from 100 ft/s (30.48 m/s) to 250 ft/s (76.2 m/s). In another example, the filler material may have a COR value in a range from approximately 0.65 to approximately 0.85 when measured with an initial velocity in a range from 100 ft/s (30.48 m/s) to 150 ft/s (45.72 m/s). In another example, the filler material may have a COR value in a range from approximately 0.75 to approximately 0.8 when measured with an initial velocity in a range 100 ft/s (30.48 m/s) to 150 ft/s (45.72 m/s). In another example, the filler material may have a COR value in a range from approximately 0.55 to approximately 0.90 when measured with an initial velocity in a range from 100 ft/s (30.48 m/s) and 250 ft/s (76.2 m/s). In another example, the filler material may have a COR value in a range from approximately 0.75 to approximately 0.85 when measured with an initial velocity in a range 110 ft/s (33.53 m/s) to 200 ft/s (60.96 m/s). In yet another example, the filler material may have a COR value in a range from approximately 0.8 to approximately 0.9 when measured with an initial velocity of about 125 ft/s (38.1 m/s). While a particular example may be described above, other methods may be used to measure the CORs of the filler material, the face portion 6575, and/or the golf club head 6500. The apparatus, methods, and articles of manufacture described herein are not limited in this regard.

When the face portion 6575 of the golf club head 6500 strikes a golf ball, the face portion 6575 and the filler material may deform and/or compress. The kinetic energy of the impact may be transferred to the face portion 6575 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 6500.

The filler material may include a bonding portion. In one example, the bonding portion may be one or more bonding agents (e.g., one or more adhesive or epoxy materials). For example, the bonding agent may assist in bonding or adhering the filler material to at least a back surface 6576 of the face portion 6575. The bonding agent may also absorb shock, isolate vibration, and/or dampen noise when the golf club head 6500 strikes a golf ball via the face portion 6575. Further, the bonding agent may be an epoxy material that may be flexible or slightly flexible when cured. In one example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In yet another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

Further, the filler material may include a combination of one or more bonding agents such as any of the bonding agents described herein and one or more polymer materials such as any of the polymer materials described herein. In one example, the filler material may include one or more bonding agents that may be used to bond the polymer material to the back surface 6576 of the face portion 6575. The one or more bonding agents may be applied to the back surface 6576 of the face portion 6575. The filler material may further include one or more polymer materials that may partially or entirely fill the remaining portions of the first interior cavity portion 6810. Accordingly, two or more separate materials may partially or entirely fill the first interior cavity portion 6810. The apparatus, methods, and articles of manufacture described herein are not limited in this regard.

The filler material may only include one or more polymer materials that adhere to inner surface(s) of the first interior cavity portion 6810 without a separate bonding agent (e.g., an adhesive or epoxy material). For example, the filler material may include a mixture of one or more polymer materials and one or more bonding agents (e.g., adhesive or epoxy material(s)). Accordingly, the mixture including the one or more polymer materials and the one or more bonding agents may partially or entirely fill the first interior cavity portion 6810 and adhere to inner surface(s) of the first interior cavity portion 6810. In another example, the first interior cavity portion 6810 may be partially or entirely filled with one or more polymer materials without any bonding agents. In yet another example, the first interior cavity portion 6810 may be partially or entirely filled with one or more bonding agents and/or adhesive materials such as an adhesive or epoxy material. The apparatus, methods, and articles of manufacture described herein are not limited in this regard.

For example, at least 50% of the first interior cavity portion 6810 may be filled with a filler material to absorb shock, isolate vibration, dampen noise, and/or provide structural support when the golf club head 6500 strikes a golf ball via the face portion 6575. With the support of the cavity wall portion 6720 to form the first interior cavity portion 6810 and filling at least a portion of the first interior cavity portion 6810 with a filler material, the face portion 6575 may be relatively thin without degrading the structural integrity, sound, and/or feel of the golf club head 6500. In one example, the face portion 6575 may have a thickness of less than or equal to 0.075 inch (e.g., a distance between a front surface 6574 and the back surface 6576). In another example, the face portion 6575 may have a thickness of less than or equal to 0.2 inch. In another example, the face portion 6575 may have a thickness of less than or equal to 0.06 inch. In yet another example, the face portion 6575 may have a thickness of less than or equal to 0.05 inch. Further, the face portion 6575 may have a thickness of less than or equal to 0.03 inch. In yet another example, a thickness of the face portion 6575 may be greater than or equal to 0.03 inch and less than or equal to 0.2 inch. The apparatus, methods, and articles of manufacture described herein are not limited in this regard.

In one example, the filler material may be injected into the first interior cavity portion 6810 from one or more of the ports of the body portion 6510. For example, one or more of the ports 6622, 6624, and 6626 of the second port region 6620 may be connected to the first interior cavity portion 6810 for injection molding the filler material in the first interior cavity portion 6810 and/or applying any bonding agent to the first interior cavity portion 6810. In another example, another one of the ports of the second port region 6620 may be connected to the first interior cavity portion 6810 so that the air that is displaced by the filler material injected into the body portion 6510 can escape. The apparatus, methods, and articles of manufacture described herein are not limited in this regard.

In the illustrated example of FIGS. 65-68, the second interior cavity portion 6820 may be unfilled (i.e., empty space). Alternatively (not shown), the second interior cavity portion 6820 may be partially or entirely filled with a filler material (i.e., a cavity filling portion), which may include one or more similar or different types of materials described herein and may be different or similar to the filler material used to fill the first interior cavity portion 6810. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a top portion, a bottom portion, a rear portion, a neutral axis, and a front portion having a face portion;

a cavity wall portion extending from the top portion to the bottom portion;

a first interior cavity portion between the face portion and the cavity wall portion, the first interior cavity portion having a maximum first width above the neutral axis and a maximum second width below the neutral axis; and a second interior cavity portion between the cavity wall portion and the rear portion, wherein the maximum second width is greater than the maximum first width.

2. A golf club head as defined in claim 1, the cavity wall portion comprising:

a first wall portion extending from the top portion toward the bottom portion;

a second wall portion extending from the first wall portion toward the rear portion and the bottom portion; and a third wall portion extending from the second wall portion to the bottom portion.

3. A golf club head as defined in claim 1, wherein the first interior cavity portion is at least partially filled with a polymer material, the polymer material coupled to the face portion and the cavity wall portion.

4. A golf club head as defined in claim 1, wherein the first interior cavity portion further comprises a third width below the maximum second width, the third width being less than the maximum second width.

5. A golf club head as defined in claim 1 further comprising a plurality of mass portions coupled to the bottom portion, the plurality of mass portions located closer to the front portion than the rear portion, wherein the first interior cavity portion at least partially extends over at least one of the plurality of mass portions.

6. A golf club head as defined in claim 1 further comprising a first set of mass portions and a second set of mass portions, the first set of mass portions coupled to the bottom portion and located closer to the toe portion than the heel portion, the second set of mass portions coupled to the bottom portion and located closer to the heel portion than the toe portion.

7. A golf club head as defined in claim 1, wherein the cavity wall portion is located less than or equal to 1.0 inch (25.4 millimeters) rearward from the face portion.

8. A golf club head as defined in claim 1, wherein the first interior cavity portion is associated with a first volume, the second interior cavity portion is associated with a second volume, and the first volume is less than or equal to 50% of the second volume.

9. A golf club head comprising:

a body portion having a toe portion, a heel portion, a top portion, a bottom portion, a rear portion, and a front portion having a face portion;

a cavity wall portion located within the body portion and rearward of the face portion, the cavity wall portion extending from the toe portion to the heel portion and extending from the top portion to the bottom portion, the cavity wall portion comprising:

a first wall portion extending from the top portion toward the bottom portion;

a second wall portion extending from the first wall portion toward the rear portion and the bottom portion; and a third wall portion extending from the second wall portion to the bottom portion;

a first interior cavity portion between the cavity wall portion and the face portion; and a second interior cavity portion between the cavity wall portion and the rear portion.

10. A golf club head as defined in claim 9, the first interior cavity portion comprising an enlarged cavity portion below a neutral axis of the body portion, the enlarged cavity portion having a maximum width greater than a maximum width of the first interior cavity portion above the neutral axis.

11. A golf club head as defined in claim 9, wherein the first interior cavity portion is at least 50% filled with a polymer material, the polymer material extending from the face portion to the cavity wall portion.

12. A golf club head as defined in claim 9 further comprising a plurality of mass portions coupled to the bottom portion and located closer to the front portion than the rear portion, wherein the first interior cavity portion at least partially extends over at least one of the plurality of mass portions.

13. A golf club head as defined in claim 9 further comprising a first set of mass portions coupled to the bottom portion and located closer to the toe portion than the heel portion, and a second set of mass portions coupled to the bottom portion and located closer to the heel portion than the toe portion.

14. A golf club head as defined in claim 9, wherein the cavity wall portion is less than or equal to 1.0 inch (25.4 millimeters) rearward from the face portion.

15. A golf club head as defined in claim 9, wherein the first interior cavity portion is associated with a first volume, the second interior cavity portion is associated with a second volume, and the first volume is less than or equal to 50% of the second volume.

16. A golf club head comprising:

a body portion having a toe portion, a heel portion, a top portion, a bottom portion, a rear portion, a neutral axis, and a front portion having a face portion;

a cavity wall portion located less than or equal to 1.0 inch (25.4 millimeters) rearward from the face portion, the cavity wall portion extending from the toe portion to the heel portion and from the top portion to the bottom portion;

a first interior cavity portion extending from the cavity wall portion to the face portion, the first interior cavity portion comprising an enlarged cavity portion below the neutral axis, the enlarged cavity portion having a maximum width greater than a maximum width of the first interior cavity portion above the neutral axis; and a second interior cavity portion extending from the cavity wall portion to the rear portion.

17. A golf club head as defined in claim 16 further comprising a port extending through the bottom portion to the first interior cavity portion, wherein the first interior cavity portion is at least partially filled with a polymer material.

18. A golf club head as defined in claim 16 further comprising a plurality of mass portions coupled to the bottom portion, wherein the first interior cavity portion at least partially extends over at least one of the plurality of mass portions.

19. A golf club head as defined in claim 16 further comprising a first mass portion coupled to the bottom portion and located closer to the toe portion than the heel portion, and a second mass portion coupled to the bottom portion and located closer to the heel portion than the toe portion.

20. A golf club head as defined in claim 16 further comprising a polymer material extending from the face portion to the cavity wall portion, wherein the face portion has a thickness less than or equal to 0.075 inch.

* * * * *